US010895219B2

(12) United States Patent
Fujita et al.

(10) Patent No.: US 10,895,219 B2
(45) Date of Patent: Jan. 19, 2021

(54) CYLINDER BORE WALL THERMAL INSULATOR, INTERNAL COMBUSTION ENGINE, AND AUTOMOBILE

(71) Applicant: NICHIAS CORPORATION, Tokyo (JP)

(72) Inventors: Yoshifumi Fujita, Tokyo (JP); Tatsunori Kataoka, Tokyo (JP)

(73) Assignee: NICHIAS CORPORATION, Tokyo (JP)

( * ) Notice: Subject to any disclaimer, the term of this patent is extended or adjusted under 35 U.S.C. 154(b) by 0 days.

(21) Appl. No.: 16/485,947

(22) PCT Filed: Feb. 13, 2018

(86) PCT No.: PCT/JP2018/004880
§ 371 (c)(1),
(2) Date: Aug. 14, 2019

(87) PCT Pub. No.: WO2018/151092
PCT Pub. Date: Aug. 23, 2018

(65) Prior Publication Data

US 2020/0018255 A1 Jan. 16, 2020

(30) Foreign Application Priority Data

Feb. 15, 2017 (JP) ..... 2017-025802

(51) Int. Cl.
*F02F 1/40* (2006.01)
*F01P 3/02* (2006.01)
*F02F 1/24* (2006.01)

(52) U.S. Cl.
CPC ..... *F02F 1/40* (2013.01); *F01P 3/02* (2013.01); *F01P 2003/024* (2013.01); *F02F 2001/249* (2013.01)

(58) Field of Classification Search
CPC ..... F02F 1/14; F02F 1/166; F02F 1/16; F02F 1/163; F02F 2001/104; F02F 2001/106;
(Continued)

(56) References Cited

U.S. PATENT DOCUMENTS

2009/0194046 A1* 8/2009 Shikida ..... F02F 1/14 123/41.74
2010/0242868 A1* 9/2010 Shikida ..... F01P 3/02 123/41.79

(Continued)

FOREIGN PATENT DOCUMENTS

CN 106133299 11/2016
CN 106170619 11/2016

(Continued)

OTHER PUBLICATIONS

Office Action for CN Application No. 201880012206.2 dated Dec. 25, 2019 (with translation), 26 pages.

(Continued)

*Primary Examiner* — Long T Tran
(74) *Attorney, Agent, or Firm* — Nixon & Vanderhye P.C.

(57) ABSTRACT

A thermal insulator for a cylinder bore wall section having a shape conforming to a shape of the groove-like coolant passage in a setting position of the thermal insulator, in which each of the bore wall insulating sections includes a rubber member, a rear surface pressing member, and elastic members, a coolant passage opening through which coolant flowing on a rear surface side of the supporting section passes to flow to an inner side of the supporting section is formed on at least one place of upper portions of supporting section inter-bore portions, the supporting section has a guide wall formed in a vicinity of the coolant passage opening, and has an inclined wall formed on the rear surface side of the supporting section bore portion, and only a center or a vicinity of the center in an arc direction of each of the (Continued)

bore wall insulating sections is fixed to the supporting section.

12 Claims, 29 Drawing Sheets

(58) Field of Classification Search
CPC ..... F02F 1/10; F01P 2003/021; F01P 3/02; F01P 7/14; F01P 2003/028; F01P 2003/024
See application file for complete search history.

(56) References Cited

U.S. PATENT DOCUMENTS

| | | | | |
|---|---|---|---|---|
| 2017/0022929 | A1* | 1/2017 | Karita | F02F 1/166 |
| 2017/0030289 | A1 | 2/2017 | Okawa et al. | |
| 2017/0350306 | A1* | 12/2017 | Makino | F02F 1/14 |
| 2018/0094568 | A1* | 4/2018 | Yanagi | F01P 3/02 |

FOREIGN PATENT DOCUMENTS

| | | | |
|---|---|---|---|
| EP | 3 168 449 | | 5/2017 |
| JP | 2006-090194 | | 4/2006 |
| JP | 2006090194 | A * | 4/2006 |
| JP | 2008-031939 | | 2/2008 |
| JP | 2015-113770 | | 6/2015 |
| JP | 2015108345 | | 6/2015 |
| JP | 2015-200303 | | 11/2015 |
| JP | 2015-203312 | | 11/2015 |

OTHER PUBLICATIONS

International Search Report for PCT/JP2018/004880, dated Apr. 17, 2018, 5 pages.
Search Report issued in EP Appln. No. 18754020.8 dated Nov. 10, 2020.

* cited by examiner (A)

(B)

(C)

(A)

(B)

(A)

(B)

(A)

(B)

(C)

CYLINDER BORE WALL THERMAL INSULATOR, INTERNAL COMBUSTION ENGINE, AND AUTOMOBILE

This application is the U.S. national phase of International Application No. PCT/JP2018/004880 filed 13 Feb. 2018, which designated the U.S. and claims priority to JP Patent Application No. 2017-025802 filed 15 Feb. 2017, the entire contents of each of which are hereby incorporated by reference.

TECHNICAL FIELD

The present invention relates to a thermal insulator disposed in contact with a wall surface on a groove-like coolant passage side of a cylinder bore wall of a cylinder block of an internal combustion engine, an internal combustion engine including the thermal insulator, and an automobile including the internal combustion engine.

BACKGROUND ART

An internal combustion engine has a structure in which an explosion of fuel occurs at a top dead center of a piston in a bore and the piston is pushed down by the explosion, temperature rises on an upper side of a cylinder bore wall and temperature falls on a lower side of the cylinder bore wall. Therefore, a difference occurs in a thermal deformation amount between the upper side and the lower side of the cylinder bore wall. Expansion is large on the upper side and, on the other hand, expansion is small on the lower side.

As a result, frictional resistance between the piston and the cylinder bore wall increases. This causes a decrease in fuel efficiency. Therefore, there is a need to reduce the difference in the thermal deformation amount between the upper side and the lower side of the cylinder bore wall.

Therefore, in order to equalize a wall temperature of the cylinder bore wall, it has been conventionally attempted to set a spacer in the groove-like coolant passage for adjusting a flow of coolant in the groove-like coolant passage and controlling the cooling efficiency on the upper side and the cooling efficiency on the lower side of the cylinder bore wall by the coolant. For example, Patent Literature 1 discloses a heat medium passage partitioning member for cooling an internal combustion engine that is a passage partitioning member disposed in a groove-like heat medium passage for cooling formed in a cylinder block of the internal combustion engine, to thereby partition the groove-like heat medium passage for cooling into a plurality of passages, the passage partitioning member including: a passage dividing member that is formed at height smaller than the depth of the groove-like heat medium passage for cooling and functioning as a wall section that divides the groove-like heat medium passage for cooling into a bore side passage and a counter-bore side passage; and a flexible lip member that is formed from the passage dividing member toward an opening of the groove-like heat medium passage for cooling and formed of a flexible material in a manner in which a distal edge portion extends beyond one inner surface of the groove-like heat medium passage for cooling, whereby, after completion of insertion into the groove-like heat medium passage for cooling, the distal edge portion comes into contact with the inner surface in an intermediate position in a depth direction of the groove-like heat medium passage for cooling with a deflection restoration force of the distal edge portion to separate the bore side passage and the counter-bore side passage.

CITATION LIST

Patent Literature

[Patent Literature 1]
Japanese Patent Laid-Open No. 2008-31939 (Claims)

SUMMARY OF INVENTION

Technical Problem

In the heat medium passage partitioning member for cooling an internal combustion engine in Patent Literature 1, the wall temperature of the cylinder bore wall can be equalized to some extent. Therefore, it is possible to reduce the difference in the thermal deformation amount between the upper side and the lower side of the cylinder bore wall. However, in recent years, there is a need to further reduce the difference in the thermal deformation amount between the upper side and the lower side of the cylinder bore wall.

Accordingly, in recent years, the wall temperature of the cylinder bore wall is equalized by actively insulating, with the thermal insulator, the wall surface on the cylinder bore side in the groove-like coolant passage of the cylinder block. In order to effectively insulate the wall surface on the cylinder bore side in the groove-like coolant passage, it is demanded that adhesion of the thermal insulator to the wall surface on the cylinder bore side in the groove-like coolant passage is high.

In a circumferential direction of the cylinder bore wall, the cylinder bore wall does not need to be uniformly insulated in the entire circumferential direction, and has a portion which needs to be insulated and a portion which does not need to be insulated. Therefore, it is demanded to insulate only the portion which needs to be insulated.

In recent years, an internal combustion engine in which an air-fuel ratio which is a ratio between the air and the fuel supplied into the cylinder is larger than the air-fuel ratio of the conventional internal combustion engine is developed. In such an internal combustion engine, the temperature of an upper portion of the cylinder bore wall, specifically, the temperature of the upper portion of a boundary of the bore walls of the cylinder bores and the vicinity of the boundary is higher than the temperature of the conventional internal combustion engine. Therefore, it is demanded to increase the cooling efficiency of the upper portion of the boundary of the bore walls of the cylinder bores and the vicinity of the boundary.

Therefore, an object of the present invention is to provide a thermal insulator that has high adhesion to a wall surface on a cylinder bore side of a groove-like coolant passage, can insulate selectively a portion which needs to be insulated, and has high cooling efficiency of an upper portion of a boundary of the bore walls of the cylinder bores and the vicinity of the boundary.

Solution to Problem

The above problems are solved by the present invention described below.

That is, the present invention (1) provides a thermal insulator for a cylinder bore wall set in a groove-like coolant passage of a cylinder block of an internal combustion engine including cylinder bores and for insulating all of bore walls in a circumferential direction of all the cylinder bores or a part of the bore walls in the circumferential direction of all the cylinder bores when viewed in the circumferential direction, the thermal insulator including: bore wall insulating sections having an arcuate shape when viewed from above and for insulating a wall surface on the cylinder bore side of the groove-like coolant passage; and a supporting section having a shape conforming to a shape of the groove-like coolant passage in a setting position of the thermal insulator, the bore wall insulating sections being fixed to the supporting section, wherein each of the bore wall insulating sections includes: a rubber member in contact with the wall surface on the cylinder bore side of the groove-like coolant passage and for covering the wall surface on the cylinder bore side of the groove-like coolant passage; a rear surface pressing member provided on a rear surface side of the rubber member and for pressing the entire rubber member toward the wall surface on the cylinder bore side of the groove-like coolant passage from the rear surface side; and elastic members that urge the rear surface pressing member to press the rubber member toward the wall surface on the cylinder bore side of the groove-like coolant passage, in each of supporting section bore portions to which the respective bore wall insulating sections are to be fixed, an opening, through which the elastic member passes from an inner side to the rear surface side of the supporting section is formed, a coolant passage opening through which coolant flowing on the rear surface side of the supporting section passes to flow to the inner side of the supporting section is formed on at least one place of upper portions of supporting section inter-bore portions, the supporting section has a guide wall for guiding the coolant formed in a vicinity of the coolant passage opening, such that the coolant flows into the coolant passage opening, and has an inclined wall formed on the rear surface side of the supporting section at a position where the coolant is supplied into the groove-like coolant passage, the inclined wall extending with an upward inclination to create a flow of the coolant toward the coolant passage opening, and only a center or a vicinity of the center in an arc direction of each of the bore wall insulating sections is fixed to the supporting section.

The present invention (2) provides a thermal insulator for a cylinder bore wall set in a groove-like coolant passage of a cylinder block of an internal combustion engine including cylinder bores and for insulating all of bore walls in a circumferential direction of all the cylinder bores or a part of the bore walls in the circumferential direction of all the cylinder bores when viewed in the circumferential direction, the thermal insulator including: bore wall insulating sections having an arcuate shape when viewed from above and for insulating a wall surface on the cylinder bore side of the groove-like coolant passage; and a supporting section having a shape conforming to a shape of the groove-like coolant passage in a setting position of the thermal insulator, the bore wall insulating sections being fixed to the supporting section, wherein each of the bore wall insulating sections includes: a rubber member in contact with the wall surface on the cylinder bore side of the groove-like coolant passage and for covering the wall surface on the cylinder bore side of the groove-like coolant passage; a rear surface pressing member provided on a rear surface side of the rubber member and for pressing the entire rubber member toward the wall surface on the cylinder bore side of the groove-like coolant passage from the rear surface side; and elastic members that urge the rear surface pressing member to press the rubber member toward the wall surface on the cylinder bore side of the groove-like coolant passage, in each of supporting section bore portions to which the respective bore wall insulating sections are to be fixed, an opening, through which the elastic member passes from an inner side to the rear surface side of the supporting section is formed, a coolant passage opening through which coolant flowing on the rear surface side of the supporting section passes to flow to the inner side of the supporting section is formed on at least one place of upper portions of supporting section inter-bore portions, the supporting section has a guide wall for guiding the coolant formed in a vicinity of the coolant passage opening, such that the coolant flows into the coolant passage opening, and a coolant gathering wall extending with an upward inclination toward the guide wall, and only a center or a vicinity of the center in an arc direction of each of the bore wall insulating sections is fixed to the supporting section.

The present invention (3) provides a thermal insulator for a cylinder bore wall set in the groove-like coolant passage of a cylinder block of an internal combustion engine including cylinder bores and for insulating all of bore walls in a circumferential direction of all the cylinder bores when viewed in the circumferential direction, the thermal insulator including: bore wall insulating sections having an arcuate shape when viewed from above and for insulating a wall surface on the cylinder bore side of the groove-like coolant passage; and a supporting section having a shape conforming to a shape of the groove-like coolant passage in a setting position of the thermal insulator, the bore wall insulating sections being fixed to the supporting section, wherein each of the bore wall insulating sections includes: a rubber member in contact with the wall surface on the cylinder bore side of the groove-like coolant passage and for covering the wall surface on the cylinder bore side of the groove-like coolant passage; a rear surface pressing member provided on a rear surface side of the rubber member and for pressing the entire rubber member toward the wall surface on the cylinder bore side of the groove-like coolant passage from the rear surface side; and elastic members that urge the rear surface pressing member to press the rubber member toward the wall surface on the cylinder bore side of the groove-like coolant passage, in each of supporting section bore portions to which the respective bore wall insulating sections are to be fixed, an opening, through which the elastic member passes from an inner side to the rear surface side of the supporting section is formed, a coolant passage opening through which coolant flowing on the rear surface side of the supporting section passes to flow to the inner side of the supporting section is formed on at least one place of upper portions of supporting section inter-bore portions set in the groove-like coolant passage in one-side half in which the coolant flows more vigorously, the supporting section set in the groove-like coolant passage in the one-side half in which the coolant flows more vigorously has a guide wall for guiding the coolant formed in a vicinity of the coolant passage opening, such that the coolant flows into the coolant passage opening, and has an inclined wall formed on the rear surface side of the supporting section at a position where the coolant is supplied into the groove-like coolant passage, the inclined wall extending with an upward inclination to create a flow of the coolant toward the coolant passage opening, a coolant passage opening through which coolant flowing on the rear surface side of the supporting section passes to flow to the inner side of the supporting section is formed on at least one place of upper portions of supporting section inter-bore portions set in the groove-like coolant passage in one-side half on an opposite side of the one-side half in which the coolant flows more vigorously, the supporting section set in the groove-like coolant passage in the one-side half on the opposite side of the one-side half in which the coolant flows more vigorously has a guide wall for guiding the coolant formed in a vicinity of the coolant passage opening, such that the coolant flows into the coolant passage opening, and a coolant gathering wall extending with an upward inclination toward the guide wall, and only a center or a vicinity of the center in an arc direction of each of the bore wall insulating sections is fixed to the supporting section.

The present invention (4) provides the thermal insulator for a cylinder bore wall according to any one of (1) to (3), wherein the rubber member is a heat-sensitive expanding rubber or a water-swelling rubber.

The present invention (5) provides an internal combustion engine, wherein at least one of the thermal insulators for a cylinder bore wall according to (1) to (3) is set in an entire or a part of a groove-like coolant passage of a cylinder block.

The present invention (6) provides an internal combustion engine, wherein the thermal insulator for a cylinder bore wall according to (1) is set in one one-side half of a groove-like coolant passage of a cylinder block and the thermal insulator for a cylinder bore wall according to (2) is set in the other one-side half of the groove-like coolant passage of the cylinder block.

The present invention (7) provides an automobile including the internal combustion engine according to any one of claim 5 or 6.

ADVANTAGEOUS EFFECTS OF INVENTION

The present invention can provide a thermal insulator that has high adhesion to a wall surface on a cylinder bore side of a groove-like coolant passage, can insulate selectively a portion which needs to be insulated, and has high cooling efficiency of an upper portion of a boundary of the bore walls of the cylinder bores and the vicinity of the boundary.

DESCRIPTION OF EMBODIMENTS

Figure 1:
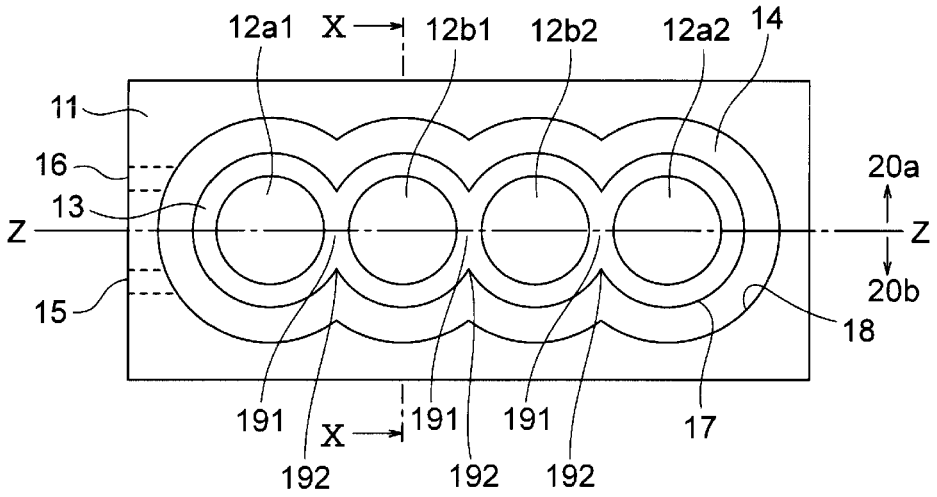
FIG. 1 is a schematic plan view illustrating a form example of a cylinder block in which a thermal insulator for a cylinder bore wall of the present invention is to be set.
Figure 2:
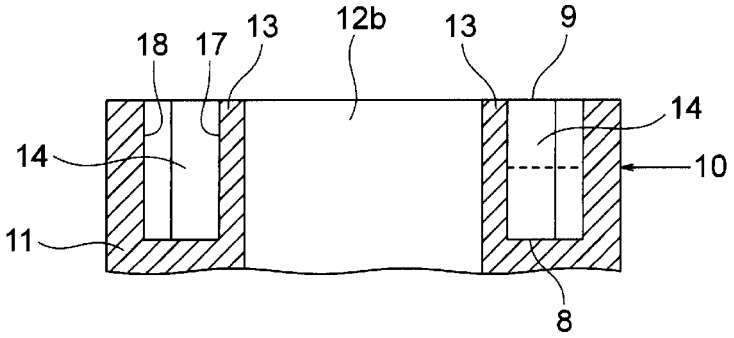
FIG. 2 is a cross-sectional view taken along a line x-x in FIG. 1.
Figure 3:
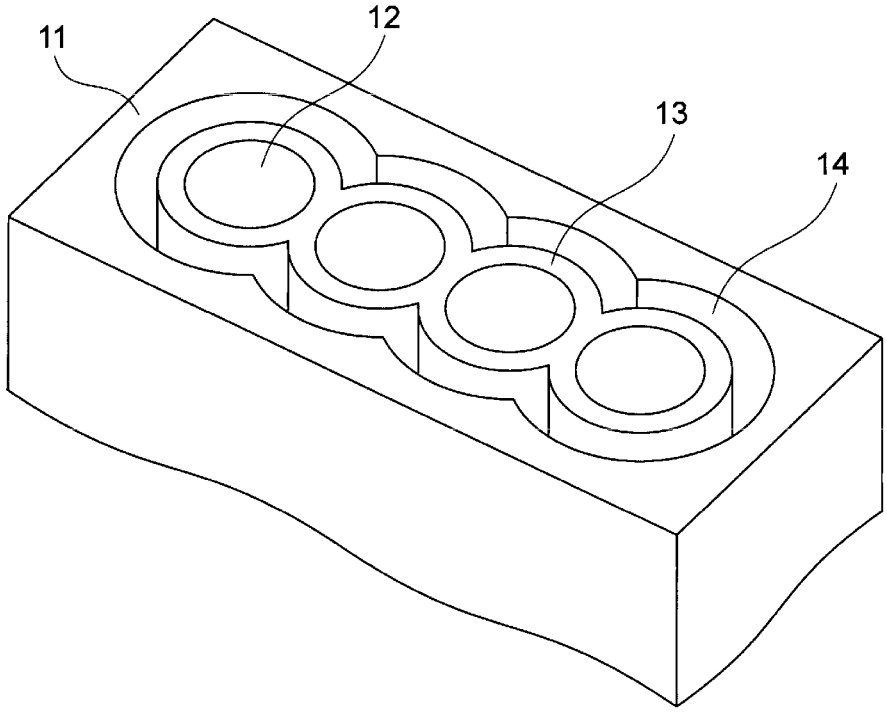
FIG. 3 is a perspective view of the cylinder block illustrated in FIG. 1.
Figure 4:
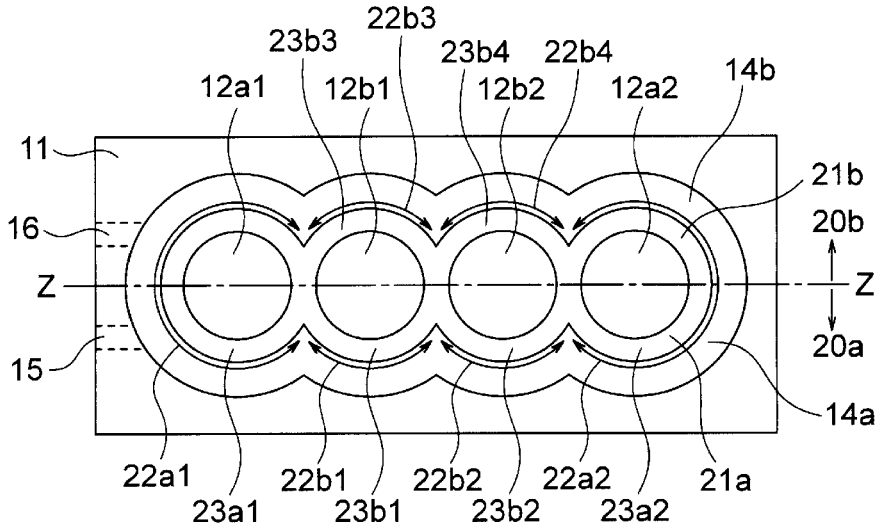
FIG. 4 is a schematic plan view illustrating a form example of the cylinder block in which the thermal insulator for the cylinder bore wall of the present invention is to be set.
Figure 5:
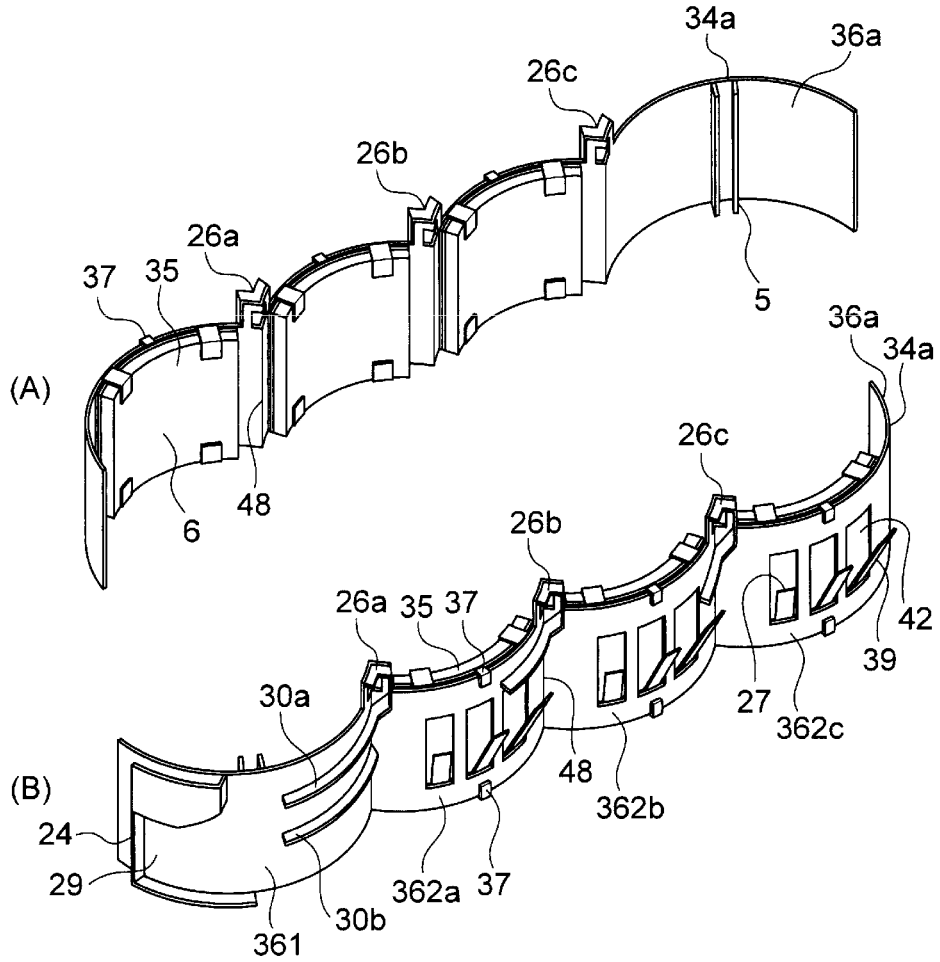
FIG. 5 is a schematic perspective view illustrating a form example of the thermal insulator for the cylinder bore wall of the present invention.
Figure 6:
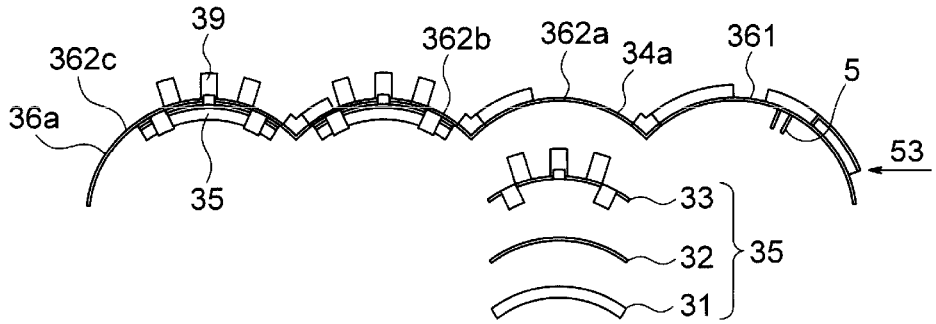
FIG. 6 is a top plan view of a thermal insulator 36*a* for the cylinder bore wall illustrated in FIG. 5.
Figure 7:
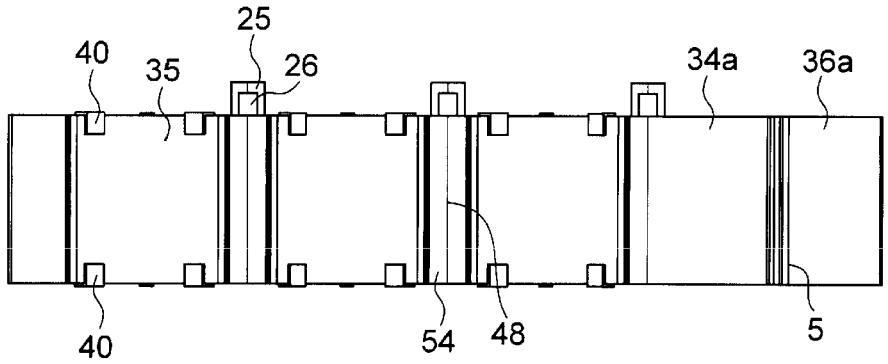
FIG. 7 is a side view of the thermal insulator 36*a* for the cylinder bore wall illustrated in FIG. 5 as viewed from a rubber member side.
Figure 8:
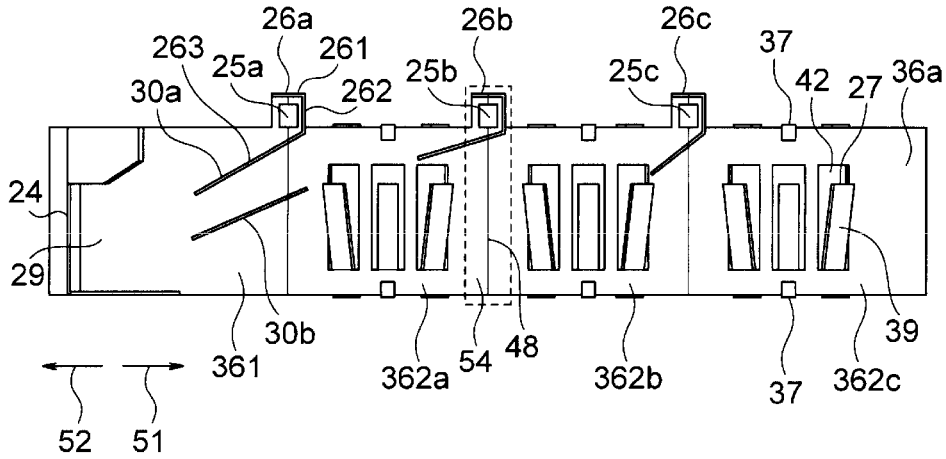
FIG. 8 is a side view of the thermal insulator 36*a* for the cylinder bore wall illustrated in FIG. 5 as viewed from a rear surface side.
Figure 9:
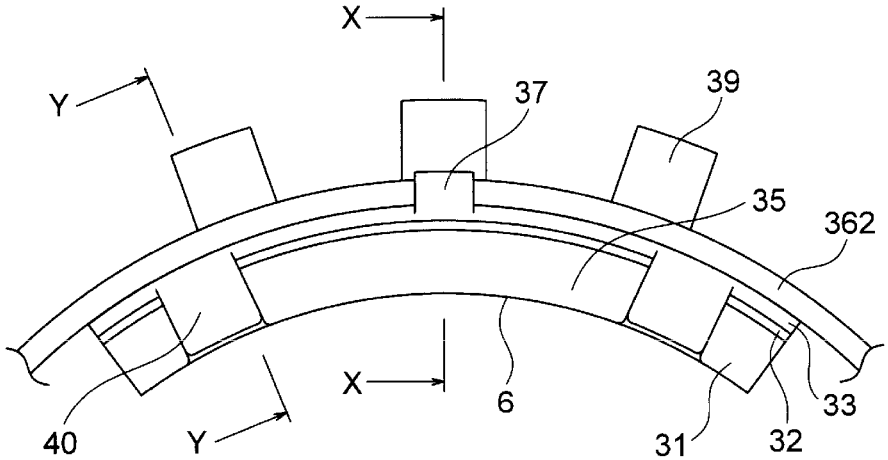
FIG. 9 is an enlarged view of the thermal insulator 36*a* for the cylinder bore wall illustrated in FIG. 5.
Figure 10:
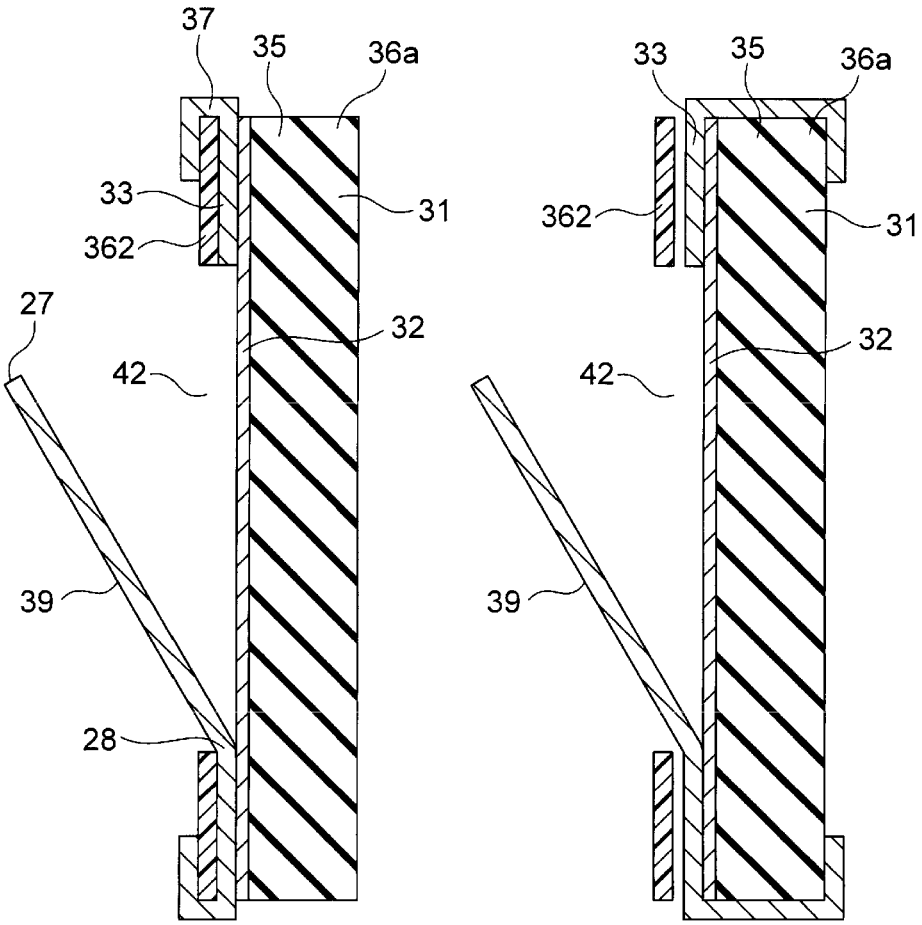
FIG. 10 is an end face view of FIG. 9.
Figure 11:
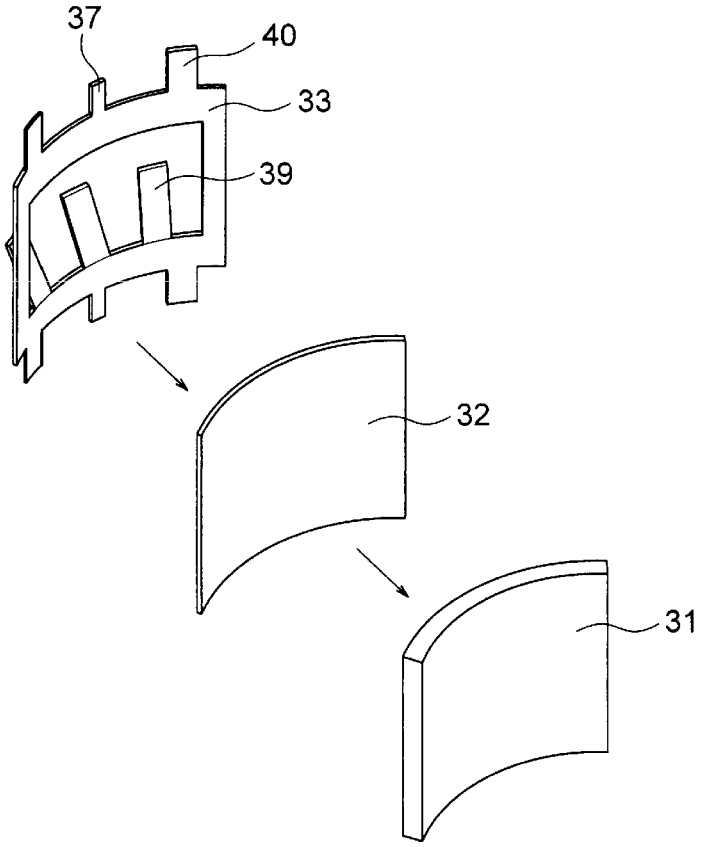
FIG. 11 is a view illustrating a state in which the bore wall insulating section 35 illustrated in FIG. 5 is manufactured.
Figure 12:
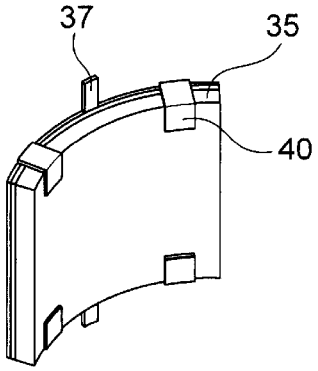
FIG. 12 is a perspective view illustrating the bore wall insulating section 35 before being fixed to being fixed to a supporting section 34*a*.
Figure 13:
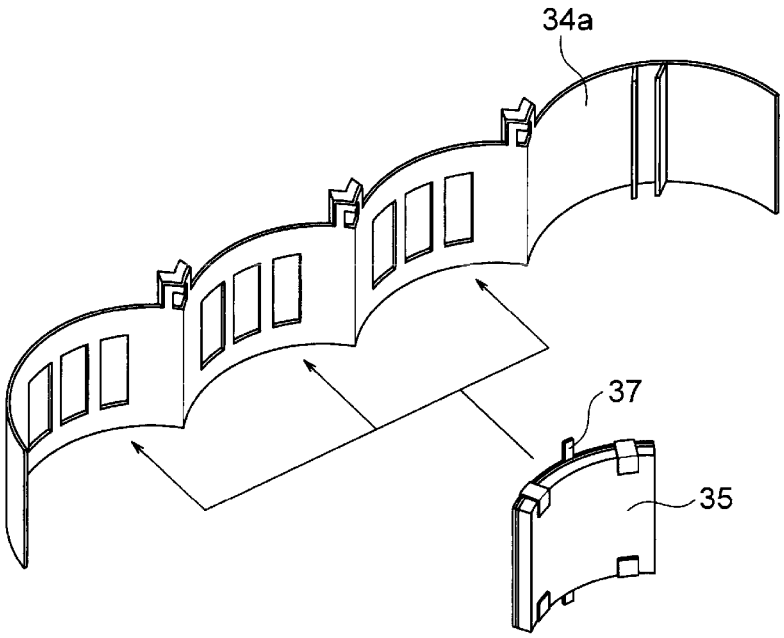
FIG. 13 is a view illustrating a state in which the bore wall insulating section 35 is fixed to the supporting section 34*a*.
Figure 14:
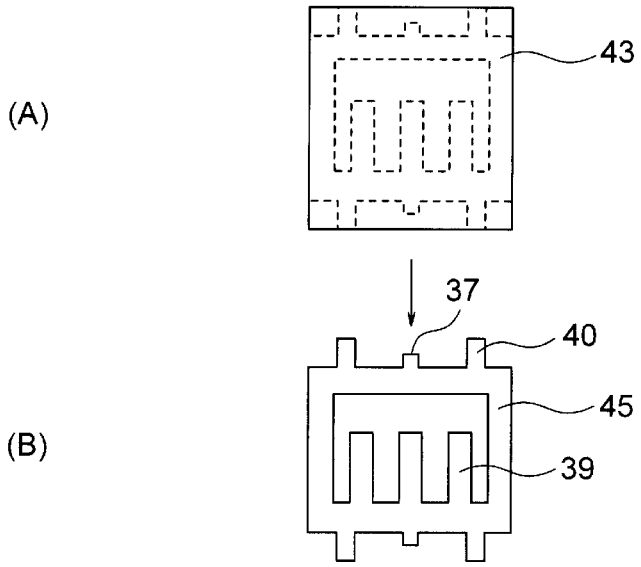
FIG. 14 is a view illustrating a state in which a metal-spring attaching member 33 is manufactured.
Figure 15:
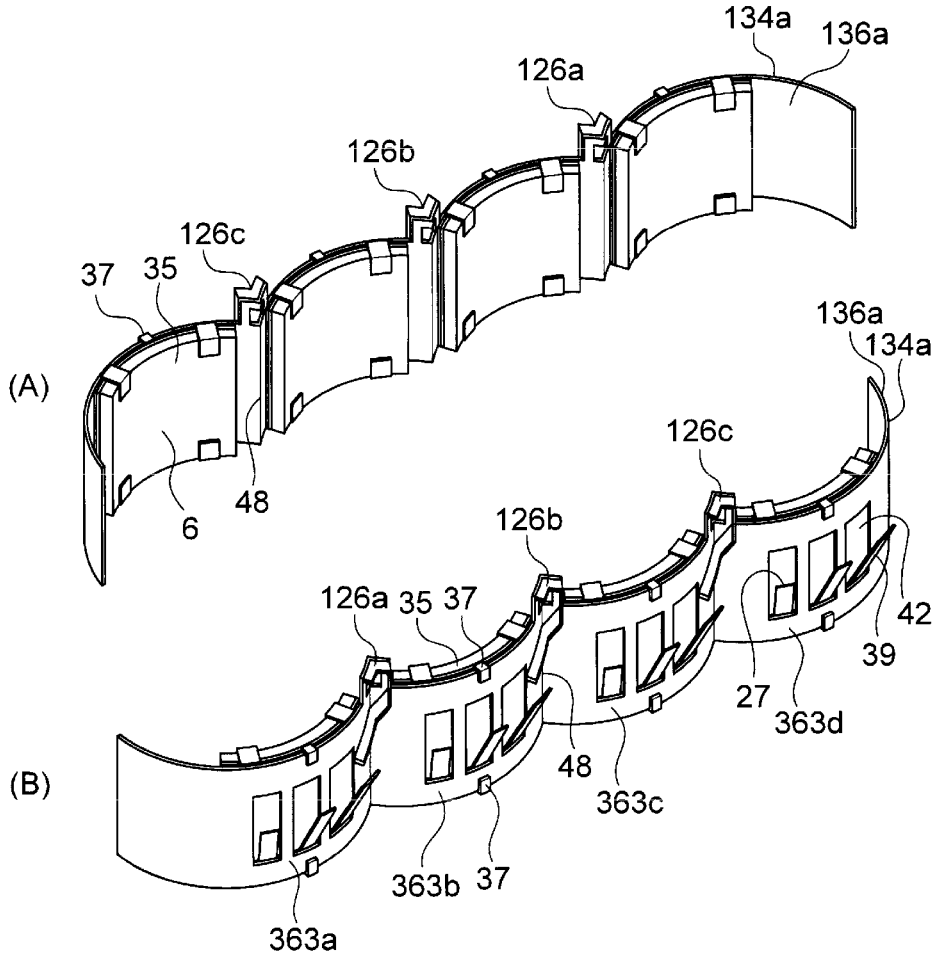
FIG. 15 is a schematic perspective view illustrating a form example of the thermal insulator for the cylinder bore wall of the present invention.
Figure 16:
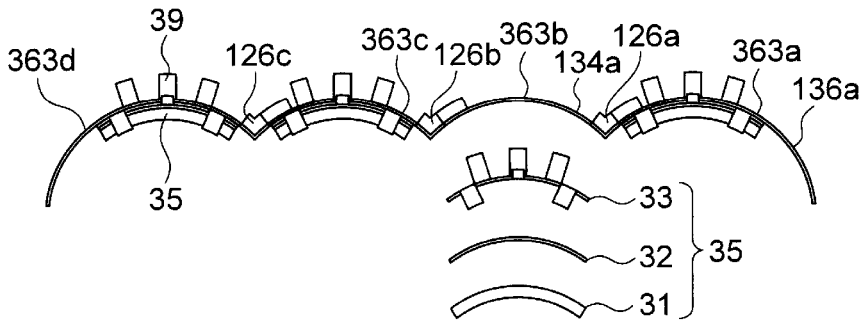
FIG. 16 is a top plan view of a thermal insulator 136*a* for the cylinder bore wall illustrated in FIG. 15.
Figure 17:
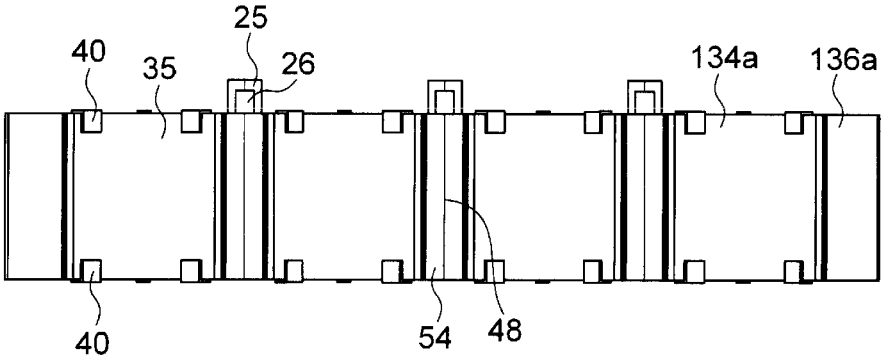
FIG. 17 is a side view of the thermal insulator 136*a* for the cylinder bore wall illustrated in FIG. 15 as viewed from a rubber member side.
Figure 18:
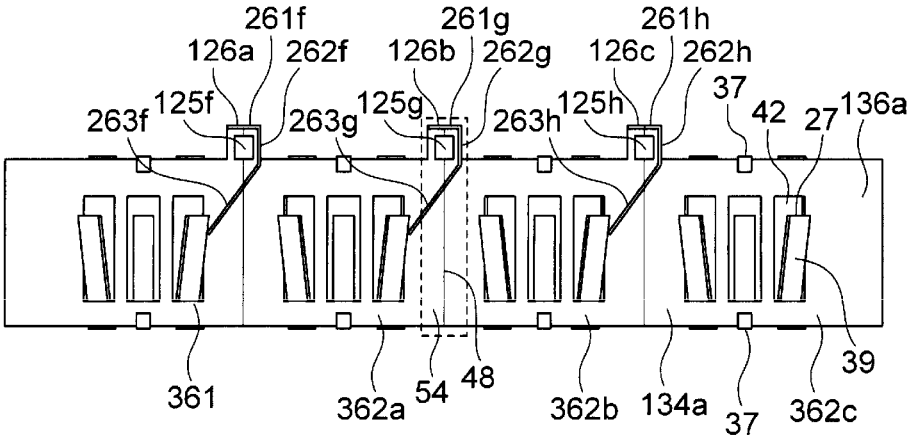
FIG. 18 is a side view of the thermal insulator 136*a* for the cylinder bore wall illustrated in FIG. 15 as viewed from a rear surface side.
Figure 19:
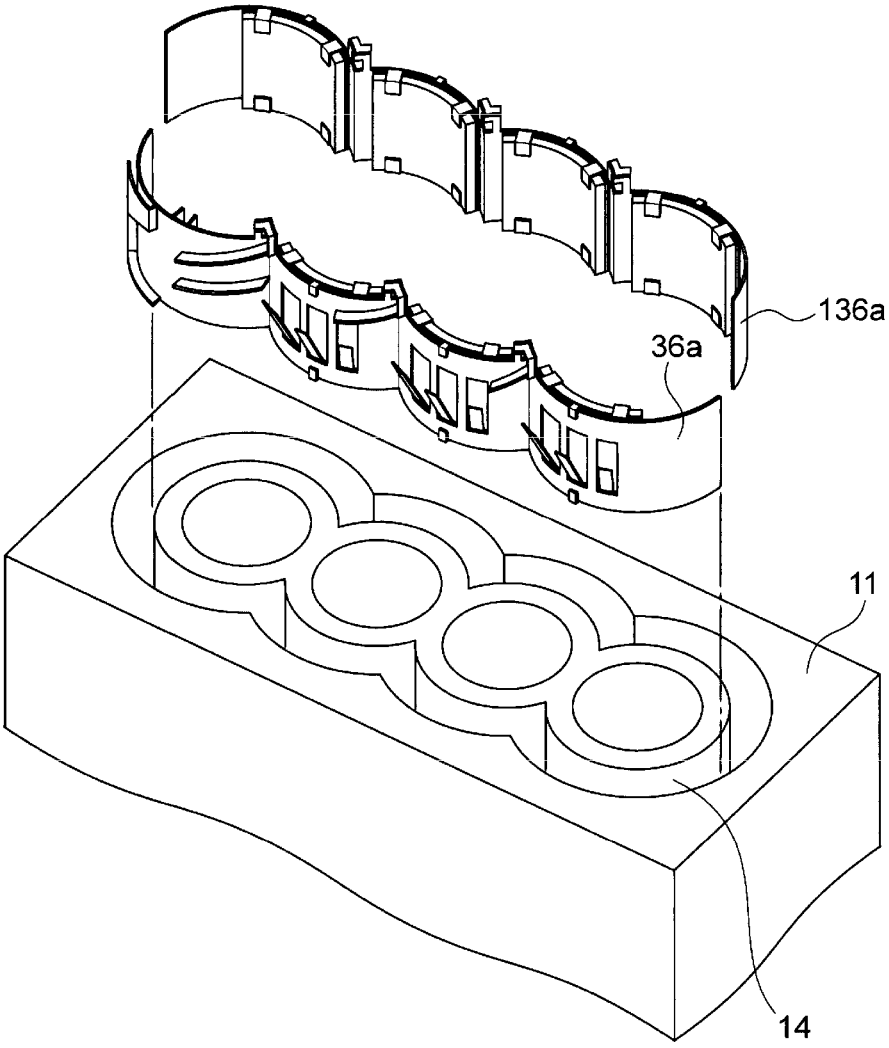
FIG. 19 is a schematic view illustrating a state in which the thermal insulator 36*a* for the cylinder bore wall and the thermal insulator 136*a* for the cylinder bore wall are to be set in the cylinder block 11 illustrated in FIG. 1.

A thermal insulator for a cylinder bore wall of the present invention and an internal combustion engine of the present invention will be described with reference to FIG. 1 to FIG. 19. FIG. 1 to FIG. 4 each illustrate a form example of a cylinder block in which the thermal insulator for the cylinder bore wall of the present invention is set. FIG. 1 and FIG. 4 each are a schematic plan view illustrating the cylinder block in which the thermal insulator for the cylinder bore wall of the present invention is to be set. FIG. 2 is a cross-sectional view taken along a line x-x in FIG. 1. FIG. 3 is a perspective view of the cylinder block illustrated in FIG. 1. FIG. 5 is a schematic perspective view illustrating a form example of the thermal insulator for the cylinder bore wall of the present invention. FIG. 6 is a top view of a thermal insulator 36*a* illustrated in FIG. 5. Note that, in FIG. 6, an insulating section at the right end among bore wall insulating sections 35 fixed to the thermal insulator 36*a* is illustrated as being separated into each of the components. FIG. 7 is a side view of the thermal insulator 36*a* illustrated in FIG. 5 as viewed from a contact surface side of a rubber member 31. FIG. 8 is a side view of the thermal insulator 36*a* illustrated in FIG. 5 as viewed from a rear surface side. FIG. 9 is an enlarged view of one of the bore wall insulating sections 35 fixed to a supporting section 34*a* illustrated in FIG. 5 as viewed from above. FIG. 10 is an end face view taken along each of lines X-X and Y-Y in FIG. 9. FIG. 11 is a view illustrating a state in which the bore wall insulating section 35 illustrated in FIG. 5 is manufactured. FIG. 12 is a perspective view illustrating the bore wall insulating section 35 before being fixed to the supporting section 34*a*. FIG. 13 is a view illustrating a state in which the bore wall insulating section 35 is fixed to the supporting section 34*a*. FIG. 14 is a view illustrating a state in which a metal-spring attaching member 33 is manufactured. FIG. 15 is a schematic perspective view illustrating a form example of the thermal insulator for the cylinder bore wall of the present invention. FIG. 16 is a top view of a thermal insulator 136*a* illustrated in FIG. 15. Note that, in FIG. 16, a second insulating section from the right among bore wall insulating sections 35 fixed to the thermal insulator 136*a* is illustrated as being separated into each of the components. FIG. 17 is a side view of the thermal insulator 136*a* illustrated in FIG. 15 as viewed from a contact surface side of a rubber member 31. FIG. 18 is a side view of the thermal insulator 136*a* illustrated in FIG. 15 as viewed from a rear surface side. FIG. 19 is a schematic view illustrating a state in which the thermal insulator 36*a* for the cylinder bore wall and the thermal insulator 136*a* for the cylinder bore wall are to be set in the cylinder block 11 illustrated in FIG. 1.

As illustrated in FIG. 1 to FIG. 3, in an open deck type cylinder block 11 of a vehicle-mounted internal combustion engine in which the thermal insulator for the cylinder bore wall is set, a bore 12 in which a piston moves up and down, and a groove-like coolant passage 14 in which coolant flows are formed. A wall partitioning into the bore 12 and the groove-like coolant passage 14 is a cylinder bore wall 13. In the cylinder block 11, a coolant supply port 15 for supplying the coolant to the groove-like coolant passage 11 and a coolant discharge port 16 for discharging the coolant from the groove-like coolant passage 11 are formed.

In the cylinder block 11, two or more bores 12 are formed side by side in series. Therefore, the bores 12 include end bores 12*a*1 and 12*a*2 adjacent to one bore and intermediate bores 12*b*1 and 12*b*2 sandwiched by two bores (note that, when the number of bores of the cylinder block is two, the bores 12 include only the end bores). Among bores formed side by side in series, the end bores 12*a*1 and 12*a*2 are bores at both ends. The intermediate bores 12*b*1 and 12*b*2 are bores formed between the end bore 12*a*1 at one end and the end bore 12*a*2 at the other end. Each of a wall between the end bore 12*a*1 and the intermediate bore 12*b*1, a wall between the intermediate bore 12*b*1 and the intermediate bore 12*b*2, and a wall between the intermediate bore 12*b*2 and the end bore 12*a*2 (inter-bore walls 191) is a portion sandwiched by two bores, to which heat is transmitted from two cylinder bores, resulting in the wall temperature being higher than that of the other walls. On a wall surface 17 on the cylinder bore side of the groove-like coolant passage 14, the temperature is the highest near the inter-bore walls 191. Therefore, the temperature of a boundary 192 of the bore walls of the cylinder bores and the vicinity of the boundary 192 is the highest in the wall surface 17 on the cylinder bore side of the groove-like coolant passage 14.

In the present invention, in a wall surface of the groove-like coolant passage 14, a wall surface on the cylinder bore 13 side is referred to as a wall surface 17 on the cylinder bore side of the groove-like coolant passage. In the wall surface of the groove-like coolant passage 14, a wall surface on an opposite side of the wall surface 17 on the cylinder bore side of the groove-like coolant passage is referred to as a wall surface 18.

In the present invention, a one-side half indicates a half on one side when the cylinder block is vertically divided into two in a direction in which the cylinder bores are disposed side by side. Therefore, in the present invention, bore walls in one-side half among the bore walls of all the cylinder bores indicate bore walls in the half on the one side when all the cylinder bore walls are vertically divided into two in the direction in which the cylinder bores are disposed side by side. For example, in FIG. 4, the direction in which the cylinder bores are disposed side by side is a Z-Z direction. Each of bore walls in one-side halves when the cylinder bore wall is divided into two by this Z-Z line is a bore wall in a one-side half among the bore walls of all the cylinder bores. That is, in FIG. 4, the bore wall in a one-side half further on the 20*a* side than the Z-Z line is a bore wall 21*a* in one one-side half among the bore walls of all the cylinder bores. The bore wall in a one-side half further on the 20*b* side than the Z-Z line is a bore wall 21*b* in the other one-side half among the bore walls of all the cylinder bores. One side among all the cylinder bore walls indicates either the bore wall 21*a* in one-side half or the bore wall 21*b* in the one-side half. A part of one side indicates a part of the bore wall 21*a* in the one-side half or a part of the bore wall 21*b* in the one-side half.

In the present invention, the bore walls of the cylinder bores indicate bore wall portions corresponding to respective individual cylinder bores. In FIG. 4, a range indicated by a double-headed arrow 22*a*1 is a bore wall 23*a*1 of the cylinder bore 12*a*1, a range indicated by a double-headed arrow 22*b*1 is a bore wall 23*b*1 of the cylinder bore 12*b*1, a range indicated by a double-headed arrow 22*b*2 is a bore wall 23*b*2 of the cylinder bore 12*b*2, a range indicated by a double-headed arrow 22*a*2 is a bore wall 23*a*2 of the cylinder bore 12*a*2, a range indicated by a double-headed arrow 22*b*3 is a bore wall 23*b*3 of the cylinder bore 12*b*1, and a range indicated by a double-headed arrow 22*b*4 is a bore wall 23*b*4 of the cylinder bore 12*b*2. That is, the bore wall 23*a*1 of the cylinder bore 12*a*1, the bore wall 23*b*1 of the cylinder bore 12*b*1, the bore wall 23*b*2 of the cylinder bore 12*b*2, the bore wall 23*a*2 of the cylinder bore 12*a*2, the bore wall 23*b*3 of the cylinder bore 12*b*1, and the bore wall 23*b*4 of the cylinder bore 12*b*2 are the bore walls of the cylinder bores, respectively.

The thermal insulator 36*a* for the cylinder bore wall illustrated in FIG. 5 is a form example of a thermal insulator for the cylinder bore wall of a first form of the present invention. The thermal insulator 36*a* for the cylinder bore wall is a thermal insulator for insulating the bore wall 21*a* in one one-side half (on the 20*a* side) in FIG. 4. The thermal insulator 36*a* for the cylinder bore wall is a form example of a thermal insulator for the cylinder bore wall in which not only an inclined wall but also a coolant contact surface and a coolant flow suppressing wall are formed on a supporting section bore portion at a position to which the coolant is supplied. Note that, in FIG. 4, a cylinder block of a form is illustrated in which the coolant that has flowed to the end in the groove-like coolant passage 14 in the one-side half on the 20*a* side is discharged from the coolant discharge port 16 formed on the lateral side of the cylinder block 11. Besides, for example, there is a cylinder block of a form in which the coolant that has flowed from one end to the other end in the groove-like coolant passage 14 in the one-side half on the 20*a* side flows into a coolant passage formed in the cylinder head rather than being discharged from the lateral side of the cylinder block.

The thermal insulator 36*a* for the cylinder bore wall includes three bore wall insulating sections 35 and the supporting section 34*a* to which the bore wall insulating sections 35 are fixed. That is, in the thermal insulator 36*a* for the cylinder bore wall, the bore wall insulating sections 35 are fixed to three places of the supporting section 34*a*. In the thermal insulator 36*a* for the cylinder bore wall, bending sections 37 of the insulating sections 35 are bent to hold the upper and lower end portions of the supporting section 34*a*, whereby the bore wall insulating sections 35 are fixed to the supporting section 34*a*.

As illustrated in FIG. 5 to FIG. 8, the thermal insulator 36*a* for the cylinder bore wall is a thermal insulator that is to be set in the groove-like coolant passage 14*a* in the one-side half of the cylinder block 11 illustrated in FIG. 4, and that is provided for insulating the bore wall 23*b*1 of the cylinder bore 12*b*1, the bore wall 23*b*2 of the cylinder bore 12*b*2, and the bore wall 23*a*2 of the cylinder bore 12*a*2. Therefore, in the thermal insulator 36*a* for the cylinder bore wall, the three bore wall insulating sections 35 are provided to insulate the three bore walls of the respective cylinder bores, that is, the bore wall 23*b*1 of the cylinder bore 12*b*1, the bore wall 23*b*2 of the cylinder bore 12*b*2, and the bore wall 23*a*2 of the cylinder bore 12*a*2.

In the thermal insulator 36*a* for the cylinder bore wall, the bore wall insulating sections 35 are fixed with a contact surface 6 of the rubber member 31 facing the cylinder bore wall side such that the contact surface 6 of the rubber member 31 can come into contact with the wall surface 17 on the cylinder bore side of the groove-like coolant passage 14. On the rear surface side of the thermal insulator 36*a* for the cylinder bore wall, metal leaf springs 39 attached to the bore wall insulating sections 35 project toward the opposite side of the rubber member 31 through openings 42 of the supporting section 34*a*. Projecting distal ends 27 of the metal leaf springs 39 are in contact with the wall surface 18 on the opposite side of the wall surface 17 on the cylinder bore side of the groove-like coolant passage 14.

The bore wall insulating section 35 fixed to the thermal insulator 36*a* for the cylinder bore wall includes, as illustrated in FIG. 6, FIG. 9, and FIG. 10, the rubber member 31, a rear surface pressing member 32, and the metal-leaf-spring attaching member 33.

The rubber member 31 is formed in an arcuate shape when viewed from above. The shape on the contact surface 26 side of the rubber member 31 is a shape conforming to the wall surface on the cylinder bore side of the groove-like coolant passage 14. The rubber member 31 is a member in direct contact with the bore wall 22 of the cylinder bore to cover an insulating part of the bore wall 22 and insulate the bore wall 22 of the cylinder bore. The rear surface pressing member 32 is formed in an arcuate shape when viewed from above. The rear surface pressing member 32 has a shape conforming to the rear surface side (a surface on the opposite side of the contact surface 6 side) of the rubber member 31 such that the rear surface pressing member 32 can press the entire rubber member 31 from the rear surface side of the rubber member 31. The metal-leaf-spring attaching member 33 is formed in an arcuate shape when viewed from above. The metal-leaf-spring attaching member 33 has a shape conforming to the rear surface side (a surface on the opposite side of the rubber member 31) of the rear surface pressing member 32. The metal leaf springs 39, which are elastic members, are attached to the metal-leaf-spring attaching member 33. The metal leaf springs 39 are vertically long rectangular metal plates. One ends in the longitudinal direction are connected to the metal-leaf-spring attaching member 33. The metal leaf springs 39 are attached to the metal-leaf-spring attaching member 33 by being bent from the metal-leaf-spring attaching member 33 on the other end side 28 connected to the metal-leaf-spring attaching member 33 such that the distal ends 27 separate from the metal-leaf-spring attaching member 33. The bending sections 40 formed on the upper side and the lower side of the metal-leaf-spring attaching member 33 are bent and the rubber member 31 and the rear surface pressing member 32 are sandwiched between the metal-leaf-spring attaching member 33 and the bending sections 40, whereby the rubber member 31 and the rear surface pressing member 32 are fixed to the metal-leaf-spring attaching member 33. In the rubber member 31, a surface of the rubber member 31 on the opposite side of the rear surface pressing member 32 side is the contact surface 6 in contact with the wall surface 17 on the cylinder bore side of the groove-like coolant passage.

The bore wall insulating section 35 is a member for insulating the bore wall of the cylinder bore. When the thermal insulator 36*a* for the cylinder bore wall is set in the groove-like coolant passage 14 of the cylinder block 11, the rubber member 31 comes into contact with the wall surface 17 on the cylinder bore side of the groove-like coolant passage 14, the wall surface 17 on the cylinder bore side of the groove-like coolant passage 14 is covered with the rubber member 31, and the rear surface pressing member 32 presses the rubber member 31 from the rear surface side toward the wall surface 17 on the cylinder bore side of the groove-like coolant passage 14 with an urging force of the metal leaf springs 39, which are the elastic members, to cause the rubber member 31 to adhere to the wall surface 17 on the cylinder bore side of the groove-like coolant passage 14, whereby the bore wall insulating section 35 insulates the bore wall of the cylinder bore.

The supporting section 34*a* is formed in a shape of continuous four arcs when viewed from above. The shape of the supporting section 34*a* is a shape conforming to a one-side half of the groove-like coolant passage 14. Note that each part of the supporting section 34*a* on the cylinder bore side is a supporting section bore portion. That is, each of four arcuate shapes forming the supporting section 34*a* is a supporting section bore portion. Therefore, the supporting section 34*a* is comprised of a supporting section bore portion 361, a supporting section bore portion 362*a*, a supporting section bore portion 362*b*, and a supporting section bore portion 362*c*. The supporting section bore portion 361, the supporting section bore portion 362*a*, the supporting section bore portion 362*b*, and the supporting section bore portion 362*c*, each of which is formed in an arcuate shape, are continuously connected in this order.

In the supporting section bore portions to which the respective bore portion insulating sections 35 are fixed, that is, the supporting section bore portion 362*a*, the supporting section bore portion 362*b*, and the supporting section bore portion 362*c*, among the supporting section bore portions in the supporting section 34*a*, the openings 42 are formed such that the metal leaf springs 39 attached to the bore wall insulating sections 35 can pass through the supporting section 34*a* and project toward the wall surface 18 on the opposite side of the wall surface 17 on the cylinder bore side of the groove-like coolant passage 14 from the rear surface side of the thermal insulator 36*a* for the cylinder bore wall.

The supporting section 34*a* is a member to which each of the bore wall insulating sections 35 is fixed. The supporting section 34*a* plays a role of defining a position of the bore wall insulating section 35 such that the position of the bore wall insulating section 35 does not deviate in the groove-like coolant passage 14. The supporting section 34*a* is a molded body made of a synthetic resin.

In the thermal insulator 36*a* for the cylinder bore wall, only the center or the vicinity of the center in the arc direction when viewed from above (the center or the vicinity of the center of the arcuate bore wall insulating section when the bore wall insulating section is viewed from above) of the bore wall insulating section 35 is fixed to the supporting section 34*a*. In the thermal insulator 36*a* for the cylinder bore wall, three bore wall insulating sections 35 are fixed only at the centers or the vicinities of the centers in the arc direction when viewed from above, to the supporting section bore portion 362*a*, the supporting section bore portion 362*b*, and the supporting section bore portion 362*c*, respectively. The X-X end face view of FIG. 10 is an end face view cut in the center of the bore wall insulating section 35. In the X-X end face view, each of the upper end and the lower end of the metal-leaf-spring attaching member 33 is fixed to the supporting section 34*a* by the bending section 37. On the other hand, the Y-Y end face view of FIG. 10 is an end face view cut in a portion at the end of the bore wall insulating section 35. In the Y-Y end face view, the metal-leaf-spring attaching member 33 is not fixed to the supporting section 34*a*.

The supporting section bore portions include the supporting section bore portion 361 in which the inclined wall 30 is formed, and the supporting section bore portion 362 in which the inclined wall 30 is not formed. Note that the coolant 53 is supplied to the thermal insulator 36*a* for the cylinder bore wall in a direction indicated by an arrow illustrated in FIG. 6.

The supporting section bore portion 361 is a bore portion at a position where the coolant is supplied into the groove-like coolant passage. In the cylinder block 11 illustrated in FIG. 4, the coolant supply port 15 is formed at a position of the groove-like coolant passage on the cylinder bore 12*a*1 side and the one-side half 20*a* side. Therefore, the supporting section bore portion 361 on the cylinder bore 12*a*1 side is a supporting section bore portion at a position where the coolant is supplied into the groove-like coolant passage.

A coolant contact surface 29, a coolant flow suppressing wall 24, and an inclined wall 30 are formed on a rear surface side of the supporting section bore portion 361. The coolant contact surface 29 is a surface on which the coolant supplied from outside of the cylinder block firstly strikes. The coolant flow suppressing wall 24 is a wall which is provided such that the coolant which has struck on the coolant contact surface 29 flows toward the inclined wall 30 without flowing in the opposite direction 52 of the coolant flow direction. Therefore, the coolant flow suppressing wall 24 is formed to surround a portion of the coolant contact surface 29 on the opposite side of a side toward which the coolant flows. That is, the wall is formed at the upper side, the lateral side, and the lower side of the portion of the coolant contact surface 29 on the opposite side of the side toward which the coolant flows. The inclined wall 30 is an inclined wall for creating the flow of the coolant from the coolant contact surface 29 toward a coolant passage opening 25 such that the coolant flowing in the coolant flow direction 51 flows toward the coolant passage opening 25 after striking on the coolant contact surface 29. Therefore, the inclined wall 30 extends with an upward inclination from the vicinity of the coolant contact surface 29 as a start point.

A vertical rib 5 is formed on the inner surface of the supporting section bore portion 361. Note that, in the present invention, the vertical rib 5 may or need not be formed on the inner surface of the supporting section bore portion at a position where the coolant is supplied into the groove-like coolant passage, and therefore it is appropriately selected as needed whether the vertical rib is formed. In the present invention, the bore wall insulating section may be also fixed to the supporting section bore portion at a position where the coolant is supplied into the groove-like coolant passage.

The coolant passage opening 25 is formed on the upper portion of a supporting section inter-bore portion 54. The coolant passage opening 25 is a passage opening through which the coolant flowing on the rear surface side of the supporting section 34*a* passes to flow to the inner side of the supporting section 34*a*. A guide wall 26 is formed in the vicinity of the coolant passage opening 25. The guide wall 26 is a wall for guiding the coolant such that the coolant flowing from the coolant contact surface 29 toward the coolant passage opening 25 flows into the coolant passage opening 25. The guide wall 26 includes an upper wall 261 formed on the upper side of the coolant passage opening 25, and a side wall 262 formed on the lateral side in the coolant flow direction, and therefore the flow of the coolant flowing from the obliquely lower side of the coolant passage opening 25 is blocked by the upper wall 261 and the side wall 262, so that the coolant flows into the coolant passage opening 25. A coolant gathering wall 263 which is inclined upwardly toward the lower end of the side wall 262 is connected to the lower end of the side wall 262 of the guide wall 26. The coolant gathering wall 263 plays a role of gathering the coolant flowing slightly below the coolant passage opening 25 at the coolant passage opening 25. Note that in the form example illustrated in FIG. 5, a coolant gathering wall of a guide wall 26*a* is connected with an inclined wall 30*a*.

In the supporting section 34*a*, a portion connecting the supporting section bore portions adjacent to each other is a boundary 48 of the supporting section bore portions. A portion of the boundary 48 of the supporting section bore portions and the vicinity of the boundary 48 in the supporting section 34*a* is a portion facing a wall surface corresponding to the lateral side of the inter-bore wall 191 in the wall surface on the groove-like coolant passage side. In the present invention, the portion of the boundary of the supporting section bore portions and the vicinity of the boundary in the supporting section, that is, the portion facing the wall surface corresponding to the lateral side of the inter-bore wall in the wall surface on the groove-like coolant passage is referred to as a supporting section inter-bore portion.

A manufacturing procedure of the thermal insulator 36*a* for the cylinder bore wall will be described. As illustrated in FIG. 11, the rear surface pressing member 32 and the metal-leaf-spring attaching member 33, in which the metal leaf springs 39 are attached and the bending sections 40 and the bending sections 37 are formed, are joined to the rubber member 31 from the rear surface side of the rubber member 31 in this order. Subsequently, the bending sections 40 are bent to hold the rear surface pressing member 32 and the rubber member 31 with the bending sections 40 as illustrated in FIG. 12, whereby the rear surface pressing member 32 and the rubber member 31 are fixed to the metal-leaf-spring attaching member 33 to manufacture the bore wall insulating section 35. As illustrated in FIG. 13, three bore wall insulating sections 35 are manufactured. The bending sections 37 are bent in fixing parts of the supporting section 34*a* and the supporting section 34*a* is held by the bending sections 37, whereby the bore wall insulating sections 35 are fixed to the supporting section 34*a* to manufacture the thermal insulator 36*a* for the cylinder bore wall.

Note that, as a manufacturing procedure of the metal-leaf-spring attaching member 33, as illustrated in FIG. 14, a metal plate 43 is prepared and the metal plate 43 is punched in positions of dotted lines in FIG. 14(A), whereby, as illustrated in FIG. 14(B), the metal leaf springs 39, the bending sections 40, and the bending sections 37 are formed to manufacture a punched product 45 of the metal plate. Subsequently, the entire punched product 45 of the metal plate is formed into an arcuate shape and the metal leaf springs 39 are bent to the rear surface side, whereby the metal-leaf-spring attaching member 33 is manufactured. The supporting section 34*a* is manufactured by injection molding of a synthetic resin.

The thermal insulator 136*a* for the cylinder bore wall illustrated in FIG. 15 is a form example of a thermal insulator for the cylinder bore wall of a second form of the present invention. The thermal insulator 136*a* for the cylinder bore wall is a thermal insulator for insulating the bore wall 21*b* in one one-side half (on the 20*b* side) in FIG. 4. The thermal insulator 136*a* for the cylinder bore wall adopts a form in which all of the supporting section bore portions have no inclined wall formed thereon.

The thermal insulator 136*a* for the cylinder bore wall includes four bore wall insulating sections 35 and the supporting section 134*a* to which the bore wall insulating sections 35 are fixed. That is, in the thermal insulator 136*a* for the cylinder bore wall, the bore wall insulating sections 35 are fixed to four places of the supporting section 134*a*. In the thermal insulator 136*a* for the cylinder bore wall, the bending sections 37 of the insulating sections 35 are bent and the bending sections 37 hold the upper and lower end portions of the supporting section 34*a*, whereby the bore wall insulating sections 35 are fixed to the supporting section 134*a*.

As illustrated in FIG. 15 to FIG. 18, the thermal insulator 136*a* for the cylinder bore wall is a thermal insulator that is to be set in the groove-like coolant passage 14*b* in the one-side half of the cylinder block 11 illustrated in FIG. 4, and that is provided for insulating the bore wall 23*a*2 of the cylinder bore 12*a*2, the bore wall 23*b*4 of the cylinder bore 12*b*2, the bore wall 23*b*3 of the cylinder bore 12*b*1, and the bore wall 23*a*1 of the cylinder bore 12*a*1. Therefore, in the thermal insulator 136*a* for the cylinder bore wall, the four bore wall insulating sections 35 are provided to insulate the four bore walls of the respective cylinder bores, that is, the bore wall 23*a*2 of the cylinder bore 12*a*2, the bore wall 23*b*4 of the cylinder bore 12*b*2, the bore wall 23*b*3 of the cylinder bore 12*b*1, and the bore wall 23*a*1 of the cylinder bore 12*a*1.

In the thermal insulator 136*a* for the cylinder bore wall, the bore wall insulating sections 35 are fixed with a contact surface 6 of the rubber member 31 facing the cylinder bore wall side such that the contact surface 6 of the rubber member 31 can come into contact with the wall surface 17 on the cylinder bore side of the groove-like coolant passage 14. On the rear surface side of the thermal insulator 36*a* for the cylinder bore wall, metal leaf springs 39 attached to the bore wall insulating sections 35 project toward the opposite side of the rubber member 31 through openings 42 of the supporting section 34. Projecting distal ends 27 of the metal leaf springs 39 are in contact with the wall surface 18 on the opposite side of the wall surface 17 on the cylinder bore side of the groove-like coolant passage 14.

The bore wall insulating section 35 fixed to the thermal insulator 136*a* for the cylinder bore wall is the same as the bore wall insulating section 35 fixed to the thermal insulator 36*a* for the cylinder bore wall.

The supporting section 134*a* is formed in a shape of continuous four arcs when viewed from above. The shape of the supporting section 134*a* is a shape conforming to a one-side half of the groove-like coolant passage 14. Therefore, the supporting section 134*a* is comprised of a supporting section bore portion 363*a*, a supporting section bore portion 363*ba*, a supporting section bore portion 363*c*, and a supporting section bore portion 363*d*. The supporting section bore portion 363*a*, the supporting section bore portion 363*b*, the supporting section bore portion 363*c*, and the supporting section bore portion 363*d*, each of which is formed in an arcuate shape, are continuously connected in this order.

The bore portion insulating sections 35 are fixed to the supporting section bore portions 363 of the supporting section 134*a*, respectively. In the supporting section bore portions 363, the openings 42 are formed such that the metal leaf springs 39 attached to the bore wall insulating sections 35 can pass through the supporting section 34*a* and project toward the wall surface 18 on the opposite side of the wall surface 17 on the cylinder bore side of the groove-like coolant passage 14 from the rear surface side of the thermal insulator 36*a* for the cylinder bore wall.

The supporting section 134*a* is a member to which each of the bore wall insulating sections 35 is fixed. The supporting section 134*a* plays a role of defining a position of the bore wall insulating section 35 such that the position of the bore wall insulating section 35 does not deviate in the groove-like coolant passage 14. The supporting section 134*a* is a molded body made of a synthetic resin.

In the thermal insulator 136*a* for the cylinder bore wall, only the center or the vicinity of the center in the arc direction, when viewed from above (the center or the vicinity of the center of the arcuate bore wall insulating section when the bore wall insulating section is viewed from above), of the bore wall insulating section 35 is fixed to the supporting section 134*a*, similarly to the thermal insulator 36*a* for the cylinder bore wall. In the thermal insulator 136*a* for the cylinder bore wall, four bore wall insulating sections 35 are fixed only at the centers or the vicinities of the centers in the arc direction when viewed from above, to the supporting section bore portion 363*a*, the supporting section bore portion 363*ba*, the supporting section bore portion 363*c* and the supporting section bore portion 363*d*, respectively.

The thermal insulator 136*a* for the cylinder bore wall is set not in the groove-like coolant passage in the one-side half on the side where the coolant which has flowed into the groove-like coolant passage vigorously flows but in the groove-like coolant passage in the other one-side half (the one-side half 14*b* in the form example in FIG. 4) on the side where the coolant gently flows after flowing the groove-like coolant passage in the one-side half. Therefore, all of the supporting section bore portions 363 in the supporting section 134*a* have no inclined wall 30 formed thereon.

The coolant passage opening 25 is formed on the upper portion of a supporting section inter-bore portion 54 in the supporting section 134*a*. The coolant passage opening 25 is a passage opening through which the coolant flowing on the rear surface side of the supporting section 134*a* passes to flow to the inner side of the supporting section 134*a*. A guide wall 126 is formed in the vicinity of the coolant passage opening 25. The guide wall 126 is a wall for guiding the coolant such that the coolant flowing on the rear surface side of the supporting section 134*a* toward the coolant passage opening 25 flows into the coolant passage opening 25. The guide wall 126 includes an upper wall 261 formed on the upper side of the coolant passage opening 25, and a side wall 262 formed on the lateral side in the coolant flow direction, and therefore the flow of the coolant flowing from the obliquely lower side of the coolant passage opening 25 is blocked by the upper wall 261 and the side wall 262, so that the coolant flows into the coolant passage opening 25. A coolant gathering wall 263 which is inclined upwardly toward the lower end of the side wall 262 is connected to the lower end of the side wall 262 of the guide wall 26. The coolant gathering wall 263 plays a role of gathering the coolant flowing below the coolant passage opening 25 at the coolant passage opening 25.

In the supporting section 134*a*, a portion connecting the supporting section bore portions adjacent to each other is a boundary 48 of the supporting section bore portions. A portion of the boundary 48 of the supporting section bore portions and the vicinity of the boundary 48 in the supporting section 134*a* is a portion facing a wall surface corresponding to the lateral side of the inter-bore wall 191 in the wall surface on the groove-like coolant passage side. In the present invention, the portion of the boundary of the supporting section bore portions and the vicinity of the boundary in the supporting section, that is, the portion facing the wall surface corresponding to the lateral side of the inter-bore wall in the wall surface on the groove-like coolant passage is referred to as a supporting section inter-bore portion.

Figure 20:
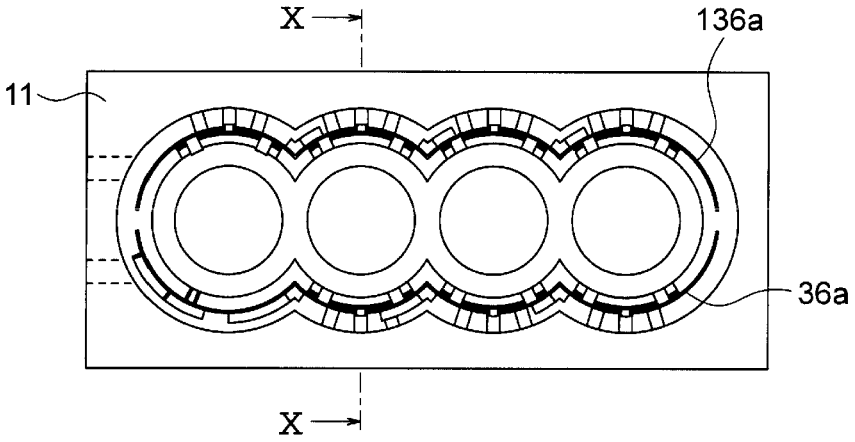
FIG. 20 is a schematic view illustrating a state in which the thermal insulator 36*a* for the cylinder bore wall and the thermal insulator 136*a* for the cylinder bore wall are set in the cylinder block 11 illustrated in FIG. 1.
Figure 21:
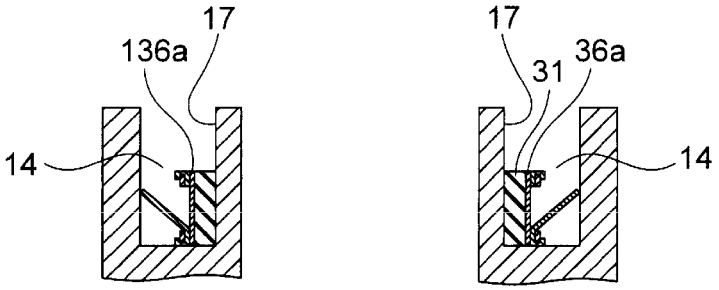
FIG. 21 is a schematic view illustrating a state in which the thermal insulator 36*a* for the cylinder bore wall and the thermal insulator 136*a* for the cylinder bore wall are set in the cylinder block 11 illustrated in FIG. 1.

The thermal insulator 36*a* for the cylinder bore wall and the thermal insulator 136*a* for the cylinder bore wall are set in, for example, the groove-like coolant passage 14 of the cylinder block 11 illustrated in FIG. 1. As illustrated in FIG. 19, the thermal insulator 36*a* for the cylinder bore wall and the thermal insulator 136*a* for the cylinder bore wall are inserted into the groove-like coolant passage 14 of the cylinder block 11. As illustrated in FIG. 20 and FIG. 21, the thermal insulator 36*a* for the cylinder bore wall and the thermal insulator 136*a* for the cylinder bore wall are set in the groove-like coolant passage 14. In this way, the thermal insulator 36*a* for the cylinder bore wall is set on the wall surface 17*a* side in one one-side half, and the thermal insulator 136*a* for the cylinder bore wall is set on the water surface 17*b* side in the other one-side half.

At this time, in the thermal insulator 36*a* for the cylinder bore wall, the metal leaf springs 39 are attached such that the distance from the contact surface 6 of the rubber member 31 of the bore wall insulating section 35 to each of the distal end sides 27 of the metal leaf springs 39 is larger than the width of the groove-like coolant passage 14. Therefore, when the thermal insulator 36*a* for the cylinder bore wall is set in the groove-like coolant passage 14, the metal leaf springs 39 are sandwiched between the rear surface of the bore wall insulating section 35 and the wall surface 18, whereby a force is applied to the distal ends 27 of the metal leaf springs 39 in a direction toward the metal-leaf-spring attaching member 33. Consequently, the metal leaf springs 39 are deformed such that the distal ends 27 approach the metal-leaf-spring attaching member 33 side. Therefore, a restoring elastic force is generated in the metal leaf springs 39. The metal-leaf-spring attaching member 33 is pushed toward the wall surface 17 on the cylinder bore side of the groove-like coolant passage with the elastic force. As a result, the rubber member 31 is pressed against the wall surface 17 on the cylinder bore side of the groove-like coolant passage by the rear surface pressing member 32 pushed by the metal-leaf-spring attaching member 33. That is, the thermal insulator 36*a* for the cylinder bore wall is set in the groove-like coolant passage 14, whereby the metal leaf springs 39 are deformed. The rear surface pressing member 32 is urged by a restoring elastic force of the deformation to press the rubber member 31 against the wall surface 17 on the cylinder bore side of the groove-like coolant passage. In this way, the rubber member 31 of the bore wall insulating section 35 of the thermal insulator 36*a* for the cylinder bore wall comes into contact with the bore wall surfaces of the cylinder bores in a part of the wall surface 17*a* in one one-side half of the entire wall surface 17 on the cylinder bore side of the groove-like coolant passage.

Figure 22:
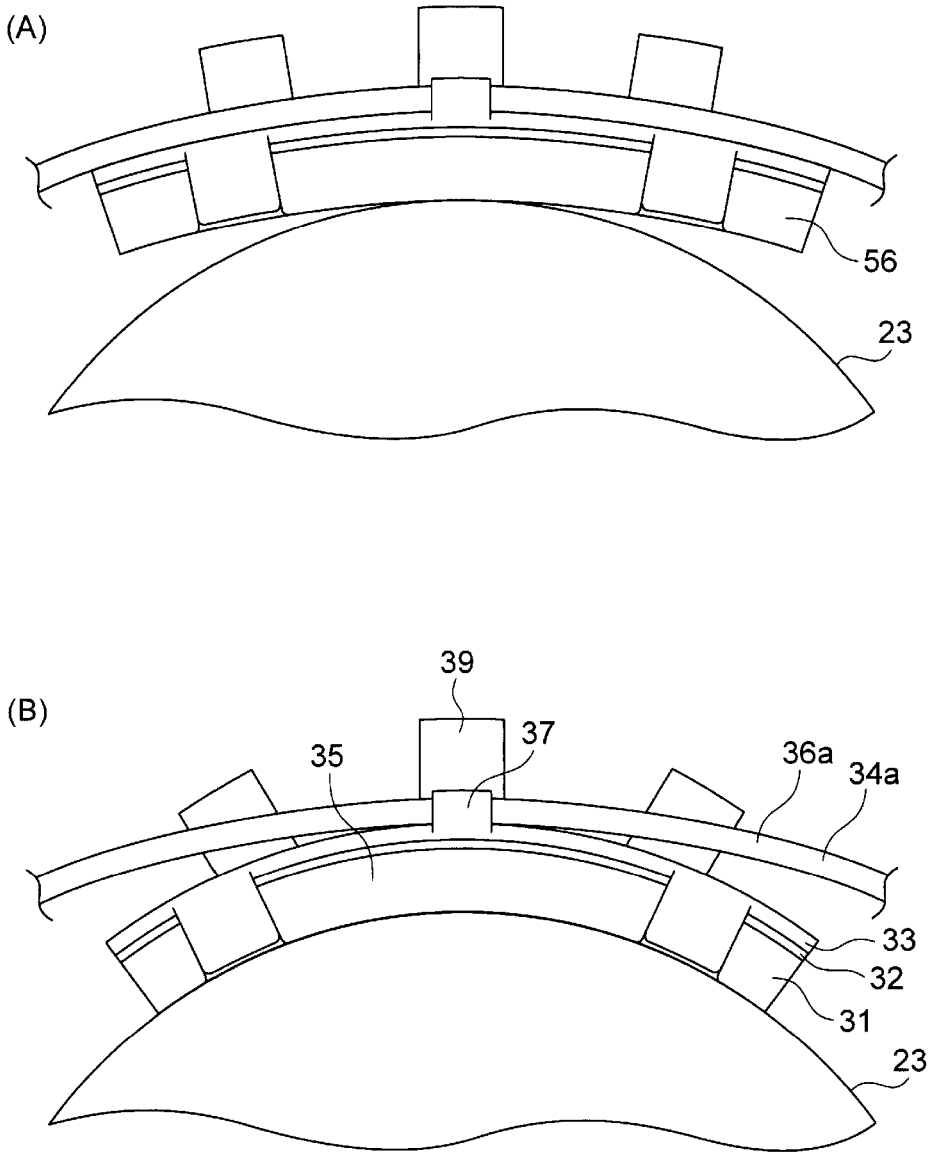
FIG. 22 is a view illustrating a state in which the bore wall insulating section of the thermal insulator for the cylinder bore wall is in contact with a bore wall.

At this time, in the thermal insulator 36*a* for the cylinder bore wall, only the center or the vicinity of the center in the arc direction when the bore wall thermal insulator is viewed from above of the bore wall insulating section 35 is fixed to the supporting section 34*a*. Therefore, when the metal-leaf-spring attaching member 33 and the rear surface pressing member 32 of the bore wall insulating section 35 are urged by the metal leaf springs 39, the metal-leaf-spring attaching member 33, the rear surface pressing member 32, and the rubber member 31 can be deformed independently from the supporting section 34*a*. This is described with reference to FIG. 22. In manufacturing of the thermal insulator for the cylinder bore wall, the rubber member is machined such that a curvature of the contact surface of the rubber member of the bore wall insulating section coincides with a curvature of the wall surface of the bore wall of the cylinder bore in contact with the rubber member. However, actually, machining errors occur with respect to design values in both of the contact surface of the rubber member and the wall surface of the bore wall of the cylinder bore. When the curvature of the contact surface of the rubber member is smaller than the curvature of the wall surface of the bore wall of the cylinder bore because of the machining error of the contact surface of the rubber member or the wall surface of the bore wall of the cylinder bore, as illustrated in FIG. 22(A), if the entire thermal insulator is fixed to the supporting section (e.g., if three places in total, that is, the vicinity of the center and both of the ends in the arc direction when the insulating section is viewed from above are fixed to the supporting section), the vicinity of the center in the arc direction of a rubber member 56 can come into contact with the bore wall 23 of the cylinder bore when being urged by the metal leaf springs. However, portions at the ends cannot come into contact with the bore wall. On the other hand, when the curvature of the contact surface of the rubber member is smaller than the curvature of the wall surface of the bore wall of the cylinder bore, as illustrated in FIG. 22(B), if only the center or the vicinity of the center of the bore wall insulating section 35 in the arc direction when the bore wall insulating section is viewed from above is fixed to the supporting section 34*a*, the portions at the ends of the bore wall insulating section 35 can be deformed to separate from the supporting section 34*a* to move toward the bore wall 23 of the cylinder bore when being urged by the metal leaf spring 39. Therefore, not only the vicinity of the center in the arc direction of the rubber member 31 but also the ends of the rubber member 31 can come into contact with the bore wall 23 of the cylinder bore. Therefore, in the thermal insulator 36*a* for the cylinder bore wall, even if there is a difference between the curvatures of the contact surface 6 of the rubber member 31 and the wall surface of the bore wall 23 of the cylinder bore because of the machining error, the rubber member 31 can be surely brought into contact with the wall surface of the bore wall of the cylinder bore. Therefore, adhesion of the bore wall 23 of the cylinder bore of the rubber member 31 to the wall surface (the wall surface 17 on the cylinder bore side of the groove-like coolant passage 14) is improved.

Figure 23:
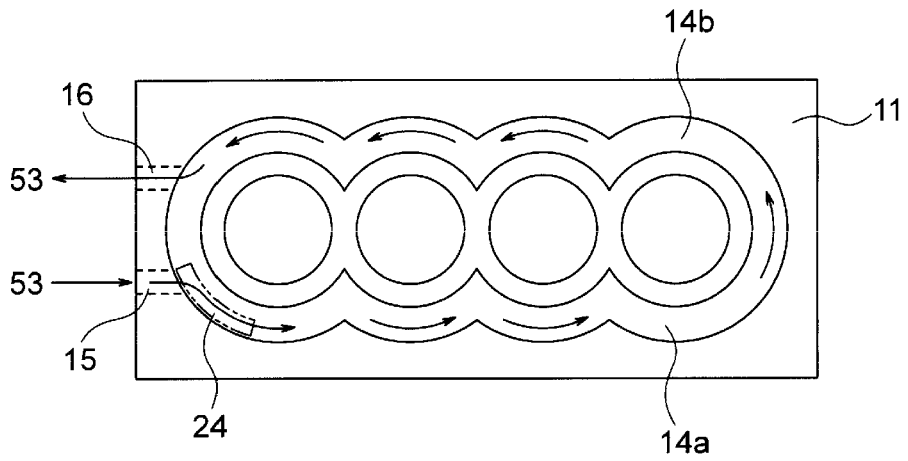
FIG. 23 is a view illustrating a flow direction of the coolant supplied to a groove coolant passage.

The flow of the coolant when the coolant is supplied into the groove-like coolant passage 14 in a state in which the thermal insulator 36*a* for the cylinder bore wall and the thermal insulator 136*a* for the cylinder bore wall are set in the groove-like coolant passage 14 of the cylinder block 11 illustrated in FIG. 1 will be described with reference to FIG. 23 to FIG. 27. FIG. 23 is a view illustrating a flow direction of coolant 53 flowing in the groove-like coolant passage when the coolant 53 is supplied from the coolant supply port 15 of the cylinder block 11 and is discharged from the coolant discharge port 16 of the cylinder block 11, and is a top view of the cylinder block 11. Note that, in FIG. 23, for the convenience of description, only a contour of the coolant flow suppressing wall 24 of the thermal insulator 36*a* for the cylinder bore wall is indicated by a two-dot chain line, and the other portions of the thermal insulator 36*a* for the cylinder bore wall and the thermal insulator 136*a* for the cylinder bore wall are omitted. As illustrated in FIG. 23, the coolant 53 supplied from the coolant supply port 15 firstly flows from an end on the coolant supply port 15 side of the groove-like coolant passage 14*a* in one one-side half toward an end on the opposite side of the end on the coolant supply port 15 side in the groove-like coolant passage 14*a* due to the presence of the coolant flow suppressing wall 24 in the vicinity of the coolant supply port 15. Subsequently, when reaching the end on the opposite side of the end on the coolant supply port 15 side in the groove-like coolant passage 14*a* in the one one-side half, the coolant 53 turns to the groove-like coolant passage 14*b* in the other one-side half, flows toward the coolant discharge port 16 in the groove-like coolant passage 14*b* in the other one-side half, and then is discharged from the coolant discharge port 16.

Figure 24:
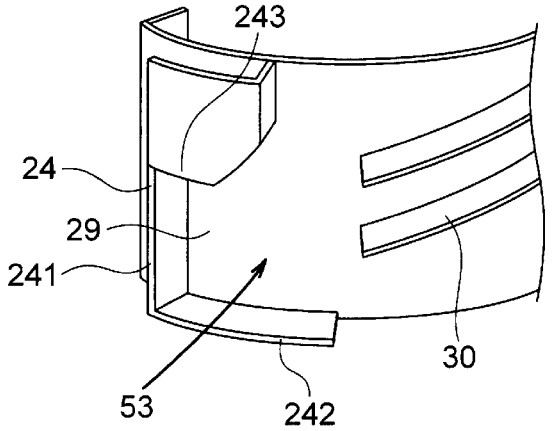
FIG. 24 is a view illustrating a flow direction of the coolant supplied to a groove coolant passage.
Figure 25:
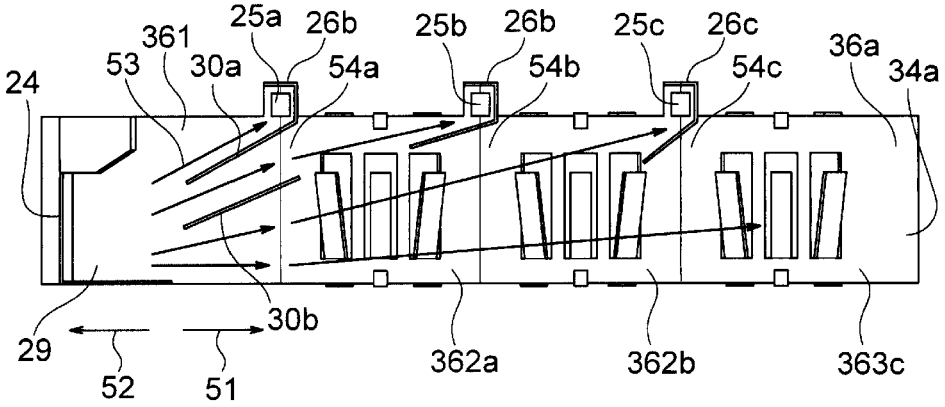
FIG. 25 is a view illustrating a flow direction of the coolant supplied to a groove coolant passage.
Figure 26:
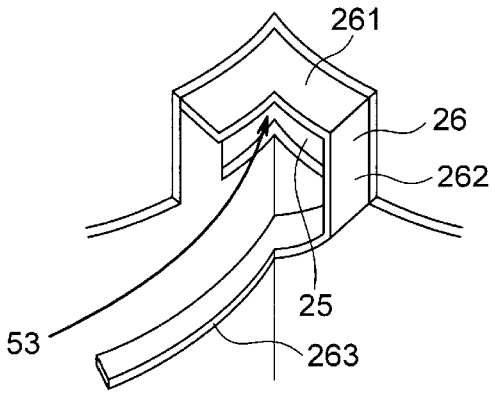
FIG. 26 is a view illustrating a flow direction of the coolant supplied to a groove coolant passage.

As illustrated in FIG. 24, the coolant 53 supplied from the coolant supply port 15 firstly strikes on the coolant contact surface 29 on the rear surface side of the supporting section bore portion 361 of a water jacket spacer 36*a*. The coolant flow suppressing wall 24 is formed on the opposite side of the coolant flow direction of the coolant contact surface 29 to surround an approximately half portion on the opposite side of the coolant flow direction in the coolant contact surface 29. Therefore, the coolant 53 that has struck on the coolant contact surface 29 flows toward the inclined wall 30 in the coolant flow direction 51 without flowing in the opposite direction 52 of the coolant flow direction. Subsequently, as illustrated in FIG. 25, the inclined wall 30 extending with an upward inclination from the vicinity of the coolant contact surface 29 is formed at a more advanced position in the coolant flow direction on the coolant contact surface 29. Therefore, the coolant 53 flowing toward the inclined wall 30 is redirected by this inclined wall 30, and flows toward the coolant passage opening 25 formed on the upper portion of the supporting section inter-bore portion 54. That is, the flow of the coolant toward the coolant passage opening 25 is created by the inclined wall 30, the coolant passage opening 25 being formed on the upper portion of the supporting section inter-bore portion 54. In the thermal insulator 36*a* for the cylinder bore wall in the form example illustrated in FIG. 25, coolant passage openings 25*a*, 25*b*, and 25*c* are formed on three upper portions of the supporting section inter-bore portions 54, respectively. Two inclined walls 30*a* and 30*b* create the coolant flow toward the coolant passage opening 25*a*, the coolant flow toward the coolant passage opening 25*b*, and the coolant flow toward the coolant passage opening 25*c*. Subsequently, as illustrated in FIG. 26, the guide wall 26 for guiding the coolant 53 that has flowed toward the coolant passage opening 25 to flow into the coolant passage opening 25 is formed in the vicinity of the coolant passage opening 25. Therefore, the coolant 53 that has flowed toward the coolant passage opening 25 flows into the coolant passage opening 25 by the guide wall 26, and flows from the outside to the inside of the supporting section 34*a*. Since the coolant passage opening 25 is formed on the upper portion of the supporting section inter-bore portion 54, there is the upper portion of the boundary 192 of the bore walls of the cylinder bores and the vicinity of the boundary 192 beyond the coolant passage opening 25. The coolant 53 flowing from the coolant contact surface 29 toward the coolant passage opening 25 has a low temperature, and the temperature of the upper portion of the boundary 192 of the bore walls of the cylinder bores and the vicinity of the boundary 192 is the highest in the wall surface on the cylinder bore side of the groove-like coolant passage. Accordingly, in the thermal insulator 36*a* for the cylinder bore wall, the coolant 53 that has flowed from the coolant contact surface 29 toward the coolant passage opening 25, that is, the coolant 53 having a low temperature can strike on the highest temperature portion in the wall surface on the cylinder bore side of the groove-like coolant passage, whereby the cooling efficiency can be increased.

Figure 27:
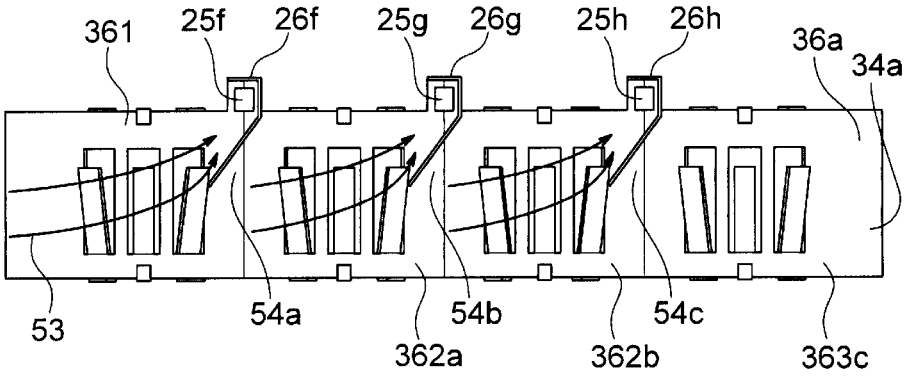
FIG. 27 is a view illustrating a flow direction of the coolant supplied to a groove coolant passage.

The coolant that has flowed into the groove-like coolant passage gently flows in the groove-like coolant passage (the groove-like coolant passage 14*b* in a one-side half in FIG. 23) in the one-side half on the opposite side of a side where the coolant vigorously flows. Usually, a passage hole of the coolant called a drill path is provided in the cylinder block, the passage hole passing from the upper portion of the boundary of the bore walls of the cylinder bores to the inter-bore wall of the cylinder head. Therefore, the gentle flow of the coolant toward the upper portion of the boundary of bore walls of the cylinder bores, that is, the coolant passage openings 25*f*, 25*g*, and 25*h* formed on the upper portion of the inter-bore portion 54 is created in the groove-like coolant passage on the rear surface side of the supporting section 134*a*. As illustrated in FIG. 27, the coolant 53 flowing below the coolant passage openings 25*f*, 25*g*, and 25*h* is gathered, toward the coolant passage openings 25*f*, 25*g*, and 25*h*, together with the coolant 53 flowing toward the coolant passage openings 25*f*, 25*g*, and 25*h* by the coolant gathering walls 263*f*, 263*g*, and 263*h*, and flows into the coolant passage openings 25*f*, 25*g*, and 25*h* by guide walls 126*a*, 126*b*, and 126*c*. Accordingly, in the thermal insulator 136*a* for the cylinder bore wall, the coolant flowing on the rear surface side can be gathered to flow into an inlet of the drill path, whereby the cooling efficiency can be increased.

Figure 36:
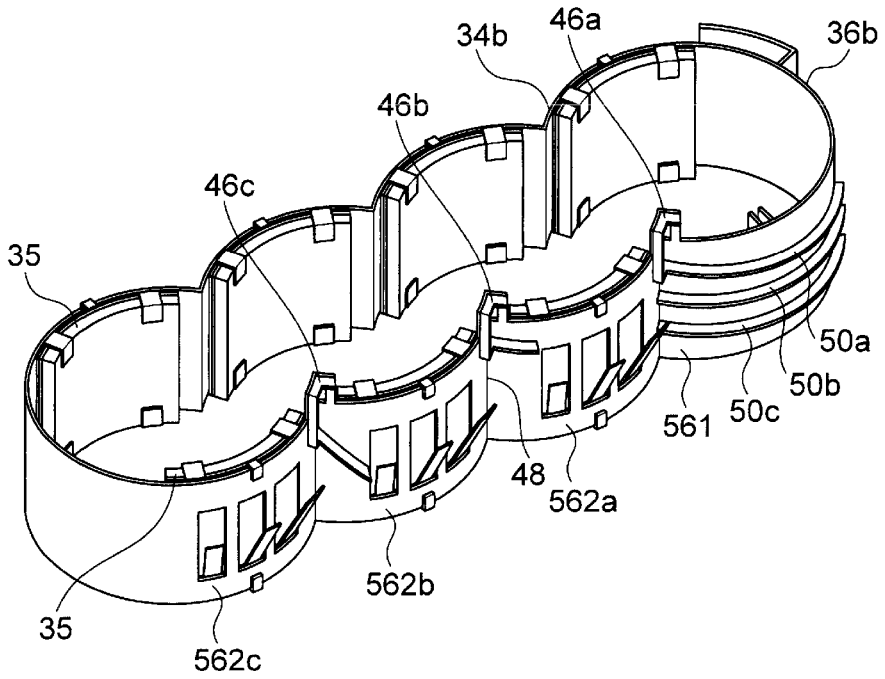
FIG. 36 is a schematic perspective view illustrating a form example of a thermal insulator for a cylinder bore wall of the present invention.
Figure 37:
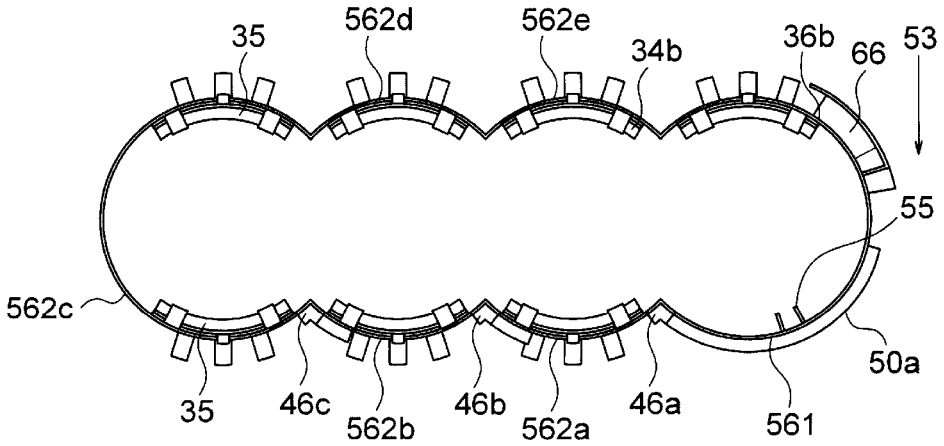
FIG. 37 is a top plan view of a thermal insulator 36*b* for the cylinder bore wall illustrated in FIG. 36.
Figure 38:
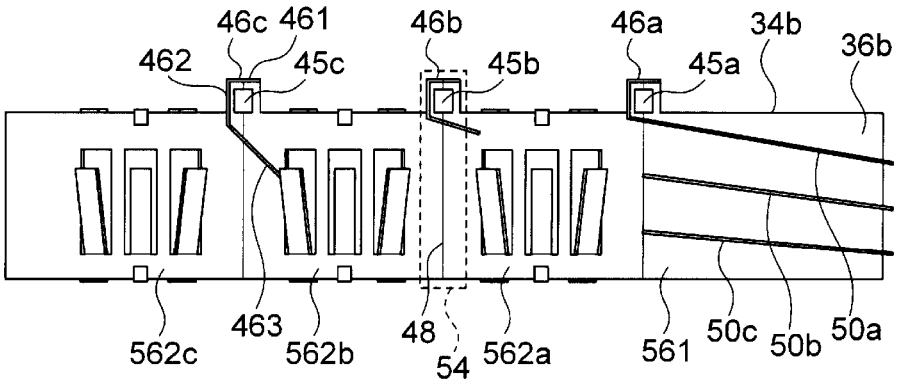
FIG. 38 is a side view illustrating a side on which a coolant passage opening of a water jacket spacer illustrated in FIG. 36 is formed, as viewed from a rear surface side.
Figure 39:
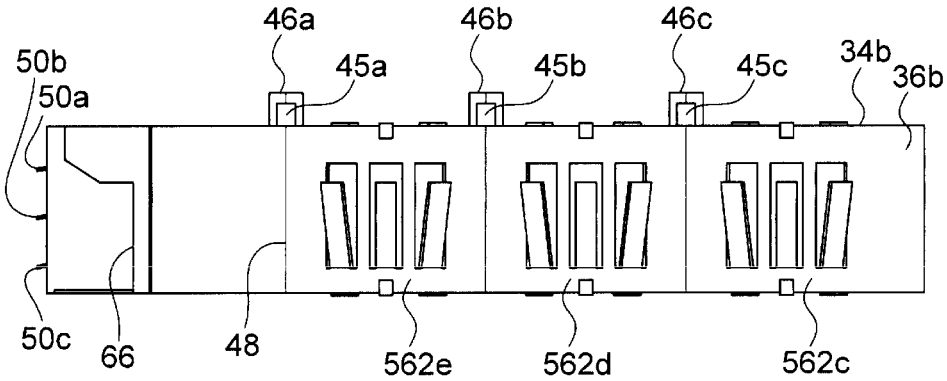
FIG. 39 is a side view illustrating a side on which a coolant passage opening of a water jacket spacer illustrated in FIG. 36 is not formed, as viewed from a rear surface side.
Figure 40:
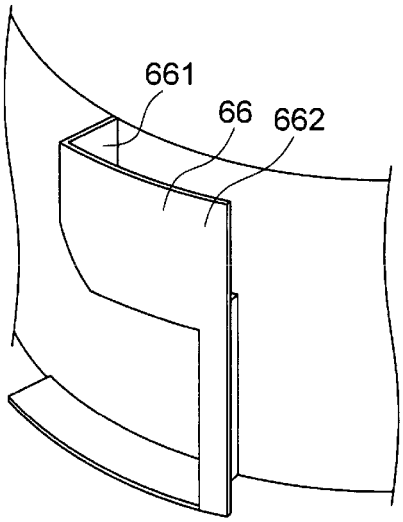
FIG. 40 is an enlarged view of a coolant flow changing member 66 of the water jacket spacer illustrated in FIG. 36.
Figure 40:
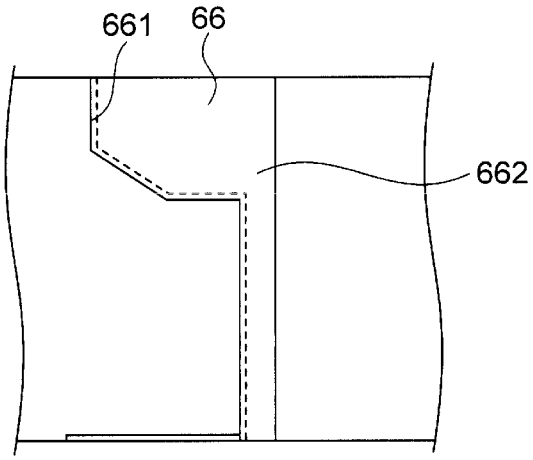

Another form example of the thermal insulator for the cylinder bore wall of the first form of the present invention will be described. FIG. 36 is a schematic perspective view illustrating another form example of the thermal insulator for the cylinder bore wall of the present invention. FIG. 37 is a top view of a thermal insulator 36*b* for the cylinder bore wall illustrated in FIG. 36. FIG. 38 is a side view of the thermal insulator 36*b* for the cylinder bore wall illustrated in FIG. 36 as viewed from a side on which a coolant passage opening is formed. FIG. 39 is a side view of the thermal insulator 36*b* for the cylinder bore wall illustrated in FIG. 36 as viewed from a side on which a coolant passage opening is not formed.

The thermal insulator 36*b* for the cylinder bore wall illustrated in FIG. 36 is another form example of a thermal insulator for a cylinder bore wall of the first form of the present invention. The thermal insulator 36*b* for the cylinder bore wall is a thermal insulator for a cylinder bore wall which is set in the entire circumferential direction of the groove-like coolant passage 14 in FIG. 44. The thermal insulator 36*b* for the cylinder bore wall is a form example of a thermal insulator for a cylinder bore wall at a position to which the coolant is supplied, in which the inclined wall is formed on the supporting section bore portion but the coolant contact surface and the coolant flow suppressing wall are not formed.

Similarly to the thermal insulator 36*a* for the cylinder bore wall, in the thermal insulator 36*b* for the cylinder bore wall, the bore wall insulating sections 35 are fixed with a contact surface 6 of the rubber member 31 facing the cylinder bore wall side such that the contact surface 6 of the rubber member 31 can come into contact with the wall surface 17 on the cylinder bore side of the groove-like coolant passage 14, and on the rear surface side of the thermal insulator 36*b* for the cylinder bore wall, metal leaf springs 39 attached to the bore wall insulating sections 35 project toward the opposite side of the rubber member 31 through openings 42 of the supporting section 34*b*.

The bore wall insulating section 35 fixed to the thermal insulator 36*b* for the cylinder bore wall is the same as the bore wall insulating section 35 fixed to the thermal insulator 36*a* for the cylinder bore wall.

The supporting section 34*b* is formed into a shape surrounding the circumference of the cylinder bore wall when viewed from above, and the shape of the supporting section 34*b* is a shape conforming to the entire circumference of the groove-like coolant passage 14. That is, the supporting section 34*b* is formed in a shape of continuous six arcs when viewed from above. Therefore, in the supporting section 34*b*, a bore portion 561 on an end bore side at one end, a bore portion 562*a* on an intermediate bore side, a bore portion 562*b* on the intermediate bore side, a bore portion 562*c* on an end bore side at the other end, a bore portion 562*d* on the intermediate bore side, and a bore portion 562*e* on the intermediate bore side, each of which is formed in an arcuate shape when viewed from above, are continuously connected in this order. The supporting section 34*b* is an injection molded product made of a synthetic resin. That is, the supporting section 34*b* is made of a synthetic resin.

In the supporting section bore portions to which the respective bore portion insulating sections 35 are fixed, that is, the supporting section bore portion 562*a*, the supporting section bore portion 562*b*, the supporting section bore portion 562*c*, the supporting section bore portion 562*d*, and the supporting section bore portion 562*e*, among the supporting section bore portions in the supporting section 34*b*, the openings 42 are formed such that the metal leaf springs 39 attached to the bore wall insulating sections 35 can pass through the supporting section 34*b* and project toward the wall surface 18 on the opposite side of the wall surface 17 on the cylinder bore side of the groove-like coolant passage 14 from the rear surface side of the thermal insulator 36*a* for the cylinder bore wall.

Similarly to the thermal insulator 36*a* for the cylinder bore wall, in the thermal insulator 36*b* for the cylinder bore wall, only the center or the vicinity of the center in the arc direction, when viewed from above, of the bore wall insulating section 35 is fixed to the supporting section 34*b*.

The supporting section bore portions include the supporting section bore portion 561 in which an inclined wall 50 is formed, and the supporting section bore portion 562 in which the inclined wall 50 is not formed. Note that the coolant 53 is supplied to the thermal insulator 36*b* for the cylinder bore wall in a direction indicated by an arrow illustrated in FIG. 37.

The supporting section bore portion 561 is a bore portion at a position where the coolant is supplied into the groove-like coolant passage. In a cylinder block 31 illustrated in FIG. 44, the supporting section bore portion 561 is at a position where a coolant supply port 44 is formed.

The inclined wall 50 is formed on a rear surface side of the supporting section bore portion 561. The inclined wall 50 is an inclined wall for creating the flow of the coolant from the vicinity of the position into which the coolant flows toward a coolant passage opening 45 such that the coolant supplied from the coolant supply port 44 flows toward the coolant passage opening 45. Therefore, the inclined wall 50 extends with an upward inclination from, as a start point, the vicinity of the position between the supporting section and the wall surface on the opposite side of the wall surface on the cylinder bore side of the groove-like coolant passage, into which much of the coolant supplied from the coolant supply port flows.

The coolant passage opening 45 is formed on the upper portion of the supporting section inter-bore portion 54. The coolant passage opening 45 is a passage opening through which the coolant flowing on the rear surface side of the supporting section 34*b* passes to flow to the inner side of the supporting section 34*b*. A guide wall 46 is formed in the vicinity of the coolant passage opening 45. The guide wall 46 is a wall for guiding the coolant such that the coolant flowing from the position into which the coolant flows toward the coolant passage opening 25 flows into the coolant passage opening 45. The guide wall 46 includes an upper wall formed on the upper side of the coolant passage opening 45, and a side wall formed on the lateral side in the coolant flow direction, and therefore the flow of the coolant flowing from the obliquely lower side of the coolant passage opening 45 is blocked by the upper wall and the side wall, so that the coolant flows into the coolant passage opening 45. A coolant gathering wall which is inclined upwardly toward the lower end of the side wall is connected to the lower end of the side wall of the guide wall 46. The coolant gathering wall plays a role of gathering the coolant flowing slightly below the coolant passage opening 45 at the coolant passage opening 25. Note that in the form example illustrated in FIG. 36, a coolant gathering wall of a guide wall 46*a* is connected with an inclined wall 50*a*.

A vertical rib 55 is formed on the inner surface of the supporting section bore portion 561 at a position to which the coolant is supplied. A coolant flow changing member 66 is formed in the supporting section bore portion 561 among the bore portions in the supporting section 34*b*. The coolant flow changing member 66 is a member for stopping the flow of the coolant which has flowed in the groove-like coolant passage, to change the flow of the coolant to the upward direction. Note that the coolant whose flow direction has been changed to the upward direction flows into the coolant passage in the cylinder head that is mounted on the cylinder block.

Figure 44:
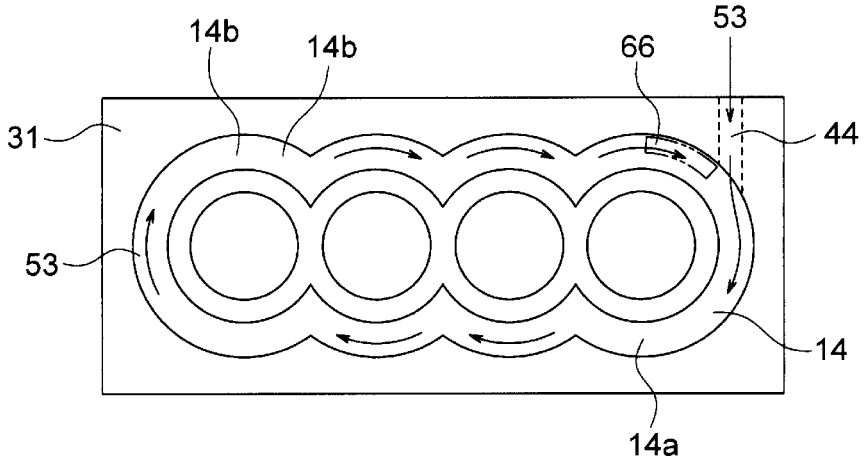
FIG. 44 is a view illustrating a flow direction of the coolant supplied to a groove coolant passage.

The thermal insulator 36*b* for the cylinder bore wall is set in, for example, the groove-like coolant passage 14 of the cylinder block 31 illustrated in FIG. 44.

The flow of the coolant when the coolant is supplied into the groove-like coolant passage 14 in a state in which the thermal insulator 36*b* for the cylinder bore wall is set in the groove-like coolant passage 14 of the cylinder block 31 illustrated in FIG. 44 will be described with reference to FIG. 41 to FIG. 44. FIG. 44 is a view illustrating a flow direction of coolant 53 flowing in the groove-like coolant passage when the coolant 53 is supplied from the coolant supply port 44 of the cylinder block 31 and is discharged to the coolant passage in the cylinder head that is mounted on the cylinder block 31 when viewed from above of the cylinder block 31. Note that, in FIG. 44, for the convenience of description, only a contour of the coolant flow changing member 66 of the thermal insulator 36*b* for the cylinder bore wall is indicated by a two-dot chain line, and the other portions of the thermal insulator 36*b* for the cylinder bore wall are omitted. As illustrated in FIG. 44, the cylinder block 31 has a structure in which the coolant supplied from the coolant supply port 44 flows through an area between the supporting section of the thermal insulator for the cylinder bore wall and the wall surface on the opposite side of the wall surface on the cylinder block side of the groove-like coolant passage without strongly striking on the rear surface of the thermal insulator for the cylinder bore wall that is set in the groove-like coolant passage 14, and flows to the groove-like coolant passage 14*a* in one one-side half. The coolant that has flowed to one end side of the groove-like coolant passage 14*a* in one one-side half firstly flows from one end side to an end on the opposite side of the one end side of the groove-like coolant passage in one one-side half. Subsequently, when reaching the end on the opposite side of the end on a side on which the coolant flows into the groove-like coolant passage 14*a* in one one-side half, the coolant turns to the groove-like coolant passage 14*b* in the other one-side half, and flows in the groove-like coolant passage 14*b* in the other one-side half toward the coolant supply port 44. Since the coolant flow changing member 66 is provided in front of the coolant supply port 44 in the flow direction of the coolant in the groove-like coolant passage 14*b* in the other one-side half, the flow of the coolant is changed to the upward direction at the position of the coolant flow changing member 66, whereby the coolant is discharged to the coolant passage in the cylinder head.

Figure 41:
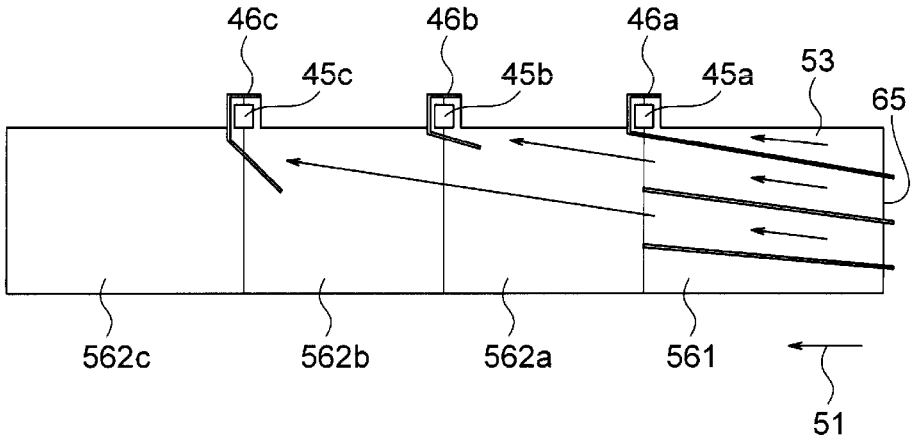
FIG. 41 is a view illustrating a flow direction of the coolant supplied to a groove coolant passage.
Figure 42:
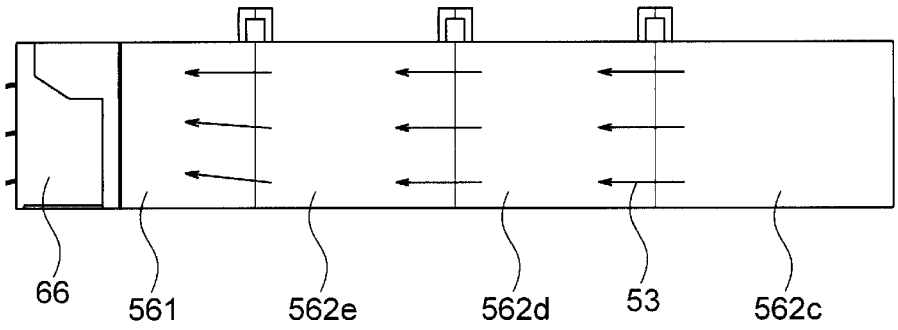
FIG. 42 is a view illustrating a flow direction of the coolant supplied to a groove coolant passage.

The coolant 53 supplied from the coolant supply port 44 of the cylinder block 31 illustrated in FIG. 44 firstly flows through an area between the supporting section bore portion 561 of the thermal insulator 36*b* for the cylinder bore wall and the wall surface on the opposite side of the wall surface on the cylinder bore side of the groove-like coolant passage, and flows into the groove-like coolant passage 14*a* in one one-side half. Subsequently, the supporting section bore portion 561 is provided on the side on which the coolant flows into the groove-like coolant passage 14*a* in one one-side half, and as illustrated in FIG. 41, on the rear surface side of the supporting section bore portion 561, the inclined wall 50 that is inclined upwardly is formed from, as a start point, a portion 65 positioned in the vicinity of the inlet of the groove-like coolant passage 14*a* in one one-side half. Therefore, the flow of the coolant 53 is changed due to this inclined wall 50, and the coolant 53 flows toward the coolant passage opening 45 formed on the upper portion of the supporting section inter-bore portion 54. That is, the flow of the coolant toward the coolant passage opening 45 is created by the inclined wall 50, the coolant passage opening 45 being formed on the upper portion of the supporting section inter-bore portion 54. In the thermal insulator 36*b* for the cylinder bore wall in the form example illustrated in FIG. 36, the coolant passage openings 45*a*, 45*b*, and 45*c* are formed at three upper portions of the supporting section inter-bore portions 54, respectively. Three inclined walls 50*a*, 50*b*, and 50*c* create the coolant flow toward the coolant passage opening 45*a*, the coolant flow toward the coolant passage opening 45*b*, and the coolant flow toward the coolant passage opening 45*c*. Subsequently, the guide wall 46 for guiding the coolant 53 that has flowed toward the coolant passage opening 45 to flow into the coolant passage opening 45 is formed in the vicinity of the coolant passage opening 45. Therefore, the coolant 53 that has flowed toward the coolant passage opening 45 flows into the coolant passage opening 45 by the guide wall 46, and flows from the outside to the inside of the supporting section 34*b*. Since the coolant passage opening 45 is formed on the upper portion of the supporting section inter-bore portion 54, there is the upper portion of the boundary 192 of the bore walls of the cylinder bores and the vicinity of the boundary 192 beyond the coolant passage opening 45. The coolant 53 flowing to the rear surface side of the bore portion 561 of the groove-like coolant passage 14*a* in one one-side half has a low temperature, and the temperature of the upper portion of the boundary 192 of the bore walls of the cylinder bores and the vicinity of the boundary 192 is the highest in the wall surface on the cylinder bore side of the groove-like coolant passage. Accordingly, in the thermal insulator 36*b* for the cylinder bore wall, the coolant 53 that has flowed to the rear surface side of the supporting section bore portion 561 of the groove-like coolant passage 14*a* in one one-side half, that is, the coolant having a low temperature can strike on the highest temperature portion in the wall surface on the cylinder bore side of the groove-like coolant passage, whereby the cooling efficiency can be increased.

Figure 43:
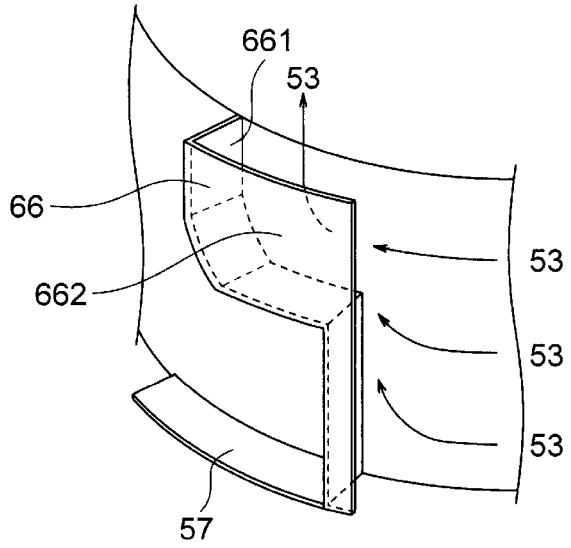
FIG. 43 is a view illustrating a flow direction of the coolant supplied to a groove coolant passage.
Figure 43:
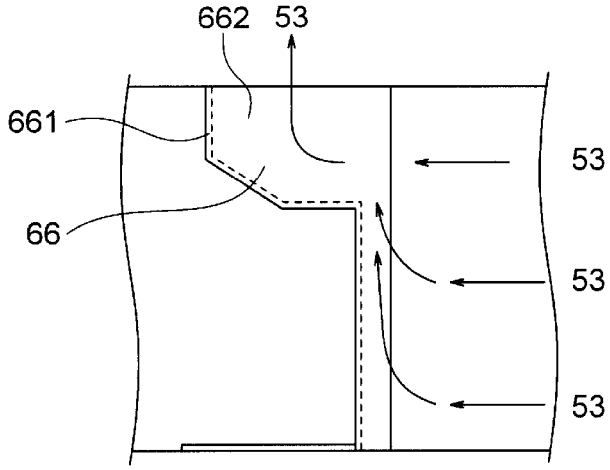

The coolant that has not flowed into the coolant passage opening 45 in the coolant flowing on the rear surface side of the supporting section bore portion 561, the supporting section bore portion 562*a*, and the supporting section bore portion 562*b* in the groove-like coolant passage 14*a* in one one-side half flows on the rear surface side of the supporting section bore portion 562*c*, flows in the groove-like coolant passage 14*b* in the other one-side half, flows on the rear surface side of the supporting section bore portion 562*d* and on the rear surface side of the supporting section bore portion 562*e*, and reaches a position at which the coolant flow changing member 66 is formed. As illustrated in FIG. 43, the coolant 53 that has reached the coolant flow changing member 66 strikes on a coolant flow changing wall 661, the flow direction of the coolant 53 is changed to the upward direction, and the coolant 53 flows to the coolant passage in the cylinder head that is mounted on the cylinder block 31. Note that an enclosure wall 662 provided on the lateral side of the coolant flow changing wall 661 and projecting in front of the coolant flow changing wall 661 in the flow direction is formed in the coolant flow changing member 66, so that the coolant 53 flows toward the coolant flow changing wall 661 and is less likely to pass through a gap between the coolant flow changing wall 661 and the wall surface on the opposite side of the wall surface on the cylinder bore side of the groove-like coolant passage.

The coolant flow changing wall 661 of the coolant flow changing member 66 plays a role of preventing the coolant supplied from the coolant supply port 44 to the groove-like coolant passage 14 from flowing toward the supporting section bore portion 562*e*.

A thermal insulator for a cylinder bore wall of a first form of the present invention is a thermal insulator set in a groove-like coolant passage of a cylinder block of an internal combustion engine including cylinder bores and for insulating all of bore walls in a circumferential direction of all the cylinder bores or a part of the bore walls in the circumferential direction of all the cylinder bores when viewed in the circumferential direction, the thermal insulator including: bore wall insulating sections having an arcuate shape when viewed from above and for insulating a wall surface on the cylinder bore side of the groove-like coolant passage; and a supporting section having a shape conforming to a shape of the groove-like coolant passage in a setting position of the thermal insulator, the bore wall insulating sections being fixed to the supporting section, wherein each of the bore wall insulating sections includes: a rubber member in contact with the wall surface on the cylinder bore side of the groove-like coolant passage and for covering the wall surface on the cylinder bore side of the groove-like coolant passage; a rear surface pressing member provided on a rear surface side of the rubber member and for pressing the entire rubber member toward the wall surface on the cylinder bore side of the groove-like coolant passage from the rear surface side; and elastic members that urge the rear surface pressing member to press the rubber member toward the wall surface on the cylinder bore side of the groove-like coolant passage, in each of supporting section bore portions to which the respective bore wall insulating sections are to be fixed, an opening, through which the elastic member passes from an inner side to the rear surface side of the supporting section is formed, a coolant passage opening through which coolant flowing on the rear surface side of the supporting section passes to flow to the inner side of the supporting section is formed on at least one place of upper portions of supporting section inter-bore portions, the supporting section has a guide wall for guiding the coolant formed in a vicinity of the coolant passage opening, such that the coolant flows into the coolant passage opening, and has an inclined wall formed on the rear surface side of the supporting section at a position where the coolant is supplied into the groove-like coolant passage, the inclined wall extending with an upward inclination to create a flow of the coolant toward the coolant passage opening, and only a center or a vicinity of the center in an arc direction of each of the bore wall insulating sections is fixed to the supporting section.

The thermal insulator for the cylinder bore wall of the first form of the present invention is set in the groove-like coolant passage of the cylinder block of the internal combustion engine. The cylinder block in which the thermal insulator for the cylinder bore wall of the present invention is set is a cylinder block of an open deck type in which two or more cylinder bores are formed side by side in series. When the cylinder block is a cylinder block of an open deck type in which two cylinder bores are formed side by side in series, the cylinder block includes cylinder bores including two end bores. When the cylinder block is a cylinder block of an open deck type in which three or more cylinder bores are formed side by side in series, the cylinder block includes cylinder bores including two end bores and one or more intermediate bores. Note that, in the present invention, among the cylinder bores formed side by side in series, bores at both ends are referred to as end bores and a bore sandwiched by other cylinder bores on both sides is referred to as intermediate bore.

A position where the thermal insulator for the cylinder bore wall of the first form of the present invention is set is a groove-like coolant passage. In many internal combustion engines, a position equivalent to a middle and lower part of the groove-like coolant passage of the cylinder bore is a position where the speed of a piston increases. Therefore, it is desirable to insulate the middle and lower part of the groove-like coolant passage. In FIG. 2, a position 10 near the middle between a top part 9 and a bottom part 8 of the groove-like coolant passage 14 is indicated by a dotted line. A portion of the groove-like coolant passage 14 in the lower side of the position 10 near the middle is referred to as a middle and lower part of the groove-like coolant passage. Note that the middle and lower part of the groove-like coolant passage does not mean a portion below a position right in the middle between the top part and the bottom part of the groove-like coolant passage and means a portion below the vicinity of the intermediate position between the top part and the bottom part. Depending on the structure of the internal combustion engine, the position where the speed of the piston increases is a position corresponding to a lower part of the groove-like coolant passage of the cylinder bore. In that case, it is desirable to insulate the lower part of the groove-like coolant passage. Therefore, it is appropriately selected to which position from the bottom part of the groove-like coolant passage is insulated by the thermal insulator for the cylinder bore wall of the present invention, that is, in which position in the up-down direction of the groove-like coolant passage the position of the upper end of the rubber member is set.

The thermal insulator for the cylinder bore wall of the first form of the present invention includes the insulating section for insulating the wall surface on the cylinder bore side of the groove-like coolant passage and the supporting section to which the insulating section is fixed. The thermal insulator for the cylinder bore wall of the first form of the present invention is a thermal insulator for insulating all of the wall surfaces in the circumferential direction on the cylinder bore side of the groove-like coolant passage or a part of the wall surfaces in the circumferential direction on the cylinder bore side of the groove-like coolant passage when viewed in the circumferential direction. That is, the thermal insulator for the cylinder bore wall of the first form of the present invention is a thermal insulator for insulating all of bore walls in the circumferential direction of all the cylinder bores or a part of the bore walls in the circumferential direction of all the cylinder bores when viewed in the circumferential direction. Examples of the thermal insulator for the cylinder bore wall of the first form of the present invention include a thermal insulator for insulating a part of one side among the bore walls of all the cylinder bores as in a form example illustrated in FIG. 5 and a form example illustrated in FIG. 31, and a thermal insulator for insulating a one one-side half and the other one-side half of the bore walls of all the cylinder bores as in a form example illustrated in FIG. 32. Note that, in the present invention, a one-side half means a one-side half in the circumferential direction of the cylinder bore wall or the groove-like coolant passage.

In the thermal insulator for the cylinder bore wall of the first form of the present invention, the bore wall insulating sections are set for each of the bore walls of the cylinder bores about to be insulated by the bore wall insulating sections. The number and a setting range of the bore wall insulating sections are selected as appropriate according to the number and insulating parts of the bore walls of the cylinder bores about to be insulated by the bore wall insulating sections. In the thermal insulator for the cylinder bore wall of the first form of the present invention, one bore wall insulating section may be set in one supporting section bore portion, two bore wall insulating sections may be set in one supporting section bore portion, or three or more bore wall insulating sections may be set in one supporting section bore portion. Alternatively, these forms may be combined. Alternatively, the bore wall insulating sections need not be set in a part of the supporting section bore portions. For example, in the thermal insulator 36*a* for the cylinder bore wall illustrated in FIG. 5, one bore wall insulating section is set for each of supporting section bore portions on the bore wall side of the intermediate bores and supporting section bore portion on the bore wall side of an end bore on the opposite side of an end bore at a position to which the coolant is to be supplied, and a bore wall insulating section is not set in a supporting section bore portion on a bore wall side of an end bore at the position to which the coolant is to be supplied. In the thermal insulator 36*c* for the cylinder bore wall illustrated in FIG. 31, one bore wall insulating section is set for each of supporting section bore portions on one bore wall side of the intermediate bores and a supporting section bore portion on the bore wall side of an end bore on the opposite side of an end bore at a position to which the coolant is to be supplied, and a bore wall insulating section is not set in each of a supporting section bore portion on the bore wall side of an end bore at the position to which the coolant is to be supplied and supporting section bore portions on the other bore wall side of the intermediate bores. In the thermal insulator 36*d* for the cylinder bore wall illustrated in FIG. 32, two bore wall insulating sections are set for a supporting section bore portion on the bore wall side of an end bore on the opposite side of an end bore at a position to which the coolant is to be supplied, and one bore wall insulating section is set for each of supporting section bore portions on the bore wall sides of the intermediate bores and a supporting section bore portion on the bore wall side of an end bore at a position to which the coolant is to be supplied. In a form example illustrated in FIG. 33(D), two bore wall insulating sections are set for one supporting section bore portion on the bore wall side of each cylinder bore. In the thermal insulator for the cylinder bore wall of the first form of the present invention, when viewed from the contact surface side, a bore wall thermal insulator may be set in substantially an entire one supporting section bore portion, a bore wall thermal insulator may be set in a part of one supporting section bore portion, or a bore wall insulating section may be a combination of these forms. For example, in a form example illustrated in FIG. 33(A), when viewed from the contact surface side, the bore wall insulating section 35 is set in substantially an entire supporting section bore portion 362. In a form example illustrated in FIG. 33(B), when viewed from the contact surface side, a bore wall insulating section 35*f* is set in a substantially lower half of a supporting section bore portion 462*b*. In a form example illustrated in FIG. 33(C), when viewed from the contact surface side, a bore wall insulating section 35*e* is set in a substantially upper half of a supporting section bore portion 462*c*. In a form example illustrated in FIG. 33(D), when viewed from the contact surface side, a bore wall insulating section 35*d*1 is set in a substantially quarter in the lower left of a supporting section bore portion 462*d* and a bore wall insulating section 35*d*2 is set in a substantially quarter in the upper right of the supporting section bore portion 462*d*. In the form examples illustrated in FIGS. 33(B), (C), and (D), an insulating range can be more finely set than in the form example illustrated in FIG. 33(A). Note that the supporting section bore portion means a portion of the supporting section on the bore wall side of the cylinder bores and is a portion for one arcuate shape forming the supporting section when viewed from above. FIG. 33 is a schematic view of a form example of the thermal insulator for the cylinder bore wall of the first form of the present invention and a view illustrating one supporting section bore portion. The left side is a view of the form examples viewed from the rear surface side. The right side is a view of the form examples viewed from the contact surface side.

The supporting section is a supporting member on which the bore wall insulating section is fixed and supported. The bore wall insulating section is fixed to the supporting section, whereby the supporting section plays a role of defining a position of the bore wall insulating section such that the position of the bore wall insulating section does not deviate in the groove-like coolant passage. When viewed from above, the supporting section has a shape conforming to the groove-like coolant passage in which the thermal insulator for the cylinder bore wall of the present invention is set. Examples of the shape of the supporting section include a shape corresponding to all of the groove-like coolant passage of the cylinder block (that is, a shape surrounding all the cylinder bore walls), a shape corresponding to one-side half of the groove-like coolant passage of the cylinder block, a shape corresponding to a part of one side of the groove-like coolant passage of the cylinder block, a shape corresponding to one one-side half and a part of the other one side connected thereto, and a shape corresponding to a part of one one-side half and a part of the other one side connected thereto.

Figure 31:
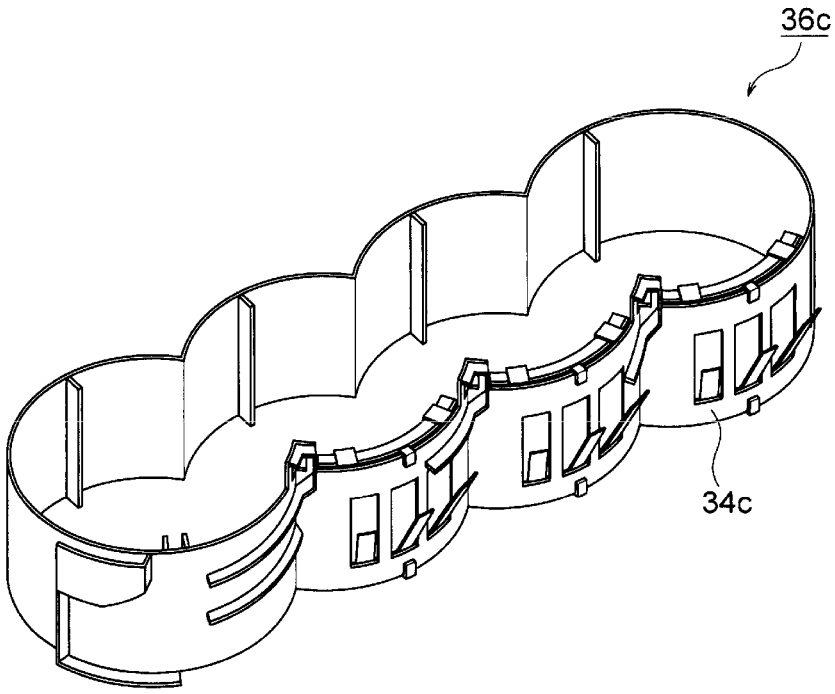
FIG. 31 is a schematic perspective view illustrating a form example of a thermal insulator for a cylinder bore wall of the present invention.
Figure 32:
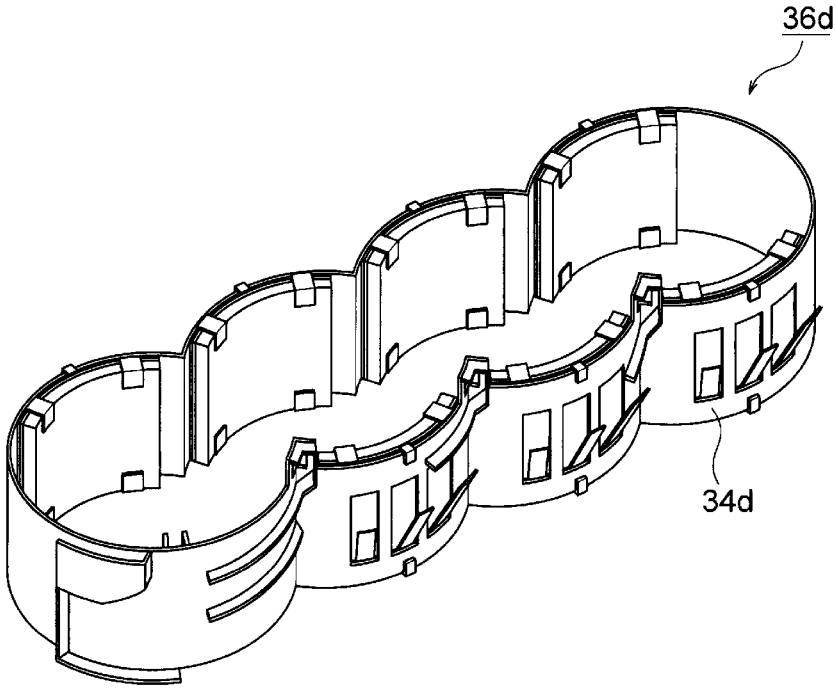
FIG. 32 is a schematic perspective view illustrating a form example of a thermal insulator for a cylinder bore wall of the present invention.
Figure 33:
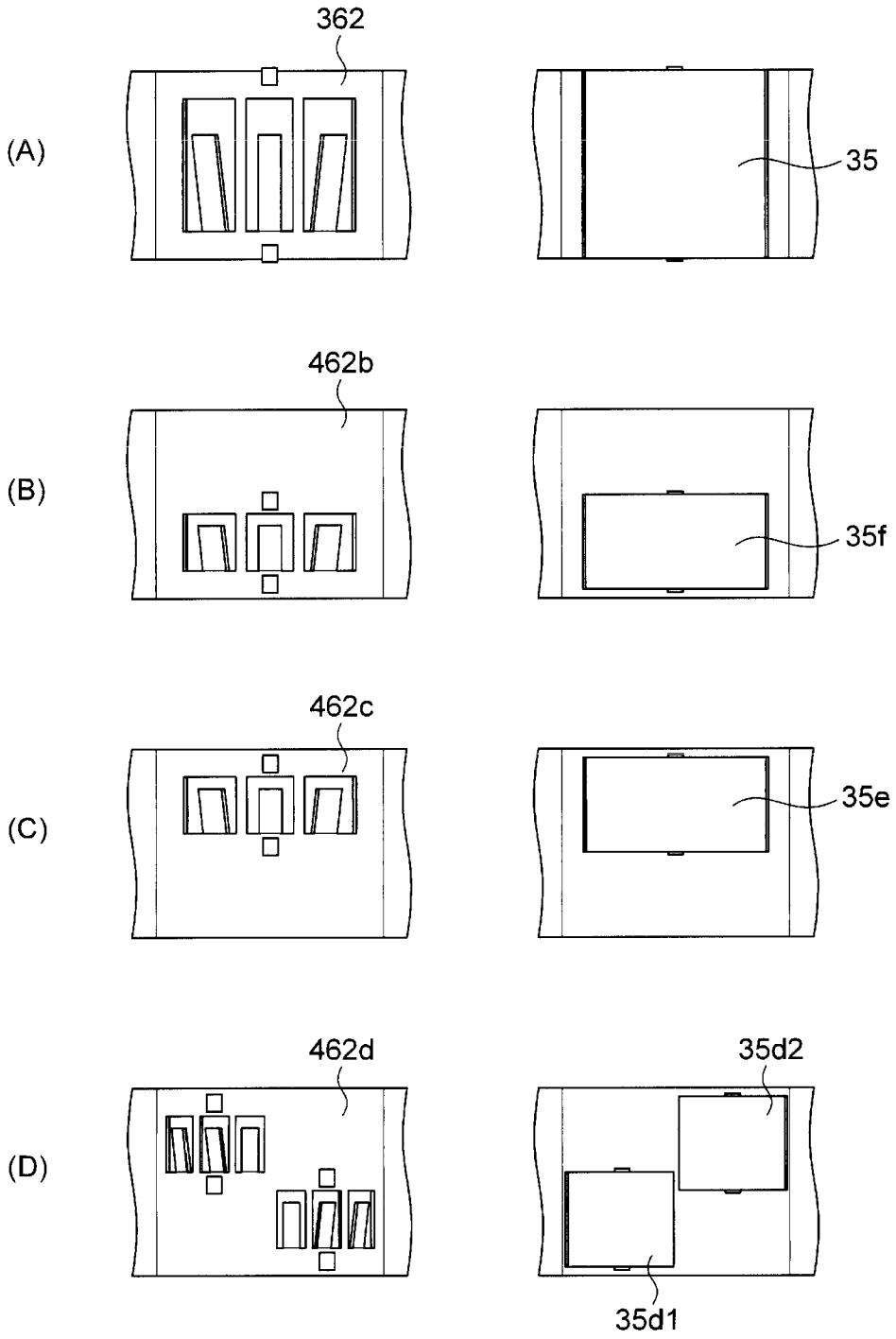
FIG. 33 is a schematic perspective view illustrating a form example of a thermal insulator for a cylinder bore wall of the present invention.

In the form example illustrated in FIG. 5, the form example illustrated in FIG. 31, and the form example illustrated in FIG. 32, the bore wall insulating section is not fixed to the inner side of the supporting section bore portion at a position to which the coolant is to be supplied, but the present invention is not limited to this form. In the thermal insulator for the cylinder bore wall of the first form of the present invention, the bore wall insulating section may be fixed to the inner side of the supporting section bore portion at a position to which the coolant is to be supplied. Alternatively, the bore wall insulating section need not be fixed to the inner side of the supporting section bore portion at a position to which the coolant is to be supplied. Alternatively, a rubber member for insulating or the like not corresponding to the bore wall insulating section according to the thermal insulator for the cylinder bore wall of the first form of the present invention may be set in the supporting section bore portion.

The bore wall insulating section includes the rubber member, the rear surface pressing member, and the elastic members.

The rubber member is a member that is direct in contact with the wall surface on the cylinder bore side of the groove-like coolant passage, covers the wall surface on the cylinder bore side of the groove-like coolant passage, and insulates the cylinder bore wall. The rubber member is pressed against the wall surface on the cylinder bore side of the groove-like coolant passage by the rear surface pressing member with an urging force of the elastic member. Therefore, the rubber member is formed into a shape conforming to the wall surface on the cylinder bore side of the groove-like coolant passage, that is, an arcuate shape when viewed from above. The shape of the rubber member viewed from a side is selected as appropriate according to a portion of the wall surface on the cylinder bore side of the groove-like coolant passage to be covered by the rubber member.

Examples of the material of the rubber member include a rubber such as a solid rubber, an expanding rubber, a foamed rubber, and a soft rubber and a silicone-based gelatinous material. A heat-sensitive expanding rubber or a water-swelling rubber that can expand a rubber member portion in the groove-like coolant passage after setting of the thermal insulator for the cylinder bore wall is desirable in that the rubber member can strongly come into contact with the cylinder bore wall to be prevented from being shaved when the thermal insulator for the cylinder bore wall is set in the groove-like coolant passage.

Examples of a composition of the solid rubber include a natural rubber, a butadiene rubber, an ethylene propylene diene rubber (EPDM), a nitrile butadiene rubber (NBR), a silicone rubber, and a fluorocarbon rubber.

Examples of the expanding rubber include a heat-sensitive expanding rubber. The heat-sensitive expanding rubber is a composite body obtained by impregnating a base foam material with a thermoplastic substance having a melting point lower than that of the base foam material, and compressing the resulting product. The heat-sensitive expanding rubber is a material, a compressed state of which is maintained by a cured product of the thermoplastic substance present at least in a surface layer part thereof at the normal temperature and is released when the cured product of the thermoplastic substance is softened by heating. Examples of the heat-sensitive expanding rubber include a heat-sensitive expanding rubber disclosed in Japanese Patent Laid-Open No. 2004-143262. When the material of the rubber member is the heat-sensitive expanding rubber, the heat-sensitive expanding rubber expands to be deformed into a predetermined shape when the thermal insulator for the cylinder bore wall of the present invention is set in the groove-like coolant passage and heat is applied to the heat-sensitive expanding rubber.

Examples of the base foam material related to the heat-sensitive expanding rubber include various polymeric materials such as a rubber, an elastomer, a thermoplastic resin, and a thermosetting resin. Specifically, examples of the base foam material include a natural rubber, various synthetic rubbers such as a chloropropylene rubber, a styrene butadiene rubber, a nitrile butadiene rubber, an ethylene propylene diene terpolymer, a silicone rubber, a fluorocarbon rubber, and an acrylic rubber, various elastomers such as soft urethane, and various thermosetting resins such as rigid urethane, a phenolic resin, and a melamine resin.

As the thermoplastic substance related to the heat-sensitive expanding rubber, a thermoplastic substance, any one of a glass transition point, a melting point, and a softening temperature of which is lower than 120° C., is desirable. Examples of the thermoplastic substance related to the heat-sensitive expanding rubber include a thermoplastic resin such as polyethylene, polypropylene, polystyrene, polyvinyl chloride, polyvinylidene chloride, polyvinyl acetate, polyacrylic ester, a styrene butadiene copolymer, chlorinated polyethylene, polyvinylidene fluoride, an ethylene-vinyl acetate copolymer, an ethylene vinyl acetate vinyl chloride acrylate ester copolymer, an ethylene-vinyl acetate acrylate ester copolymer, an ethylene-vinyl acetate vinyl chloride copolymer, nylon, an acrylonitrile-butadiene copolymer, polyacrylonitrile, polyvinyl chloride, polychloroprene, polybutadiene, a thermoplastic polyimide, polyacetal, polyphenylene sulfide, polycarbonate, and thermoplastic polyurethane and various thermoplastic compounds such as a low-melting point glass frit, starch, a solder, and a wax.

Examples of the expanding rubber include a water-swelling rubber. The water swelling rubber is a material obtained by adding a water-absorbing substance to a rubber and is a rubber material that swells by absorbing water and has firmness for retaining an expanded shape. Examples of the water-swelling rubber include rubber materials obtained by adding water-absorbing materials such as a crosslinking substance of a polyacrylic acid neutralized product, a starch acrylic acid graft copolymer cross linking substance, a cross-linked carboxymethyl cellulose salt, and polyvinyl alcohol to a rubber. Examples of the water-swelling rubber include a water-swelling rubber containing a ketiminated polyamide resin, glycidyl ethers, a water-absorbing resin, and a rubber disclosed in Japanese Patent Laid-Open No. 9-208752. When the material of the rubber member is the water-swelling rubber, the water-swelling rubber expands to be deformed into a predetermined shape when the thermal insulator for the cylinder bore wall of the present invention is set in the groove-like coolant passage and the coolant is supplied to the groove-like coolant passage and the water-swelling rubber absorbs the water.

The foamed rubber is a porous rubber. Examples of the foamed rubber include a sponge-like foamed rubber having a continuous cell structure, a foamed rubber having a closed cell structure, and a foamed rubber having a semi-closed cell structure. Specifically, examples of the material of the foamed rubber include an ethylene propylene diene terpolymer, a silicone rubber, a nitrile butadiene copolymer, a silicone rubber, and a fluorocarbon rubber. An expansion ratio of the foamed rubber is not limited to a particular value and is selected as appropriate. The water content of the rubber member can be adjusted by adjusting the expansion ratio. Note that the expansion ratio of the foamed rubber indicates a density ratio before and after foaming represented by ((density before foaming−density after foaming)/density before foaming)×100.

When the material of the rubber member is a material that can absorbs water such as the water-swelling rubber or the foamed rubber, the rubber member absorbs water when the thermal insulator for the cylinder bore wall of the present invention is set in the groove-like coolant passage and the coolant is supplied to the groove-like coolant passage. In which range the water content of the rubber member is set when the coolant is supplied to the groove-like coolant passage is selected as appropriate according to operation conditions and the like of the internal combustion engine. Note that the water content indicates a weight water content represented by (coolant weight/(filler weight+coolant weight))×100.

Figure 35:
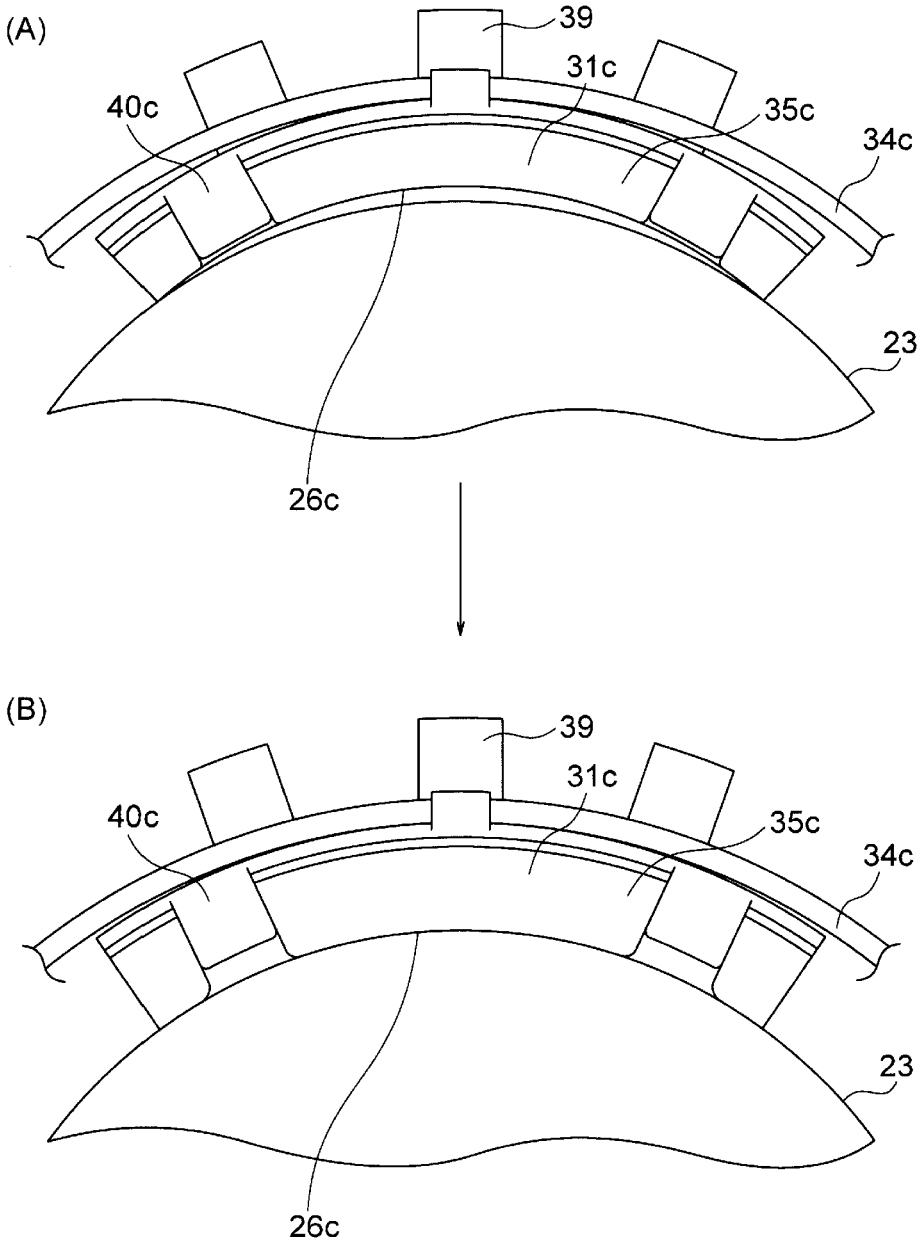
FIG. 35 is a view illustrating a state of expansion of a rubber member and deformation of the bore wall thermal insulator in the case in which an expanding rubber is used as the rubber member.

When the expanding rubber is used as the material of the rubber member, as illustrated in FIG. 35, it is desirable to design the position of the surface 26*c* of the rubber member 31*c* after the expansion such that the rubber member 31*c* expands further to the bore wall side (closer to the wall surface on the cylinder bore side of the groove-like coolant passage) than the bending sections 40*c* compared with before the expansion. In the form example illustrated in FIG. 35, before the rubber member 31*c* is urged by the elastic members 39 in the groove-like coolant passage and before the rubber member 31*c* expands (FIG. 35(A)), a curvature of the contact surface of the rubber member 31*c* is larger than a curvature of the bore wall 23 of the cylinder bore with which the rubber member is in contact. Therefore, there is a gap between the rubber member 31*c* and the bore wall 23. When the rubber member 31*c* is urged by the elastic members to expand from that state (FIG. 35(B)), the rubber member 31*c* expands such that the position of the surface 26*c* of the rubber member 31*c* is further on the bore wall side than the bending sections 40*c*. The portion in the center or the vicinity of the center of the bore wall insulating section 35*c* in the arc direction is pushed by the elastic members 39 from the rear surface side, whereby portions other than the center or the vicinity of the center in the arc direction of the bore wall insulating section 35 are deformed independently from the supporting section 34*c* such that portions on both end sides in the arc direction of the bore wall insulating section 35 open to the outside. In the thermal insulator for the cylinder bore wall of the first form of the present invention, when the curvature of the contact surface of the rubber member of the bore wall insulating section is larger than the curvature of the bore wall of the cylinder bore in contact with the rubber member, the portion in the center or the vicinity of the center in the arc direction of the bore wall insulating section is pushed by the elastic members from the rear surface side and the portions other than the center or the vicinity of the center in the arc direction of the bore wall insulating section are deformed independently from the supporting section such that the portions on both end sides in the arc direction of the bore wall insulating section open to the outside. This occurs irrespective of whether the rubber member is the expanding rubber or the rubber member is rubber that does not expand. Note that, when the rubber member of the bore wall insulating section is the expanding rubber, as the bore wall insulating section, there is also a form in which, after the thermal insulator for the cylinder bore wall of the first form of the present invention is set in the groove-like coolant passage, the expanding rubber comes into contact with the coolant or is heated to expand and comes into contact with the wall surface on the cylinder bore side of the groove-like coolant passage.

The thickness of the rubber member is not limited to a particular value and is selected as appropriate.

The rear surface pressing member is formed in an arcuate shape when viewed from above. The rear surface pressing member has a shape conforming to the rear surface side (a surface on the opposite side of the contact surface side) of the rubber member and a shape covering the entire rear surface side or substantially the entire rear surface side of the rubber member such that the rear surface pressing member can press the entire rubber member from the rear surface side of the rubber member. The material of the rear surface pressing member only has to be a material with which the rear surface pressing member can be deformed such that the rear surface pressing member can press the rubber member toward the wall surface on the cylinder bore side of the groove-like coolant passage when being pressed by the elastic members from the rear surface side. The material is selected as appropriate. However, a metal plate of stainless steel, an aluminum alloy, or the like is desirable. The thickness of the rear surface pressing member only has to be thickness with which the rear surface pressing member can be deformed such that the rear surface pressing member can press the rubber member toward the wall surface on the cylinder bore side of the groove-like coolant passage when being pressed by the elastic members from the rear surface side. The thickness of the rear surface pressing member is selected as appropriate.

The elastic members are attached to the rear surface side of the bore wall insulating section. The elastic members are members elastically deformed when the thermal insulator for the cylinder bore wall of the present invention is set in the groove-like coolant passage and for urging the rear surface pressing member with an elastic force to press the rubber member toward the wall surface on the cylinder bore side of the groove-like coolant passage.

Two or more elastic members are attached in the arc direction of the bore wall insulating section when the bore wall insulating section is viewed from above. When the elastic member is set in one place, in order to press the entire thermal insulator, the elastic member is attached to the center or the vicinity of the center in the arc direction of the bore wall insulating section. However, since the center or the vicinity of the center of the bore wall insulating section is fixed to the supporting section, the bore wall insulating section is pressed together with the supporting section. Therefore, the portions at the ends of the bore wall insulating section do not separate from the supporting section to be deformed independently from the supporting section. The rubber member is not pressed toward the wall surface on the cylinder bore side of the groove-like coolant passage. Therefore, the elastic members need to be attached to at least in two places in total, that is, one place close to one end side and one place close to the other end of the bore wall insulating section such that the portions at both of the ends of the bore wall insulating section separate from the supporting section to be deformed independently from the supporting section and press the rubber member toward the wall surface on the cylinder bore side of the groove-like coolant passage. The elastic members are desirably attached to three places in total, that is, one place in the center or the vicinity of the center in the arc direction of the bore wall insulating section, one place close to one end side of the bore wall insulating section, and one place close to the other end such that the entire bore wall insulating section is pressed and the portions at both the ends of the bore wall insulating section are pressed independently from the supporting section. Further, the elastic members may be attached to four or more places in the arc direction in order to improve adhesion of the rubber member of the bore wall insulating section to the wall surface on the cylinder bore side of the groove-like coolant passage.

A form of the elastic member is not limited to a particular form. Examples of the form of the elastic member include a tabular elastic member, a coil-like elastic member, a leaf spring, a torsion spring, and an elastic rubber. The material of the elastic member is not limited to a particular material. However, stainless steel (SUS), an aluminum alloy, or the like is desirable because LLC resistance is high and strength is high. As the elastic member, a metal elastic member such as a metal leaf spring, a coil spring, a leaf spring, or a torsion spring is desirable.

Figure 30:
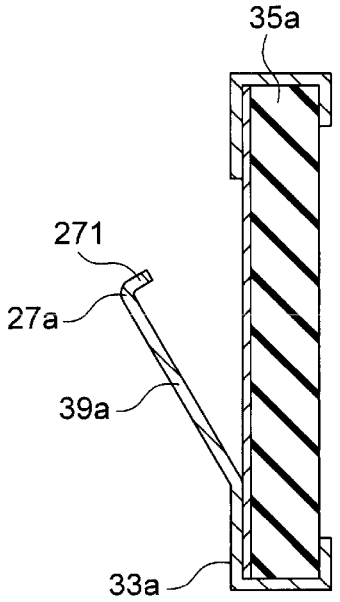
FIG. 30 is a schematic view illustrating a form example of the bore wall insulating section.
Figure 30:
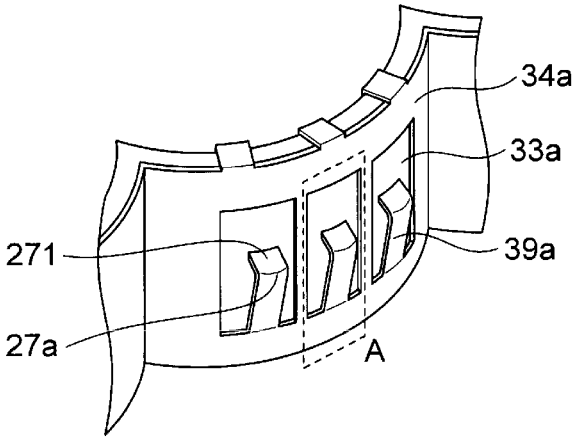
Figure 30:
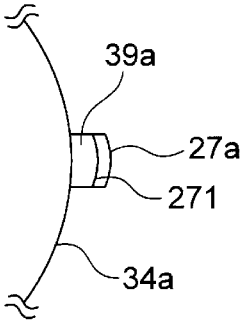

As the elastic member, it is desirable that a portion in contact with the wall surface on the opposite side of the wall surface on the cylinder bore side of the groove-like coolant passage and the vicinity of the portion are formed into a curved surface shape swelling to the wall surface on the opposite side of the wall surface on the cylinder bore side of the groove-like coolant passage because it is possible to prevent the wall surface on the opposite side of the wall surface on the cylinder bore side of the groove-like coolant passage from being damaged by a contact portion with the wall surface of the elastic member when the thermal insulator for the cylinder bore wall of the present invention is inserted into the groove-like coolant passage. Examples of such a form example include a form example illustrated in FIG. 30. In FIG. 30, metal-leaf-spring attaching members 33*a*, to which respective metal leaf springs 39*a* are attached, are provided on the rear surface side of the bore wall thermal insulating section 35*a*. As illustrated in FIG. 30(A), a distal end portion 27*a* of the metal leaf spring 39*a* is formed by bending a folding-back section 271 to the bore wall thermal insulating section 35*a* side. As illustrated in FIGS. 30(B) and (C), the distal end portion 27*a* is formed in a curved surface shape swelling with respect to a wall surface in contact with the distal end portion 27*a* (a wall surface on the opposite side of the wall surface on the cylinder bore side of the groove-like coolant passage). That is, in the form example illustrated in FIG. 30, in the metal leaf spring, which is the elastic member, a distal end portion in contact with the wall surface on the opposite side of the wall surface on the cylinder bore side of the groove-like coolant passage is formed in a curved surface shape swelling with respect to the wall surface on the opposite side of the wall surface on the cylinder bore side of the groove-like coolant passage. Note that FIG. 30(A) is an end face view of the bore wall insulating section 35*a* and is an end face view of the bore wall insulating section 35*a* perpendicularly cut in the center in the arc direction. FIG. 30(B) is a view of the supporting section bore portion, to which the bore wall insulating section 35*a* is fixed, as viewed from obliquely above on the rear surface side. FIG. 30(C) is a view of a portion A, which is surrounded by a dotted line in FIG. 30(B), as viewed from above.

In the thermal insulator for the cylinder bore wall of the first form of the present invention, a form, a shape, a size, a setting position, a setting number, and the like of the elastic members are selected as appropriate according to the shape and the like of the groove-like coolant passage such that the rubber member is urged by an appropriate pressing force by the elastic members when the thermal insulator is set in the groove-like coolant passage.

Figure 34:
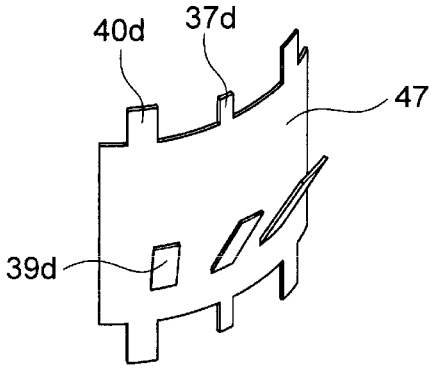
FIG. 34 is a schematic view illustrating a form example of a rear surface pressing member.

In the thermal insulator 36*a* for the cylinder bore wall illustrated in FIG. 5, the metal-leaf-spring attaching member and the metal leaf spring, which is the elastic member, are integrally formed and the rubber member and the rear surface pressing member are fixed to the metal-leaf-spring attaching member in which the metal leaf spring is formed, whereby the elastic member is attached to the bore wall insulating section. However, a method of attaching the elastic member to the bore wall insulating section is not limited to a particular method. Examples of other methods include a method of welding a metal elastic member such as a metal leaf spring, a metal coil spring, a leaf spring, or a torsion spring to the rear surface pressing member made of a metal plate to fix the rubber member to the rear surface pressing member to which the elastic member is welded. In a form example illustrated in FIG. 34, metal leaf springs 39*d* made of longitudinally long rectangular metal plates are welded to the rear surface pressing member 47 in which bending sections 40*d* made of a metal plate and for fixing rubber member to upper and lower parts and bending sections 37*d* for fixing the thermal insulator to the supporting section are formed.

Figure 28:
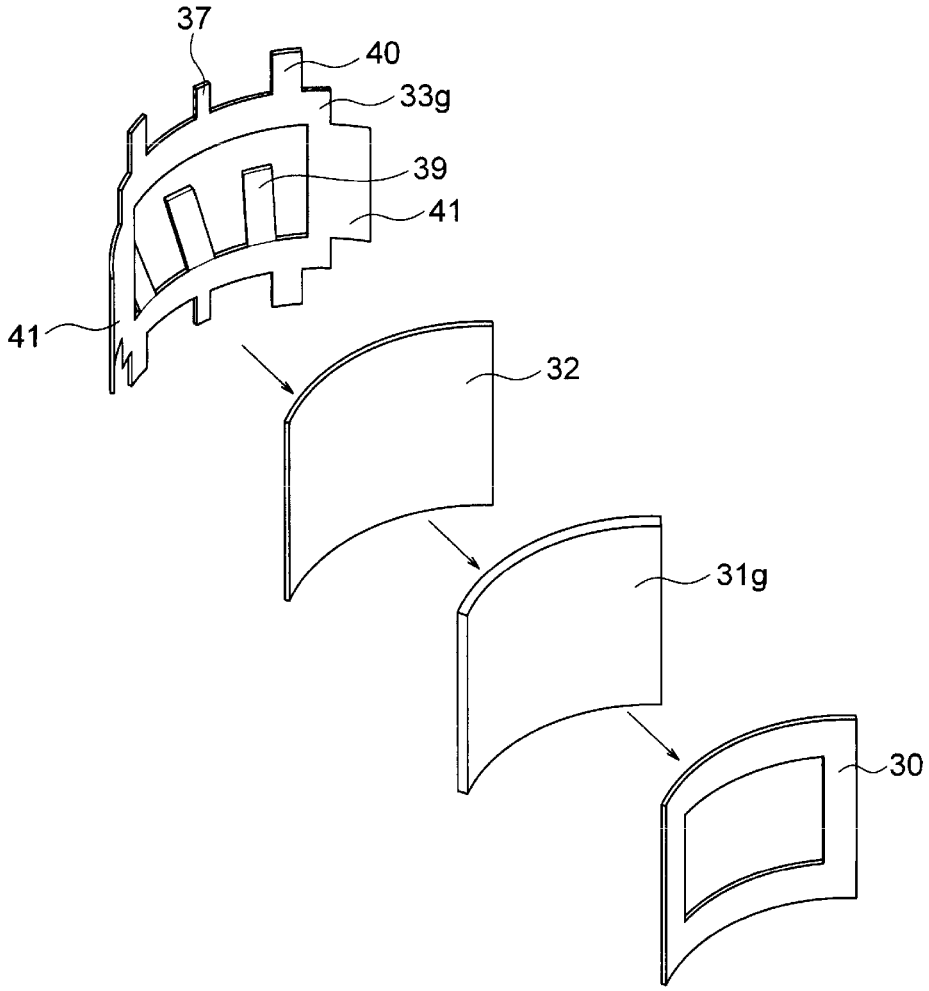
FIG. 28 is a schematic perspective view illustrating a state in which a form example of a bore wall insulating section is manufactured.
Figure 29:
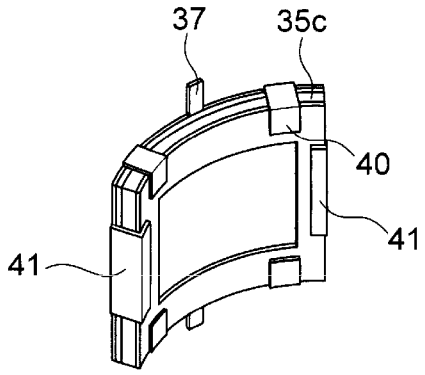
FIG. 29 is a schematic perspective view illustrating a form example of the bore wall insulating section illustrated in FIG. 28.

Examples of a form example of the bore wall insulating sections include form examples illustrated in FIG. 28 and FIG. 29. As illustrated in FIG. 28, the rear surface pressing member 32 and a metal-leaf-spring attaching member 33*g*, to which the metal leaf springs 39 are attached and in which the bending sections 40, the bending sections 41, and the bending sections 37 are formed, are joined to a rubber member 31*g*, which is an expanding rubber, in this order and a hollow square-shaped backing plate 30 formed of a hollow square-shaped metal thin plate is further joined to the contact surface side of the rubber member 31*g*. Subsequently, the bending sections 40 and the bending sections 41 are bent. As illustrated in FIG. 29, the rear surface pressing member 32, the rubber member 31*g*, and the hollow square-shaped backing plate 30 are held by the bending sections 40 and the bending sections 41, whereby the rear surface pressing member 32, the rubber member 31*g*, and the hollow square-shaped backing plate 30 are fixed to the metal-leaf-spring attaching member 33*g* to manufacture a bore wall insulating section 35*d*. That is, examples of the bore wall insulating section include a bore wall insulating section including the rubber member, which is the expanding rubber, the rear surface pressing member, the elastic members, and the hollow square-shaped backing plate disposed on the contact surface side of the rubber member and formed of the hollow square-shaped metal plate. The hollow square-shaped backing plate has a hollow square shape when viewed from the contact surface side. Therefore, the hollow square-shaped backing plate is in contact with ends on four sides of the surface of the rubber member. In other words, the hollow square-shaped backing plate includes a rectangular opening on the inner side. When the rubber member, which is the expanding rubber, expands, the expanding rubber projects further to the outside than the backing plate from the portion of this opening. The surface of the projecting portion is formed as the contact surface of the rubber member. In the bore wall insulating section including the hollow square-shaped backing plate, the bending sections for fixing the rubber member do not come into direct contact with the rubber member. The hollow square-shaped backing plate having an extremely large contact area compared with the bending sections comes into contact with the rubber member. Therefore, it is possible to prevent the rubber member from being easily torn when the bending sections having a small contact area with the rubber member bite into the rubber member.

In the thermal insulator for the cylinder bore wall of the first form of the present invention, the bore wall insulating sections are fixed to the supporting section such that the contact surface of the rubber member faces the wall surface on the cylinder bore side of the groove-like coolant passage and the contact surface of the rubber member can come into contact with the wall surface on the cylinder bore side of the groove-like coolant passage. On the rear surface side of the thermal insulator for the cylinder bore wall of the first form of the present invention, the elastic members attached to the bore wall insulating sections project toward the opposite side of the rubber member through openings of the supporting section such that the elastic members can come into contact with the wall surface on the opposite side of the wall surface on the cylinder bore side of the groove-like coolant passage.

The number of bore wall insulating sections fixed to the supporting section is selected as appropriate according to the number and insulating parts of bore walls of the cylinder bores about to be insulated by the bore wall insulating sections.

The supporting section is a member to which the bore wall insulating sections are fixed such that the positions of the bore wall insulating sections in the groove-like coolant passage do not deviate. Therefore, the supporting section has a shape conforming to the groove-like coolant passage in the setting position of the thermal insulator for the cylinder bore wall of the present invention. When viewed from above, the supporting section is formed into a shape surrounding all the cylinder bores or a shape of a continuous plurality of arcs. The supporting section is made of a synthetic resin, metal or the like. The supporting section is desirably made of a synthetic resin. Usually, the supporting section is manufactured by being integrally formed together with a member attached to the supporting section such as the coolant flow partitioning member by injection molding of the synthetic resin. The material of the supporting section is not limited to a particular material if the material has heat resistance and LLC resistance. The material only has to be a synthetic resin, a metal material or the like used in a thermal insulator for a bore wall of a cylinder bore and a water jacket spacer.

In the supporting section, the opening sections, through which the elastic members attached to the bore wall insulating sections present further on the wall surface side on the cylinder bore side of the groove-like coolant passage than the supporting section pass, are formed such that the elastic members can come into contact with the wall surface on the opposite side of the wall surface on the cylinder bore side of the groove-like coolant passage.

The thermal insulator for the cylinder bore wall of the first form of the present invention may be a thermal insulator in which the bore wall insulating sections are set in all of the supporting section bore portions or may be a thermal insulator in which the bore wall insulating sections are set in a part of all the supporting section bore portions. Examples of a form of the thermal insulator for the cylinder bore wall of the present invention in which the bore wall insulating sections are set in a part of all the supporting section bore portions include a thermal insulator in which the shape of the supporting section is a shape surrounding the bore walls of all the cylinder bores and the bore wall insulating sections are set in a part of all the supporting section bore portions, for example, a thermal insulator 36*c* for a cylinder bore wall illustrated in FIG. 31, and a thermal insulator in which the shape of the supporting section is a shape corresponding to a one-side half among the bore walls of all the cylinder bores and the bore wall insulating sections are set in a part of all the supporting section bore portions, for example, a thermal insulator 36*a* for a cylinder bore wall illustrated in FIG. 5. Examples of a form of the thermal insulator for the cylinder bore wall of the present invention in which the bore wall insulating sections are set in all of all the supporting section bore portions include a thermal insulator in which the shape of the supporting section is a shape surrounding the bore walls of all the cylinder bores and the bore wall insulating sections are set in all of all the supporting section bore portions, for example, a thermal insulator 36*c* for a cylinder bore wall illustrated in FIG. 32.

In the thermal insulator for the cylinder bore wall of the present invention (the thermal insulator for the cylinder bore wall of the first form of the present invention and a thermal insulator for a cylinder bore wall of a second form of the present invention which is described later), only the center or the vicinity of the center in the arc direction, when viewed from above, of the bore wall insulating section is fixed to the supporting section. Therefore, in the thermal insulator for the cylinder bore wall of the present invention, portions other than the center or the vicinity of the center in the arc direction in the bore wall insulating section are not fixed to the supporting section. Therefore, when being pushed by the elastic members from the rear surface side, the portions other than the center or the vicinity of the center in the arc direction of the bore wall insulating section can be deformed to separate from the supporting section and move toward the wall surface on the cylinder bore side of the groove-like coolant passage. Alternatively, when the portion in the center or the vicinity of the center in the arc direction of the bore wall insulating section is pushed by the elastic members from the rear surface side, the portions other than the center or the vicinity of the center in the arc direction of the bore wall insulating section can be deformed independently from the supporting section such that the portions on both end sides in the arc direction of the bore wall insulating section open to the outside.

Consequently, in the thermal insulator for the cylinder bore wall of the present invention (the thermal insulator for the cylinder bore wall of the first form of the present invention and a thermal insulator for a cylinder bore wall of a second form of the present invention which is described later), in manufacturing of the thermal insulator for the cylinder bore wall or manufacturing of the cylinder block, even if the curvature of the contact surface of the rubber member of the bore wall insulating section is smaller than the curvature of the bore wall of the cylinder bore with which the rubber member is in contact, because of the machining error, the portions other than the center or the vicinity of the center in the arc direction of the bore wall insulating section are pushed by the elastic members from the rear surface side to be deformed to separate from the supporting section and move toward the wall surface on the cylinder bore side of the groove-like coolant passage and the rubber member can adhere to the wall surface on the cylinder bore side of the groove-like coolant passage. Therefore, adhesion of the rubber member to the wall surface on the cylinder bore side of the groove-like coolant passage is improved. Alternatively, even if the curvature of the contact surface of the rubber member of the bore wall insulating section is larger than the curvature of the bore wall of the cylinder bore with which the rubber member is in contact, because of the machining error, the portions on both end sides in the arc direction of the bore wall insulating section are deformed to open to the outside and the rubber member can adhere to the wall surface on the cylinder bore side of the groove-like coolant passage. Therefore, adhesion of the rubber member to the wall surface on the cylinder bore side of the groove-like coolant passage is improved.

In particular, when an expanding rubber such as a heat-sensitive expanding rubber or a water-swelling rubber is used as the rubber member of the thermal insulator for the cylinder bore wall of the present invention (the thermal insulator for the cylinder bore wall of the first form of the present invention and a thermal insulator for a cylinder bore wall of a second form of the present invention which is described later), even if machining of the contact surface of the rubber member before expansion is accurately performed, because of unevenness of an expansion amount at the time when the rubber member is expanded, the shape of the contact surface of the rubber member after the expansion sometimes deviates from the surface shape of the wall surface on the cylinder bore side of the groove-like coolant passage to which the contact surface adheres. Even in such a case, in the thermal insulator for the cylinder bore wall of the present invention, by being pushed by the elastic members from the rear surface side, the portions other than the center or the vicinity of the center in the arc direction of the bore wall insulating section are deformed to separate from the supporting section and move toward the wall surface on the cylinder bore side of the groove-like coolant passage or the portions on both end sides in the arc direction of the bore wall insulating section are deformed to open to the outside and the rubber member can adhere to the wall surface on the cylinder bore side of the groove-like coolant passage. Therefore, adhesion of the rubber member to the wall surface on the cylinder bore side of the groove-like coolant passage is improved.

Note that, in FIG. 22, for description of the effects of the present invention, a figure (FIG. 22(A)) is used in which, in the entire both end sides of the insulating section, a large gap is formed between the contact surfaces on both end sides of the rubber member and the bore walls. However, actually, such a large machining error does not occur. However, actually, a small gap is formed or the contact surface of the rubber member and the bore wall are partially separated because of a machining error.

In the thermal insulator for the cylinder bore wall of the first form of the present invention, a range in which the bore wall insulating section is fixed to the supporting section, specifically, the length of the fixing portion in the arc direction when viewed from above and the length of the fixing portion in the up-down direction when viewed from a side are selected as appropriate in a range in which the effects of the present invention are achieved. For example, as in the form example illustrated in FIG. 5, the bore wall insulating section can be fixed to the supporting section only by the vicinity of the center in the arc direction of the bore wall insulating section when viewed from above and the upper end side and the lower end side of the bore wall insulating section when viewed from a side.

The supporting section bore portions include a supporting section bore portion in which the inclined wall is formed on the rear surface side thereof and a supporting section bore portion in which the inclined wall is not formed on the rear surface side thereof.

The supporting section bore portion in which the inclined wall is formed on the rear surface side thereof is a supporting section bore portion at a position where the coolant is supplied into the groove-like coolant passage. Examples of the thermal insulator for the cylinder bore wall of the present invention include a thermal insulator in a form in which not only an inclined wall but also a coolant contact surface and a coolant flow suppressing wall are formed in the supporting section bore portion at the position to which the coolant is supplied (hereinafter, also referred to as a thermal insulator for a cylinder bore wall of a first (A) form of the present invention), and a thermal insulator in a form in which an inclined wall is formed on the supporting section bore portion at a position to which the coolant is supplied but the coolant contact surface and the coolant flow suppressing wall are not formed thereon (hereinafter, also referred to as a thermal insulator for a cylinder bore wall of a first (B) form of the present invention).

The thermal insulator for the cylinder bore wall of the first (A) form of the present invention is a thermal insulator for a cylinder bore wall set in a cylinder block, in which the inclination of the rear surface of the supporting section with respect to the direction in which the coolant flows into the groove-like coolant passage is relatively large at a position where the coolant that has flowed into the groove-like coolant passage from the coolant supply port strikes on the supporting section. In the cylinder block in which the thermal insulator for the cylinder bore wall of the first (A) form of the present invention, the coolant flowing into the groove-like coolant passage from the coolant supply port strongly strikes on the coolant contact surface on the rear surface side of the supporting section, and then flows in the opposite direction of the direction in the coolant flow suppressing wall is formed, due to the presence of the coolant flow suppressing wall.

In the thermal insulator for the cylinder bore wall of the first (A) form of the present invention, the coolant contact surface is formed at a position on which the coolant supplied from the coolant supply port firstly strikes, in the supporting section bore portion in which the inclined wall is formed on the rear surface side thereof, and the coolant flow suppressing wall is formed to surround a portion of the coolant contact surface on the opposite side of the side toward which the coolant flows.

The coolant contact surface related to the thermal insulator for the cylinder bore wall of the first (A) form of the present invention is a surface on which the coolant supplied from outside of the cylinder block firstly strikes. In the form example illustrated in FIG. 1, the coolant supply port 15 is provided at a position illustrated in FIG. 1. However, the position of the coolant supply port varies depending on the type of internal combustion engine. Therefore, a position at which the coolant contact surface is formed is selected as appropriate according to the formation position of the coolant supply port of the cylinder block in which the thermal insulator for the cylinder bore wall of the present invention is set.

Figure 46:
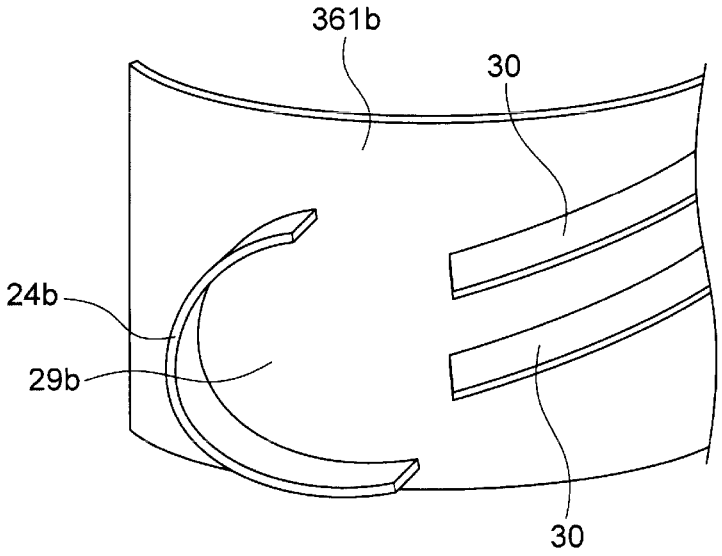
FIG. 46 is a schematic view illustrating a form example of a coolant flow suppressing wall.
Figure 47:
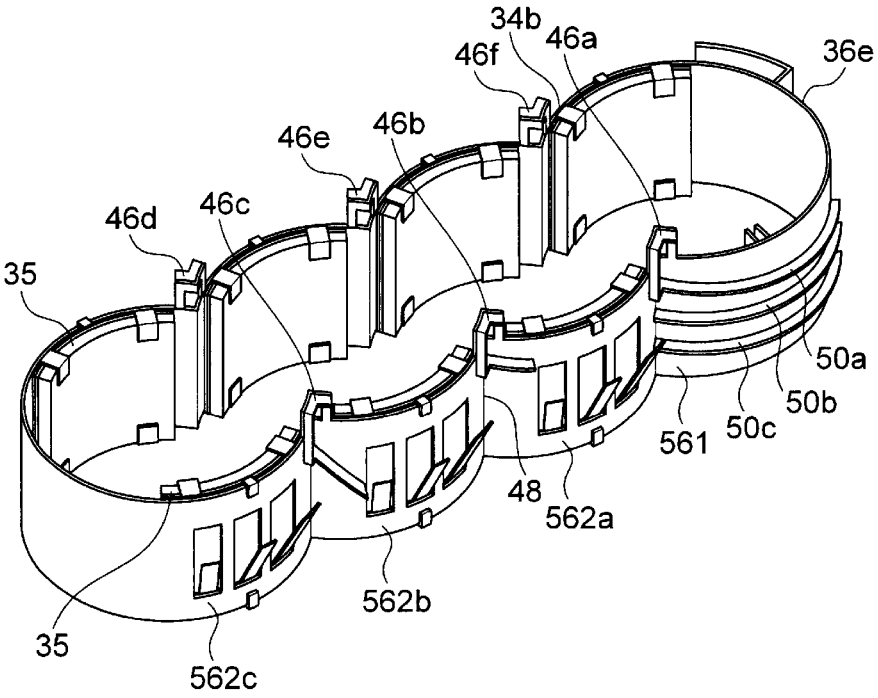
FIG. 47 is a schematic perspective view illustrating a form example of the thermal insulator for the cylinder bore wall of the present invention.
Figure 48:
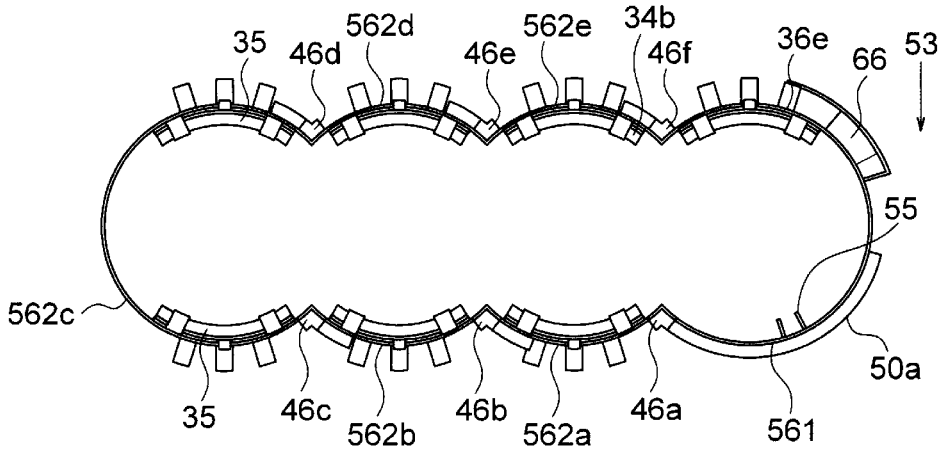
FIG. 48 is a top plan view of a thermal insulator 36*e* for the cylinder bore wall illustrated in FIG. 47.
Figure 49:
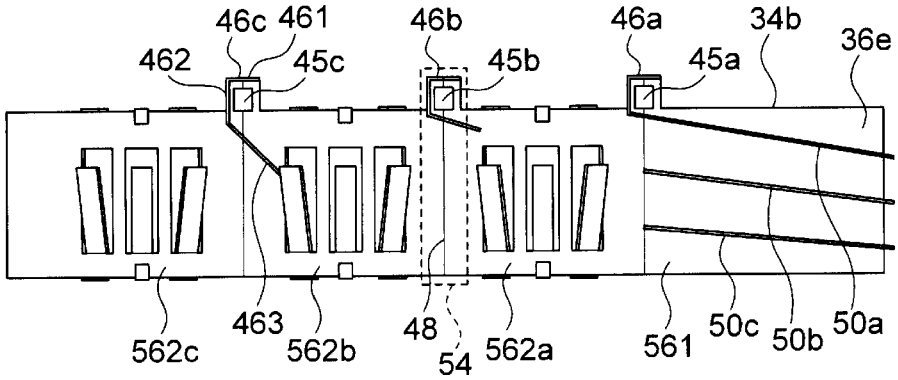
FIG. 49 is a side view illustrating a side on which an inclined wall of a water jacket spacer illustrated in FIG. 47 is formed, as viewed from a rear surface side.
Figure 50:
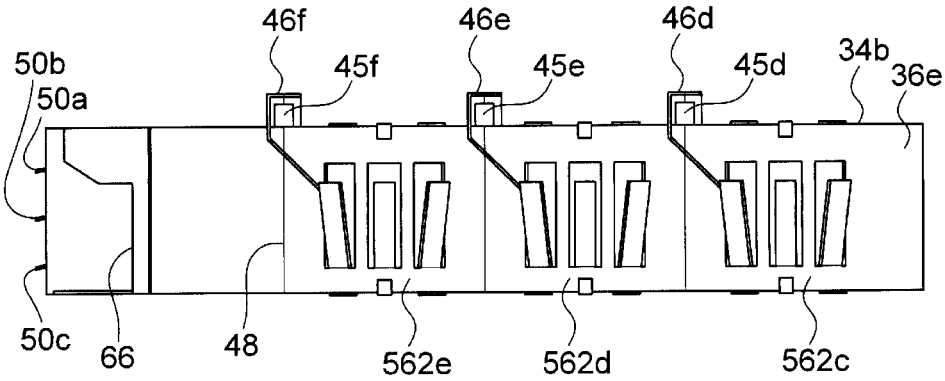
FIG. 50 is a side view illustrating a side on which an inclined wall of a water jacket spacer illustrated in FIG. 47 is not formed, as viewed from a rear surface side.

The coolant flow suppressing wall related to the thermal insulator for the cylinder bore wall of the first (A) form of the present invention is a wall which is provided such that the coolant which has struck on the coolant contact surface flows toward the inclined wall without flowing in the opposite direction of the coolant flow direction. Therefore, the coolant flow suppressing wall is formed to surround a portion on the opposite side of the coolant flow direction in the coolant contact surface. That is, the wall is formed at the upper side, the lateral side, and the lower side of the portion of the coolant contact surface on the opposite side of the side toward which the coolant flows. In the form example illustrated in FIG. 5, a lateral side portion 241 of the coolant flow suppressing wall is formed on the entire lateral side on the opposite side of the side toward which the coolant flows, of the coolant contact surface, a lower side portion 242 of the coolant flow suppressing wall is formed on the entire lower side of the coolant contact surface, and an upper side portion 243 of the coolant flow suppressing wall is formed on an approximately half portion of the upper side of the coolant contact surface. However, the present invention is not limited to this form. A range surrounded by the coolant flow suppressing wall on the opposite side of the side toward which the coolant flows, of the coolant contact surface is selected as appropriate in a range in which the effects of the present invention are achieved. In the form example illustrated in FIG. 5, all of wall portions of the coolant flow suppressing wall are linear in a shape when viewed from a side, but the shape of the wall portion is not limited to this shape. For example, in the form example illustrated in FIG. 46, a curved coolant flow suppressing wall 24*b* which is formed in a substantially C shape when viewed from a side is formed on the opposite side of the side toward which the coolant flows, of a coolant contact surface 29*b*.

The coolant flow suppressing wall is a portion for preventing the coolant supplied into the groove-like coolant passage from immediately flowing to the coolant discharge port present in the vicinity of the coolant supply port.

In the thermal insulator for the cylinder bore wall of the first (A) form of the present invention, the inclined wall is a wall for creating the flow of the coolant from the coolant contact surface toward a coolant passage opening such that the coolant flowing in the coolant flow direction flows toward the coolant passage opening after striking on the coolant contact surface. Therefore, the inclined wall extends with an upward inclination from the vicinity of the coolant contact surface as a start point. The number of inclined walls is selected as appropriate according to the number of coolant passage opening formed in the supporting section. An inclination angle of the inclined wall is selected as appropriate by the position of the coolant passage opening formed in the supporting section. The end point of the inclined wall is selected as appropriate in a range in which the effects of the present invention are achieved. In the form example illustrated in FIG. 5, the inclined walls 30*a* and 30*b* extend to the vicinity of the inter-bore portion, and the inclined wall 30*a* is connected to the lower end of the guide wall 26*a*. The inclined wall may or need not be connected to the guide wall. Note that in the present invention, the upward inclination means that when the coolant advances in the flow direction, the position becomes correspondingly high.

A thermal insulator for a cylinder bore wall of the first (B) form of the present invention is a thermal insulator for a cylinder bore wall set in a cylinder block in which a part of the coolant supplied from the coolant supply port strikes on the supporting section, in which the inclination of the rear surface side of the supporting section with respect to the direction in which the coolant flows into the groove-like coolant passage is relatively small at a position where a part of the coolant supplied from the coolant supply port strikes on the supporting section. In the cylinder block in which the thermal insulator for the cylinder bore wall of the first (B) form of the present invention, a part of the coolant supplied from the coolant supply port strikes on the rear surface side of the supporting section, but does not strongly strike thereon. In addition, much of the coolant supplied from the coolant supply port flows to pass through an area between the supporting section and the wall surface on the opposite side of the wall surface on the cylinder bore side of the groove-like coolant passage.

The inclined wall related to the thermal insulator for the cylinder bore wall of the first (B) form of the present invention extends with an upward inclination from, as a start point, the vicinity of a position of the supporting section on which the coolant flowing from the coolant supply port firstly strikes. In the form example illustrated in FIG. 44, the coolant supply port 44 is provided at the position illustrated in FIG. 44, but the position of the coolant supply port varies depending on the type of internal combustion engine. Therefore, the position of the start point of the inclined wall is selected as appropriate according to the formation position of the coolant supply port of the cylinder block in which the thermal insulator for the cylinder bore wall of the present invention is set.

In the thermal insulator for the cylinder bore wall of the first (B) form of the present invention, the inclined wall is a wall for creating the flow of the coolant from the vicinity of the position where the coolant firstly strikes on the supporting section toward the coolant passage opening so that the coolant flowing from the coolant supply opening flows toward the coolant passage opening. The inclined wall extends with an upward inclination from, as a start point, the vicinity of the position where the coolant flowing from the coolant supply opening firstly strikes on the supporting section. The number of inclined walls is selected as appropriate according to the number of coolant passage opening formed in the supporting section. An inclination angle of the inclined wall is selected as appropriate by the position of the coolant passage opening formed in the supporting section. The end point of the inclined wall is selected as appropriate in a range in which the effects of the present invention are achieved. In the form example illustrated in FIG. 36, the inclined walls 50*a*, 50*b*, and 50*c* extend to the vicinity of the inter-bore portion, and the inclined wall 50*a* is connected to the lower end of the guide wall 46*a*. The inclined wall may or need not be connected to the guide wall.

Figure 45:
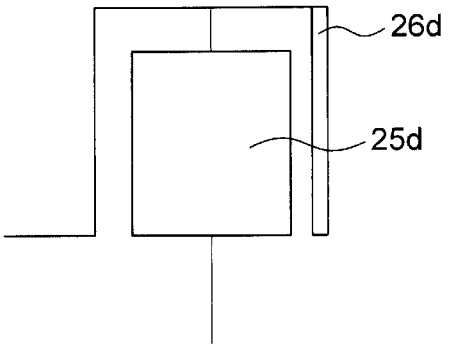
FIG. 45 is a schematic view illustrating a form example of a guide wall.
Figure 45:
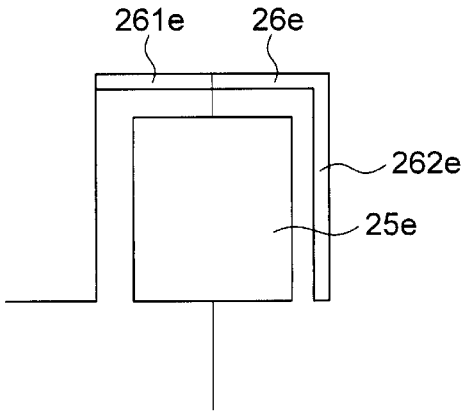
Figure 45:
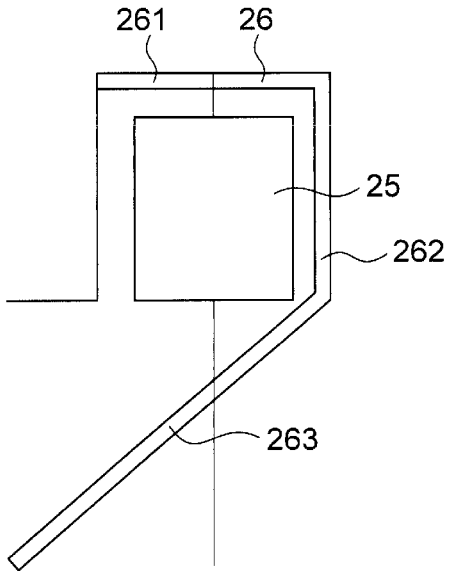

In the thermal insulator for the cylinder bore wall of the first form of the present invention, a coolant passage opening is formed on an upper portion of a supporting section inter-bore portion. The coolant passage opening is a passage opening through which the coolant flowing on the rear surface side of the supporting section passes to flow to the inner side of the supporting section. The guide wall is formed in the vicinity of the coolant passage opening. The guide wall is a wall for guiding the coolant such that the coolant flowing from the coolant contact surface toward the coolant passage opening flows into the coolant passage opening. Since the coolant flows from the obliquely lower side toward the coolant passage opening, when the guide wall is formed on the lateral side in the coolant flow direction of the coolant passage opening similarly to the guide wall 26*d* illustrated in FIG. 45(A), the coolant flowing toward the coolant passage opening can be blocked by the guide wall formed on the lateral side in the coolant flow direction of the coolant passage opening. Therefore, the coolant can flow into the coolant passage opening 25. Accordingly, the guide wall has a wall at least on the lateral side in the coolant flow direction. As a form example of the guide wall, the guide wall includes a guide wall upper side portion 261*e* formed on the upper side of the coolant passage opening and a guide wall side portion 261*e* formed on the lateral side in the coolant flow direction similarly to the guide wall 26*e* illustrated in FIG. 45(B). Since the coolant flows from the obliquely lower side toward the coolant passage opening, the effect of feeding the coolant to the coolant passage opening is increased by providing the guide wall upper side portion on the upper side of the coolant passage opening in addition to the guide wall side portion formed on the lateral side in the flow direction of the coolant passage opening. Here, forming the guide wall on the upper side in addition to the guide wall on the lateral side of the coolant passage opening leads to large pressure loss of the coolant. Therefore, in the thermal insulator for the cylinder bore wall of the present invention, whether the guide wall is formed only on the lateral side in the flow direction of the coolant passage opening or the guide walls are formed on both of the lateral side in the flow direction and the upper side of the coolant passage opening is selected as appropriate. That is, in the case of placing importance on prevention of increase in pressure loss, the guide wall is formed only on the lateral side in the flow direction of the coolant passage opening. In the case of placing more importance on cooling efficiency than on prevention of increase in pressure loss, the guide walls are formed on both of the lateral side in the flow direction and the upper side of the coolant passage opening. Some coolant flowing from the coolant contact surface toward the coolant passage opening flows slightly below the coolant passage opening. As illustrated in FIG. 45(C), the coolant gathering wall 263 extending with an upward inclination toward the lower end of the wall of the guide wall side portion 262 on the lateral side in the coolant flow direction of the coolant passage opening can be used to gather the coolant flowing slightly below the coolant passage opening and passing through the coolant passage opening at the coolant passage opening 25. Therefore, the guide wall that includes the coolant gathering wall extending with an upward inclination toward the lower end of the guide wall side portion in the coolant flow direction of the coolant passage opening is desirable in that the amount of the coolant flowing into the coolant passage opening can be increased. Note that the presence and absence of the coolant gathering wall is selected as appropriate according to the use purpose or the like of the thermal insulator. The coolant gathering wall may be connected to the lower end of the guide wall. Alternatively, when extending to the vicinity of the lower end of the guide wall, the coolant gathering wall need not be connected thereto. It is desirable that the coolant gathering wall is connected to the lower end of the guide wall.

When the coolant is supplied to the groove-like coolant passage in a state in which the thermal insulator for the cylinder bore wall of the first form of the present invention is set in the groove-like coolant passage of the cylinder lock, the coolant supplied to the groove-like coolant passage flows toward the coolant passage opening by the inclined wall formed on the rear surface side of the supporting section bore portion at a position where the coolant is supplied into the groove-like coolant passage, the coolant passage opening formed on the upper portion of the supporting section inter-bore portion, and the guide wall formed in the vicinity of the coolant passage opening, flows into the coolant passage opening, further passes through the coolant passage opening, and strikes on the upper portion of the boundary of the bore walls of the cylinder bores and the vicinity of the boundary. The coolant flowing on the rear surface side of the supporting section from the coolant supply port and flowing toward the coolant passage opening has a low temperature, and the temperature of the upper portion of the boundary of the bore walls of the cylinder bores and the vicinity of the boundary is the highest in the wall surface on the cylinder bore side of the groove-like coolant passage. Accordingly, in the thermal insulator for the cylinder bore wall of the present invention, the coolant having a low temperature that has flowed from the coolant supply port toward the coolant passage opening can strike on the highest temperature portion in the wall surface on the cylinder bore side of the groove-like coolant passage, whereby the cooling efficiency can be increased. In particular, in the case in which the passage hole of the coolant is formed in the inter-bore wall called a drill path, the opening of the drill path is provided on the upper portion of the boundary of the bore walls of the cylinder bores and the vicinity of the boundary. In that case, the coolant having a low temperature strikes on the upper portion of the boundary of bore walls of the cylinder bore walls and the vicinity of the boundary, this upper portion can be cooled and the coolant can flow in the drill path efficiently, whereby the inter-bore wall can be directly cooled with the coolant having a low temperature. Therefore, the cooling efficiency can be increased.

A thermal insulator for a cylinder bore wall of a second form of the present invention is a thermal insulator set in a groove-like coolant passage of a cylinder block of an internal combustion engine including cylinder bores and for insulating all of bore walls in a circumferential direction of all the cylinder bores or a part of the bore walls in the circumferential direction of all the cylinder bores when viewed in the circumferential direction, the thermal insulator including: bore wall insulating sections having an arcuate shape when viewed from above and for insulating a wall surface on the cylinder bore side of the groove-like coolant passage; and a supporting section having a shape conforming to a shape of the groove-like coolant passage in a setting position of the thermal insulator, the bore wall insulating sections being fixed to the supporting section, wherein each of the bore wall insulating sections includes: a rubber member in contact with the wall surface on the cylinder bore side of the groove-like coolant passage and for covering the wall surface on the cylinder bore side of the groove-like coolant passage; a rear surface pressing member provided on a rear surface side of the rubber member and for pressing the entire rubber member toward the wall surface on the cylinder bore side of the groove-like coolant passage from the rear surface side; and elastic members that urge the rear surface pressing member to press the rubber member toward the wall surface on the cylinder bore side of the groove-like coolant passage, in each of supporting section bore portions to which the respective bore wall insulating sections are to be fixed, an opening, through which the elastic member passes from an inner side to the rear surface side of the supporting section is formed, a coolant passage opening through which coolant flowing on the rear surface side of the supporting section passes to flow to the inner side of the supporting section is formed on at least one place of upper portions of supporting section inter-bore portions, the supporting section has a guide wall for guiding the coolant formed in a vicinity of the coolant passage opening, such that the coolant flows into the coolant passage opening, and a coolant gathering wall extending with an upward inclination toward the guide wall, and only a center or a vicinity of the center in an arc direction of each of the bore wall insulating sections is fixed to the supporting section.

The thermal insulator for the cylinder bore wall of the second form of the present invention is set in the groove-like coolant passage of the cylinder block of the internal combustion engine. The cylinder block in which the thermal insulator for the cylinder bore wall of the second form of the present invention is set is a cylinder block of an open deck type in which two or more cylinder bores are formed side by side in series, similarly to the cylinder block in which the thermal insulator for the cylinder bore wall of the first form of the present invention is set.

A position where the thermal insulator for the cylinder bore wall of the second form of the present invention is set is the same as that where the thermal insulator for the cylinder bore wall of the first form of the present invention. The thermal insulator for the cylinder bore wall of the second form of the present invention is desirably set in a middle and lower part of the groove-like coolant passage when in the structure of the internal combustion engine in which the thermal insulator for the cylinder bore wall is set, a position equivalent to the middle and lower part of the groove-like coolant passage of the cylinder bore is a position where the speed of a piston increases. When in the structure of the internal combustion engine in which the thermal insulator for the cylinder bore wall is set, a position corresponding to a lower part of the groove-like coolant passage of the cylinder bore is a position where the speed of a piston increases, the thermal insulator for the cylinder bore wall is desirably set in the lower part of the groove-like coolant passage.

The thermal insulator for the cylinder bore wall of the second form of the present invention includes the insulating section for insulating the wall surface on the cylinder bore side of the groove-like coolant passage and the supporting section to which the insulating section is fixed. The thermal insulator for the cylinder bore wall of the second form of the present invention is a thermal insulator for insulating all of the wall surfaces on the cylinder bore side of the groove-like coolant passage or a part of the wall surfaces on the cylinder bore side of the groove-like coolant passage when viewed in the circumferential direction. That is, the thermal insulator for the cylinder bore wall of the second form of the present invention is a thermal insulator for insulating all of bore walls in the circumferential direction of all the cylinder bores or a part of the bore walls in the circumferential direction of all the cylinder bores when viewed in the circumferential direction. Examples of the thermal insulator for the cylinder bore wall of the second form of the present invention include a thermal insulator for insulating a part of one side among the bore walls of all the cylinder bores as in a form example illustrated in FIG. 15, a thermal insulator for insulating all of bore walls of all the cylinder bores, and a thermal insulator for insulating a one one-side half and a part of the other one side of the bore walls of all the cylinder bores.

In the thermal insulator for the cylinder bore wall of the second form of the present invention, the bore wall insulating sections are set for each of the bore walls of the cylinder bores about to be insulated by the bore wall insulating sections. The number and a setting range of the bore wall insulating sections are selected as appropriate according to the number and insulating parts of the bore walls of the cylinder bores about to be insulated by the bore wall insulating sections. In the thermal insulator for the cylinder bore wall of the second form of the present invention, one bore wall insulating section may be set in one supporting section bore portion, two bore wall insulating sections may be set in one supporting section bore portion, or three or more bore wall insulating sections may be set in one supporting section bore portion, similarly to the thermal insulator for the cylinder bore wall of the first form of the present invention. Alternatively, these forms may be combined. Alternatively, the bore wall insulating sections need not be set in a part of the supporting section bore portions. In the thermal insulator for the cylinder bore wall of the second form of the present invention, when viewed from the contact surface side, a bore wall thermal insulator may be set in substantially an entire one supporting section bore portion, a bore wall thermal insulator may be set in a part of one supporting section bore portion, or a bore wall insulating section may be a combination of these forms, similarly to the thermal insulator for the cylinder bore wall of the first form of the present invention.

The supporting section is a supporting member on which the bore wall insulating section is fixed and supported. The bore wall insulating section is fixed to the supporting section, whereby the supporting section plays a role of defining a position of the bore wall insulating section such that the position of the bore wall insulating section does not deviate in the groove-like coolant passage. When viewed from above, the supporting section has a shape conforming to the groove-like coolant passage in which the thermal insulator for the cylinder bore wall of the second form of the present invention is set. Examples of the shape of the supporting section include a shape corresponding to all of the groove-like coolant passage of the cylinder block (that is, a shape surrounding all the cylinder bore walls), a shape corresponding to one-side half of the groove-like coolant passage of the cylinder block, a shape corresponding to a part of one side of the groove-like coolant passage of the cylinder block, a shape corresponding to one one-side half and a part of the other one side connected thereto, and a shape corresponding to a part of one one-side half and a part of the other one side connected thereto.

The bore wall insulating section related to the thermal insulator for the cylinder bore wall of the second form of the present invention includes the rubber member, the rear surface pressing member, and the elastic members. The bore wall insulating section related to the thermal insulator for the cylinder bore wall of the second form of the present invention, the rubber member, the rear surface pressing member, and the elastic members are the same as the bore wall insulating section related to the thermal insulator for the cylinder bore wall of the first form of the present invention, the rubber member, the rear surface pressing member, and the elastic members, respectively.

In the thermal insulator for the cylinder bore wall of the second form of the present invention, the bore wall insulating sections are fixed to the supporting section such that the contact surface of the rubber member faces the wall surface on the cylinder bore side of the groove-like coolant passage and the contact surface of the rubber member can come into contact with the wall surface on the cylinder bore side of the groove-like coolant passage. On the rear surface side of the thermal insulator for the cylinder bore wall of the second form of the present invention, the elastic members attached to the bore wall insulating sections project toward the opposite side of the rubber member through openings of the supporting section such that the elastic members can come into contact with the wall surface on the opposite side of the wall surface on the cylinder bore side of the groove-like coolant passage.

The number of bore wall insulating sections fixed to the supporting section is selected as appropriate according to the number and insulating parts of bore walls of the cylinder bores about to be insulated by the bore wall insulating sections.

The supporting section is a member to which the bore wall insulating sections are fixed such that the positions of the bore wall insulating sections in the groove-like coolant passage do not deviate. Therefore, the supporting section has a shape conforming to the groove-like coolant passage in the setting position of the thermal insulator for the cylinder bore wall of the present invention. When viewed from above, the supporting section is formed into a shape surrounding all the cylinder bores or a shape of a continuous plurality of arcs. The supporting section is made of a synthetic resin, metal or the like. The supporting section is made of a synthetic resin, metal or the like. The supporting section is desirably made of a synthetic resin. Usually, the supporting section made of a synthetic resin is manufactured by being integrally formed together with a member attached to the supporting section such as the coolant flow partitioning member by injection molding of the synthetic resin. The material of the supporting section is not limited to a particular material if the material has heat resistance and LLC resistance. The material only has to be a synthetic resin, a metal material or the like used in a thermal insulator for a bore wall of a cylinder bore and a water jacket spacer.

In the supporting section, the opening sections, through which the elastic members attached to the bore wall insulating sections present further on the wall surface side on the cylinder bore side of the groove-like coolant passage than the supporting section pass, are formed such that the elastic members can come into contact with the wall surface on the opposite side of the wall surface on the cylinder bore side of the groove-like coolant passage.

The thermal insulator for the cylinder bore wall of the second form of the present invention may be a thermal insulator in which the bore wall insulating sections are set in all of the supporting section bore portions or may be a thermal insulator in which the bore wall insulating sections are set in a part of all the supporting section bore portions. Examples of a form of the thermal insulator for the cylinder bore wall of the present invention in which the bore wall insulating sections are set in a part of all the supporting section bore portions include a thermal insulator in which the shape of the supporting section is a shape surrounding the bore walls of all the cylinder bores and the bore wall insulating sections are set in a part of all the supporting section bore portions, and a thermal insulator in which the shape of the supporting section is a shape corresponding to a one-side half among the bore walls of all the cylinder bores and the bore wall insulating sections are set in a part of all the supporting section bore portions. Examples of a form of the thermal insulator for the cylinder bore wall of the second form of the present invention in which the bore wall insulating sections are set in all of all the supporting section bore portions include a thermal insulator in which the shape of the supporting section is a shape surrounding the bore walls of all the cylinder bores and the bore wall insulating sections are set in all of all the supporting section bore portions.

In the thermal insulator for the cylinder bore wall of the second form of the present invention, a range in which the bore wall insulating section is fixed to the supporting section, specifically, the length of the fixing portion in the arc direction when viewed from above and the length of the fixing portion in the up-down direction when viewed from a side are selected as appropriate in a range in which the effects of the present invention are achieved.

All of the supporting section bore portions of the thermal insulator for the cylinder bore wall of the second form of the present invention have no inclined wall formed on the rear surface side thereof.

In the thermal insulator for the cylinder bore wall of the second form of the present invention, a coolant passage opening is formed on an upper portion of a supporting section inter-bore portion. The coolant passage opening is a passage opening through which the coolant flowing on the rear surface side of the supporting section passes to flow to the inner side of the supporting section. The guide wall is formed in the vicinity of the coolant passage opening, to guide the coolant such that the coolant flowing toward the coolant passage opening flows into the coolant passage opening. In the thermal insulator for the cylinder bore wall of the second form of the present invention, the guide wall includes an upper wall formed on the upper side of the coolant passage opening and a side wall formed on the lateral side in the coolant flow direction of the coolant passage opening. The thermal insulator for the cylinder bore wall of the second form of the present invention is set in the groove-like coolant passage in the one-side half on the opposite side of a side where the coolant that has flowed into the groove-like coolant passage vigorously flows. Therefore, the coolant slowly flows on the rear surface side of the supporting section of the thermal insulator for the cylinder bore wall of the second form of the present invention. When a passage hole of the coolant called a drill path is provided in the cylinder block, the passage hole passing from the upper portion of the boundary of the bore walls of the cylinder bores to the inter-bore wall of the cylinder head, the gentle flow of the coolant toward the upper portion of the boundary of bore walls of the cylinder bores, that is, the coolant passage opening formed on the upper portion of the inter-bore portion is created in the groove-like coolant passage on the rear surface side of the supporting section of the thermal insulator for the cylinder bore wall of the second form of the present invention. In the thermal insulator for the cylinder bore wall of the second form of the present invention, the coolant gathering wall extending in an upward inclination toward the side wall of the guide wall is formed. The coolant flowing below the coolant passage opening is gathered, toward the coolant passage opening, together with the coolant flowing toward the coolant passage opening by the coolant gathering wall, and flows into the coolant passage opening by the guide wall. Accordingly, in the thermal insulator for the cylinder bore wall of the second form of the present invention, the coolant flowing on the rear surface side can be gathered to flow into an inlet of the drill path, whereby the cooling efficiency can be increased. The coolant gathering wall may be connected to the lower end of the guide wall. Alternatively, when extending to the vicinity of the lower end of the guide wall, the coolant gathering wall need not be connected thereto. It is desirable that the coolant gathering wall is connected to the lower end of the guide wall.

In the form example illustrated in FIG. 20 and FIG. 21, the thermal insulator for the cylinder bore wall of the first form of the present invention is set in one one-side half of the groove-like coolant passage of the cylinder block and the thermal insulator for the cylinder bore wall of the second form of the present invention is set in the other one-side half of the groove-like coolant passage, but the present invention is not limited to this form. Only the thermal insulator for the cylinder bore wall of the first form of the present invention may be set in the groove-like coolant passage of the cylinder block. Alternatively, only the thermal insulator for the cylinder bore wall of the second form of the present invention may be set in the groove-like coolant passage of the cylinder block. Alternatively, the thermal insulator for the cylinder bore wall of the first form of the present invention and the thermal insulator for the cylinder bore wall of the second form of the present invention may be set in one one-side half and the other one-side half of the groove-like coolant passage, respectively. Alternatively, the thermal insulator for the cylinder bore wall of the first form of the present invention and a thermal insulator for a cylinder bore wall other than the thermal insulator for the cylinder bore wall of the present invention or a water jacket spacer may be set in one one-side half and the other one-side half of the groove-like coolant passage, respectively. Alternatively, the thermal insulator for the cylinder bore wall of the second form of the present invention and a thermal insulator for a cylinder bore wall other than the thermal insulator for the cylinder bore wall of the present invention or a water jacket spacer may be set in one one-side half and the other one-side half of the groove-like coolant passage, respectively. Alternatively, a thermal insulator for a cylinder bore wall in a form in which the thermal insulator for the cylinder bore wall of the first form of the present invention and the thermal insulator for the cylinder bore wall of the second form of the present invention are combined (described later) may be set in the groove-like coolant passage.

As the thermal insulator for the cylinder bore wall of the first form of the present invention and the thermal insulator for the cylinder bore wall of the second form of the present invention, when viewed in the circumferential direction, the shape of the supporting section is a shape conforming to the entire circumference of the groove-like coolant passage, and a thermal insulator for a cylinder bore wall is provided by combining the thermal insulator for the cylinder bore wall of the first form of the present invention and the thermal insulator for the cylinder bore wall of the second form of the present invention. In a thermal insulator 36*e* for a cylinder bore wall of a form example illustrated in FIG. 47 to FIG. 50, the shape of the supporting section is a shape conforming to the entire circumference of the groove-like coolant passage. In addition, the inclined walls are formed in the bore portion 561 at a position where the coolant is supplied into the groove-like coolant passage, the coolant passage openings 45*a*, 45*b*, and 45*c* and the guide walls 46*a*, 46*b*, and 46*c* are formed on the upper portions of the inter-bore portions that are set in the groove-like coolant passage in one one-side half in which the coolant flows more vigorously than in the other one-side half, and the coolant gathering wall 463 is formed as needed. In addition, the coolant passage openings 46*d*, 46*e*, and 46*f*, the guide wall including the upper wall formed on the upper side of the coolant passage opening and the side wall on the lateral side in the coolant flow direction of the coolant passage opening, and the coolant gathering wall are formed on the upper portion of the inter-bore portions set in the groove-like coolant passage in the one-side half on the opposite side of a side where the coolant vigorously flows. The coolant flow changing member 66 is formed in front of the coolant supply port of the groove-like coolant passage in the one-side half on the opposite side of a side where the coolant vigorously flows.

As a form in which the thermal insulator for the cylinder bore wall of the first form of the present invention and the thermal insulator for the cylinder bore wall of the second form of the present invention are combined, that is, a thermal insulator for a cylinder bore wall having a shape conforming to the entire circumference of the groove-like coolant passage, and having a feature of the thermal insulator for the cylinder bore wall of the first form of the present invention in one one-side half of the groove-like coolant passage and a feature of the thermal insulator for the cylinder bore wall of the second form of the present invention in the other one-side half of the groove-like coolant passage is a thermal insulator set in the groove-like coolant passage of a cylinder block of an internal combustion engine including cylinder bores and for insulating all of bore walls in a circumferential direction of all the cylinder bores when viewed in the circumferential direction, the thermal insulator including: bore wall insulating sections having an arcuate shape when viewed from above and for insulating a wall surface on the cylinder bore side of the groove-like coolant passage; and a supporting section having a shape conforming to a shape of the groove-like coolant passage in a setting position of the thermal insulator, the bore wall insulating sections being fixed to the supporting section, wherein each of the bore wall insulating sections includes: a rubber member in contact with the wall surface on the cylinder bore side of the groove-like coolant passage and for covering the wall surface on the cylinder bore side of the groove-like coolant passage; a rear surface pressing member provided on a rear surface side of the rubber member and for pressing the entire rubber member toward the wall surface on the cylinder bore side of the groove-like coolant passage from the rear surface side; and elastic members that urge the rear surface pressing member to press the rubber member toward the wall surface on the cylinder bore side of the groove-like coolant passage, in each of supporting section bore portions to which the respective bore wall insulating sections are to be fixed, an opening, through which the elastic member passes from an inner side to the rear surface side of the supporting section is formed, a coolant passage opening through which coolant flowing on the rear surface side of the supporting section passes to flow to the inner side of the supporting section is formed on at least one place of upper portions of supporting section inter-bore portions set in the groove-like coolant passage in one-side half in which the coolant flows more vigorously, the supporting section set in the groove-like coolant passage in the one-side half in which the coolant flows more vigorously has a guide wall for guiding the coolant formed in a vicinity of the coolant passage opening, such that the coolant flows into the coolant passage opening, further has a coolant gathering wall extending with an upward inclination toward the guide wall, and has an inclined wall formed on the rear surface side of the supporting section at a position where the coolant is supplied into the groove-like coolant passage, the inclined wall extending with an upward inclination to create a flow of the coolant toward the coolant passage opening, a coolant passage opening through which coolant flowing on the rear surface side of the supporting section passes to flow to the inner side of the supporting section is formed on at least one place of upper portions of supporting section inter-bore portions set in the groove-like coolant passage in one-side half on an opposite side of the one-side half in which the coolant flows more vigorously, the supporting section set in the groove-like coolant passage in the one-side half on the opposite side of the one-side half in which the coolant flows more vigorously has a guide wall for guiding the coolant formed in a vicinity of the coolant passage opening, such that the coolant flows into the coolant passage opening, and a coolant gathering wall extending with an upward inclination toward the guide wall, and only a center or a vicinity of the center in an arc direction of each of the bore wall insulating sections is fixed to the supporting section.

The supporting section is made of a synthetic resin, metal or the like. The supporting section is desirably made of a synthetic resin. Usually, the supporting section made of a synthetic resin is manufactured by being integrally formed together with a member attached to the supporting section such as the coolant flow partitioning member by injection molding of the synthetic resin. The material of the supporting section is not limited to a particular material if the material has heat resistance and LLC resistance. The material only has to be a synthetic resin, a metal material or the like used in a thermal insulator for a bore wall of a cylinder bore and a water jacket spacer. The coolant gathering wall may be connected to the lower end of the guide wall. Alternatively, when extending to the vicinity of the lower end of the guide wall, the coolant gathering wall need not be connected thereto. It is desirable that the coolant gathering wall is connected to the lower end of the guide wall.

The thermal insulator for the cylinder bore wall of the present invention (the thermal insulator for the cylinder bore wall of the first form of the present invention and the thermal insulator for the cylinder bore wall of the second form of the present invention) may include a horizontal rib formed on the upper portion on the rear surface side of the supporting section, the horizontal rib extending in parallel to the coolant flow direction. The thermal insulator for the cylinder bore wall of the present invention includes the horizontal rib formed on the upper portion on the rear surface side, the horizontal rib extending in parallel to the coolant flow direction, whereby the coolant flowing on the upper portion of the groove-like coolant passage can be prevented from flowing down into a middle and lower part. A formation position in the up-down direction of the horizontal rib extending in parallel to the coolant flow direction, the horizontal rib being formed on the upper portion on the rear surface side, and the formation position and length in the coolant flow direction of the horizontal rib are selected as appropriate.

The thermal insulator for the cylinder bore wall of the present invention (the thermal insulator for the cylinder bore wall of the first form of the present invention and the thermal insulator for the cylinder bore wall of the second form of the present invention) may include a cylinder head contact portion formed in the supporting section to prevent the water jacket spacer from deviating in the upward direction, the other parts or member. In addition, the thermal insulator for the cylinder bore wall of the present invention may include a member for adjusting the other coolant flow.

An internal combustion engine of the present invention is an internal combustion engine in which at least one of the thermal insulator for the cylinder bore wall of the first form of the present invention, the thermal insulator for the cylinder bore wall of the second form of the present invention, and the thermal insulator for the cylinder bore wall in a form in which the thermal insulator for the cylinder bore wall of the first form of the present invention and the thermal insulator for the cylinder bore wall of the second form of the present invention are combined is set in the entire or a part of the groove-like coolant passage of the cylinder block.

The internal combustion engine of the present invention is an internal combustion engine in which the thermal insulator for the cylinder bore wall of the first form is set in one one-side half of the groove-like coolant passage of the cylinder block and the thermal insulator for the cylinder bore wall of the second form is set in the other one-side half of the groove-like coolant passage of the cylinder block.

In the internal combustion engine of the present invention, the thermal insulator for the cylinder bore wall of the first form of the present invention or the thermal insulator for the cylinder bore wall of the second form of the present invention is set in the entire or a part of the groove-like coolant passage of the cylinder block. A water jacket spacer other than the water jacket spacer of the present invention or a thermal insulator for a cylinder bore wall may be set in the groove-like coolant passage in which the thermal insulator for the cylinder bore wall of the first form of the present invention or the thermal insulator for the cylinder bore wall of the second form of the present invention is not formed.

The internal combustion engine of the present invention is an internal combustion engine in which the thermal insulator for the cylinder bore wall of the present invention is set.

An automobile of the present invention is an automobile including the internal combustion engine of the present invention.

INDUSTRIAL APPLICABILITY

According to the present invention, since it is possible to improve adhesion of the thermal insulator to the wall surface on the cylinder bore side of the groove-like coolant passage of the cylinder block, it is possible to improve a heat retaining property of the wall surface on the cylinder bore side of the groove-like coolant passage. In addition, the coolant having a low temperature can strike on the upper portion of the boundary of the bore walls of the cylinder bore walls and the vicinity of the boundary, whereby the cooling efficiency can be increased. Therefore, since it is possible to reduce a difference in a deformation amount between the upper side and the lower side of the cylinder bore wall of the internal combustion engine, it is possible to reduce the friction of the piston. Therefore, it is possible to provide a fuel-saving internal combustion engine. Furthermore, it is possible to increase the cooling efficiency of an internal combustion engine with a large air-fuel ratio, the temperature of which being higher than that of the conventional internal combustion engine.

REFERENCE SIGNS LIST

5, 55 Vertical rib
6 Contact surface
8 Bottom part
9 Top part
10 Position near middle
11 Cylinder block
12 Bore
**12*a*1, 12*a*2** End bore
**12*b*1, 12*b*2** Intermediate bore
13 Cylinder bore wall
14 Groove-like coolant passage

15, 44 Coolant supply port
16 Coolant discharge port
17 Wall surface on cylinder bore side of groove-like coolant passage 14
17*a*, 17*b* Wall surface in one-side half side
18 Wall surface on opposite side of wall surface on cylinder bore side of groove-like coolant passage 14
20*a*, 20*b* One-side half
21*a*, 21*b* Bore wall in one-side half
23*a*1, 23*a*2, 23*b*1, 23*b*2 Bore wall of cylinder bore
24, 24*b* Coolant flow suppressing wall
25, 25*a*, 25*b*, 25*c*, 25*d*, 25*e*, 45*a*, 45*b*, 45*c* Coolant passage opening
26, 26*a*, 26*b*, 26*c*, 26*d*, 26*e*, 46*a*, 46*b*, 46*c* Guide wall
29, 29*b* Coolant contact surface
30, 30*a*, 30*b*, 50*a*, 50*b*, 50*c* Inclined wall
27, 27*a* Distal end
28 Other end side
30 Hollow square-shaped backing plate
31, 31*c*, 31*g* Rubber member
32, 47 Rear surface pressing member
33, 33*a*, 33*g* Metal-leaf-spring attaching member
34*a*, 34*b*, 34*c* Supporting section
35, 35*c*, 35*d*1, 35*d*2, 35*e*, 35*f* Bore wall insulating section
36*a*, 36*b*, 36*c*, 36*d* Thermal insulator for cylinder bore wall
37, 40, 41, 40*d* Bending section
39, 39*a* Metal leaf spring
42 Opening
43 Metal plate
45 Punched product of metal plate
48 Boundary of supporting section bore portions
51 Coolant flow direction
52 Opposite direction of coolant flow direction
53 Coolant
54 Supporting section inter-bore portion
66 Coolant flow changing member
131 Inter-bore wall
192 Boundary of bore walls of cylinder bores of wall surface on cylinder bore side of groove-like coolant passage
241 Lateral side portion of coolant flow suppressing wall
242 Lower side portion of coolant flow suppressing wall
243 Upper side portion of coolant flow suppressing wall
261, 261*e* Upper side portion of guide wall
262, 262*e* Lateral side portion of guide wall
263 Coolant gathering wall of guide wall
271 Folding-back section
361, 361*b*, 561 Supporting section bore portion in which inclined wall is formed
362, 362*a*, 362*b*, 362*c*, 562, 562*a*, 562*b*, 562*c*, 562*d*, 562*e* Supporting section bore portion in which inclined wall is not formed
661 Coolant flow changing wall
662 Enclosure wall

The invention claimed is:

1. A thermal insulator for a cylinder bore wall set in a groove-like coolant passage of a cylinder block of an internal combustion engine including cylinder bores and for insulating all of bore walls in a circumferential direction of all the cylinder bores or a part of the bore walls in the circumferential direction of all the cylinder bores when viewed in the circumferential direction, the thermal insulator comprising:

bore wall insulating sections having an arcuate shape when viewed from above and for insulating a wall surface on the cylinder bore side of the groove-like coolant passage; and a supporting section having a shape conforming to a shape of the groove-like coolant passage in a setting position of the thermal insulator, the bore wall insulating sections being fixed to the supporting section only in a center or a vicinity of the center in an arc direction of each of the bore wall insulating sections, wherein each of the bore wall insulating sections includes: a rubber member in contact with the wall surface on the cylinder bore side of the groove-like coolant passage and for covering the wall surface on the cylinder bore side of the groove-like coolant passage; a rear surface pressing member provided on a rear surface side of the rubber member and for pressing the entire rubber member toward the wall surface on the cylinder bore side of the groove-like coolant passage from the rear surface side; and elastic members that urge the rear surface pressing member to press the rubber member toward the wall surface on the cylinder bore side of the groove-like coolant passage, an opening in each of supporting section bore portions to which the respective bore wall insulating sections are to be fixed, the opening being through which the elastic member passes from an inner side to the rear surface side of the supporting section, a coolant passage opening through which coolant flowing on the rear surface side of the supporting section passes to flow to an inner side of the supporting section is formed on at least one place of upper portions of supporting section inter-bore portions, and the supporting section has a guide wall for guiding the coolant formed in a vicinity of the coolant passage opening, such that the coolant flows into the coolant passage opening, and has an inclined wall formed on the rear surface side of the supporting section at a position where the coolant is supplied into the groove-like coolant passage, the inclined wall extending with an upward inclination to create a flow of the coolant toward the coolant passage opening.

2. The thermal insulator for a cylinder bore wall according to claim 1, wherein the rubber member is a heat-sensitive expanding rubber or a water-swelling rubber.

3. An internal combustion engine, wherein at least one of the thermal insulators for a cylinder bore wall according to claim 1 is set in an entire or a part of a groove-like coolant passage of a cylinder block.

4. An automobile including the internal combustion engine according to claim 3.

5. An internal combustion engine, wherein the thermal insulator for a cylinder bore wall according to claim 1 is set in one one-side half of a groove-like coolant passage of a cylinder block and a thermal insulator for a cylinder bore wall is set in the other one-side half of the groove-like coolant passage of the cylinder block, wherein the thermal insulator for a cylinder bore wall comprises:

bore wall insulating sections having an arcuate shape when viewed from above and for insulating a wall surface on the cylinder bore side of the groove-like coolant passage; and a supporting section having a shape conforming to a shape of the groove-like coolant passage in a setting position of the thermal insulator, the bore wall insulating sections being fixed to the supporting section, wherein each of the bore wall insulating sections includes: a rubber member in contact with the wall surface on the cylinder bore side of the groove-like coolant passage and for covering the wall surface on the cylinder bore side of the groove-like coolant passage; a rear surface pressing member provided on a rear surface side of the rubber member and for pressing the entire rubber member toward the wall surface on the cylinder bore side of the groove-like coolant passage from the rear surface side; and elastic members that urge the rear surface pressing member to press the rubber member toward the wall surface on the cylinder bore side of the groove-like coolant passage, in each of supporting section bore portions to which the respective bore wall insulating sections are to be fixed, an opening, through which the elastic member passes from an inner side to the rear surface side of the supporting section is formed, a coolant passage opening through which coolant flowing on the rear surface side of the supporting section passes to flow to an inner side of the supporting section is formed on at least one place of upper portions of supporting section inter-bore portions, the supporting section has a guide wall for guiding the coolant formed in a vicinity of the coolant passage opening, such that the coolant flows into the coolant passage opening, and a coolant gathering wall extending with an upward inclination toward the guide wall, and only a center or a vicinity of the center in an arc direction of each of the bore wall insulating sections is fixed to the supporting section.

6. An automobile including the internal combustion engine according to claim 5.

7. A thermal insulator for a cylinder bore wall set in a groove-like coolant passage of a cylinder block of an internal combustion engine including cylinder bores and for insulating all of bore walls in a circumferential direction of all the cylinder bores or a part of the bore walls in the circumferential direction of all the cylinder bores when viewed in the circumferential direction, the thermal insulator comprising:

bore wall insulating sections having an arcuate shape when viewed from above and for insulating a wall surface on the cylinder bore side of the groove-like coolant passage; and a supporting section having a shape conforming to a shape of the groove-like coolant passage in a setting position of the thermal insulator, the bore wall insulating sections being fixed to the supporting section only in a center or a vicinity of the center in an arc direction of each of the bore wall insulating sections, wherein each of the bore wall insulating sections includes: a rubber member in contact with the wall surface on the cylinder bore side of the groove-like coolant passage and for covering the wall surface on the cylinder bore side of the groove-like coolant passage; a rear surface pressing member provided on a rear surface side of the rubber member and for pressing the entire rubber member toward the wall surface on the cylinder bore side of the groove-like coolant passage from the rear surface side; and elastic members that urge the rear surface pressing member to press the rubber member toward the wall surface on the cylinder bore side of the groove-like coolant passage, an opening in each of supporting section bore portions to which the respective bore wall insulating sections are to be fixed, the opening being through which the elastic member passes from an inner side to the rear surface side of the supporting section, a coolant passage opening through which coolant flowing on the rear surface side of the supporting section passes to flow to an inner side of the supporting section is formed on at least one place of upper portions of supporting section inter-bore portions, and the supporting section has a guide wall for guiding the coolant formed in a vicinity of the coolant passage opening, such that the coolant flows into the coolant passage opening, and a coolant gathering wall extending with an upward inclination toward the guide wall.

8. The thermal insulator for a cylinder bore wall according to claim 7, wherein the rubber member is a heat-sensitive expanding rubber or a water-swelling rubber.

9. An internal combustion engine, wherein at least one of the thermal insulators for a cylinder bore wall according to claim 7 is set in an entire or a part of a groove-like coolant passage of a cylinder block.

10. A thermal insulator for a cylinder bore wall set in the groove-like coolant passage of a cylinder block of an internal combustion engine including cylinder bores and for insulating all of bore walls in a circumferential direction of all the cylinder bores when viewed in the circumferential direction, the thermal insulator comprising:

bore wall insulating sections having an arcuate shape when viewed from above and for insulating a wall surface on the cylinder bore side of the groove-like coolant passage; and a supporting section having a shape conforming to a shape of the groove-like coolant passage in a setting position of the thermal insulator, the bore wall insulating sections being fixed to the supporting section only in a center or a vicinity of the center in an arc direction of each of the bore wall insulating sections, wherein each of the bore wall insulating sections includes: a rubber member in contact with the wall surface on the cylinder bore side of the groove-like coolant passage and for covering the wall surface on the cylinder bore side of the groove-like coolant passage; a rear surface pressing member provided on a rear surface side of the rubber member and for pressing the entire rubber member toward the wall surface on the cylinder bore side of the groove-like coolant passage from the rear surface side; and elastic members that urge the rear surface pressing member to press the rubber member toward the wall surface on the cylinder bore side of the groove-like coolant passage, an opening in each of supporting section bore portions to which the respective bore wall insulating sections are to be fixed, the opening being through which the elastic member passes from an inner side to the rear surface side of the supporting section, a coolant passage opening through which coolant flowing on the rear surface side of the supporting section passes to flow to an inner side of the supporting section is formed on at least one place of upper portions of supporting section inter-bore portions set in the groove-like coolant passage in one-side half in which the coolant flows more vigorously, the supporting section set in the groove-like coolant passage in the one-side half in which the coolant flows more vigorously has a guide wall for guiding the coolant formed in a vicinity of the coolant passage opening, such that the coolant flows into the coolant passage opening, and has an inclined wall formed on the rear surface side of the supporting section at a position where the coolant is supplied into the groove-like coolant passage, the inclined wall extending with an upward inclination to create a flow of the coolant toward the coolant passage opening, a coolant passage opening through which coolant flowing on the rear surface side of the supporting section passes to flow to an inner side of the supporting section is formed on at least one place of upper portions of supporting section inter-bore portions set in the groove-like coolant passage in one-side half on an opposite side of the one-side half in which the coolant flows more vigorously, and the supporting section set in the groove-like coolant passage in the one-side half on the opposite side of the one-side half in which the coolant flows more vigorously has a guide wall for guiding the coolant formed in a vicinity of the coolant passage opening, such that the coolant flows into the coolant passage opening, and has a coolant gathering wall extending with an upward inclination toward the guide wall.

11. The thermal insulator for a cylinder bore wall according to claim 10, wherein the rubber member is a heat-sensitive expanding rubber or a water-swelling rubber.

12. An internal combustion engine, wherein at least one of the thermal insulators for a cylinder bore wall according to claim 10 is set in an entire or a part of a groove-like coolant passage of a cylinder block.

* * * * *